US008646975B2

(12) United States Patent
Moehlenbrock et al.

(10) Patent No.: US 8,646,975 B2
(45) **Date of Patent: *Feb. 11, 2014**

(54) EASY OPEN AND RECLOSABLE PACKAGE WITH DISCRETE TAPE AND DIE-CUT WEB

(75) Inventors: Andrew W. Moehlenbrock, Simpsonville, SC (US); Joseph E. Owensby, Spartanburg, SC (US); Alexis M. Chalfant, Taylors, SC (US)

(73) Assignee: Cryovac, Inc., Duncan, SC (US)

( * ) Notice: Subject to any disclaimer, the term of this patent is extended or adjusted under 35 U.S.C. 154(b) by 256 days.

This patent is subject to a terminal disclaimer.

(21) Appl. No.: 12/843,281

(22) Filed: Jul. 26, 2010

(65) Prior Publication Data

US 2011/0038570 A1 Feb. 17, 2011

Related U.S. Application Data

(60) Provisional application No. 61/274,247, filed on Aug. 14, 2009.

(51) Int. Cl.
*B65D 33/00* (2006.01)
*B65D 65/26* (2006.01)

(52) U.S. Cl.
USPC ..... 383/204; 383/207; 383/209

(58) Field of Classification Search
USPC ..... 383/200, 203, 204, 207, 209, 210, 211
See application file for complete search history.

(56) References Cited

U.S. PATENT DOCUMENTS 2,719,663 A 10/1955 Meyer-Jagenberg
3,595,468 A 7/1971 Repko
3,613,874 A 10/1971 Miller
3,942,713 A 3/1976 Olson et al.
4,156,493 A 5/1979 Julius
4,318,506 A 3/1982 Hirsch
4,709,399 A 11/1987 Sanders (Continued)

FOREIGN PATENT DOCUMENTS

EP 0179624 A2 4/1986
EP 1254846 A1 11/2002

(Continued)

OTHER PUBLICATIONS

"Amcor E-close", on or about Apr. 2008 (document undated), 2 pages.

(Continued)

*Primary Examiner* — Jes F Pascua
*Assistant Examiner* — Peter Helvey
(74) *Attorney, Agent, or Firm* — Mark B. Quatt

(57) ABSTRACT

An easy-open and reclosable package includes a pouch including a discrete tape including a base strip between first and second side panels; at least a first portion of the first surface of the strip coated with a pressure sensitive adhesive and adhered by the adhesive to the inner surface of the first panel at a first location, and a second portion of the first surface of the strip anchored to the inner surface of the first panel at a second location; a die cut in the first panel, the die cut defining a die cut segment, the die cut segment so arranged that when the package is opened, it can be reclosed by adhering at least one of the first and second panels to the adhesive; and a product in the pouch.

5 Claims, 43 Drawing Sheets

(56) References Cited

U.S. PATENT DOCUMENTS

| | | | | |
|---|---|---|---|---|
| 4,785,940 | A | 11/1988 | Wilson | |
| 4,786,190 | A | 11/1988 | Van Erden et al. | |
| 4,902,142 | A | 2/1990 | Lammert et al. | |
| 4,946,038 | A | 8/1990 | Eaton | |
| 5,044,772 | A | 9/1991 | Larson | |
| 5,044,776 | A | 9/1991 | Schramer et al. | |
| 5,167,455 | A | 12/1992 | Forman | |
| 5,205,649 | A * | 4/1993 | Fullerton | 383/5 |
| 5,346,301 | A | 9/1994 | Scarberry et al. | |
| 5,391,136 | A * | 2/1995 | Makowka | 493/210 |
| 5,476,323 | A | 12/1995 | Gold | |
| 5,564,834 | A | 10/1996 | Porchia et al. | |
| 5,658,077 | A * | 8/1997 | Hoftman | 383/35 |
| 5,806,984 | A * | 9/1998 | Yeager | 383/204 |
| 5,836,697 | A | 11/1998 | Chiesa | |
| 5,855,435 | A | 1/1999 | Chiesa | |
| 5,882,749 | A | 3/1999 | Jones et al. | |
| 5,882,789 | A | 3/1999 | Jones et al. | |
| 5,954,433 | A * | 9/1999 | Yeager | 383/203 |
| 6,012,844 | A * | 1/2000 | Huseman et al. | 383/93 |
| 6,048,100 | A | 4/2000 | Thrall et al. | |
| 6,056,141 | A | 5/2000 | Navarini et al. | |
| 6,106,153 | A | 8/2000 | Toshima | |
| 6,196,716 | B1 * | 3/2001 | Geyer | 383/5 |
| D447,054 | S | 8/2001 | Hill | |
| 6,461,044 | B1 * | 10/2002 | Anderson | 383/211 |
| 6,502,986 | B1 * | 1/2003 | Bensur et al. | 383/211 |
| 6,589,622 | B1 | 7/2003 | Scott | |
| 6,662,843 | B1 | 12/2003 | Johnson | |
| 6,793,077 | B1 | 9/2004 | Kancsar et al. | |
| 6,865,860 | B2 | 3/2005 | Arakawa et al. | |
| 6,925,779 | B2 | 8/2005 | Thieman | |
| 7,033,077 | B2 * | 4/2006 | Taylor | 383/62 |
| 7,041,042 | B2 | 5/2006 | Chertkow et al. | |
| 7,073,309 | B2 | 7/2006 | Van Driesten | |
| 7,216,764 | B2 | 5/2007 | Forman | |
| 7,217,033 | B2 | 5/2007 | Pritchard | |
| 7,305,805 | B2 | 12/2007 | Dierl et al. | |
| 7,314,312 | B2 | 1/2008 | Soderholm | |
| 7,322,473 | B2 | 1/2008 | Fux | |
| 7,395,642 | B2 | 7/2008 | Plourde et al. | |
| 7,422,782 | B2 | 9/2008 | Haedt et al. | |
| 7,527,839 | B2 | 5/2009 | Busche et al. | |
| D597,857 | S | 8/2009 | Lin | |
| 7,681,732 | B2 | 3/2010 | Moehlenbrock et al. | |
| 2004/0001927 | A1 | 1/2004 | Moran et al. | |
| 2005/0025395 | A1 | 2/2005 | Howell et al. | |
| 2006/0062496 | A1 | 3/2006 | Clune | |
| 2006/0083446 | A1 | 4/2006 | Sampaio Camacho | |
| 2006/0093765 | A1 | 5/2006 | Mueller | |
| 2006/0141196 | A1 | 6/2006 | Utz | |
| 2006/0246184 | A1 | 11/2006 | Rietjens et al. | |
| 2006/0251341 | A1 | 11/2006 | Sampaio Camacho | |
| 2006/0251342 | A1 | 11/2006 | Forman | |
| 2006/0257611 | A1 | 11/2006 | Chiesa | |
| 2007/0104395 | A1 | 5/2007 | Kinigakis et al. | |
| 2007/0104398 | A1 | 5/2007 | Ours | |
| 2007/0114144 | A1 | 5/2007 | Suzuki et al. | |
| 2007/0140599 | A1 | 6/2007 | Dalgleish et al. | |
| 2007/0141287 | A1 | 6/2007 | Laaksonen et al. | |
| 2008/0131035 | A1 | 6/2008 | Rogers | |
| 2008/0260305 | A1 | 10/2008 | Shah et al. | |
| 2009/0053372 | A1 | 2/2009 | Hambrick et al. | |
| 2009/0127281 | A1 | 5/2009 | Hickey | |
| 2009/0148081 | A1 | 6/2009 | Rogers | |
| 2009/0178945 | A1 | 7/2009 | Moehlenbrock et al. | |
| 2009/0202183 | A1 | 8/2009 | Hagino | |
| 2009/0226117 | A1 | 9/2009 | Davis et al. | |
| 2009/0257686 | A1 | 10/2009 | Anzini | |
| 2009/0279813 | A1 | 11/2009 | Pokusa et al. | |
| 2009/0304874 | A1 | 12/2009 | Stephens et al. | |
| 2009/0311454 | A1 | 12/2009 | Stephens | |
| 2010/0111453 | A1 | 5/2010 | Dierl | |
| 2010/0113239 | A1 | 5/2010 | Peterson | |
| 2010/0209551 | A1 | 8/2010 | Mitra-Shah et al. | |
| 2010/0278454 | A1 | 11/2010 | Huffer | |
| 2010/0290719 | A1 | 11/2010 | Yeager | |
| 2010/0327046 | A1 | 12/2010 | Mohda et al. | |
| 2011/0036741 | A1 * | 2/2011 | Moehlenbrock | 206/484 |
| 2011/0038569 | A1 | 2/2011 | Huffer et al. | |
| 2011/0038570 | A1 * | 2/2011 | Moehlenbrock et al. | 383/211 |
| 2011/0038571 | A1 * | 2/2011 | Moehlenbrock | 383/211 |
| 2011/0038572 | A1 * | 2/2011 | Moehlenbrock | 383/211 |
| 2011/0038573 | A1 * | 2/2011 | Moehlenbrock | 383/211 |
| 2011/0097019 | A1 * | 4/2011 | Moehlenbrock et al. | 383/105 |
| 2011/0097022 | A1 * | 4/2011 | Moehlenbrock | 383/109 |
| 2011/0097023 | A1 * | 4/2011 | Moehlenbrock | 383/116 |
| 2011/0097024 | A1 * | 4/2011 | Moehlenbrock et al. | 383/210 |
| 2012/0195526 | A1 * | 8/2012 | Moehlenbrock et al. | 383/42 |
| 2012/0195527 | A1 * | 8/2012 | Moehlenbrock et al. | 383/42 |
| 2012/0195531 | A1 * | 8/2012 | Moehlenbrock et al. | 383/109 |
| 2012/0207408 | A1 * | 8/2012 | Moehlenbrock et al. | 383/42 |
| 2012/0207410 | A1 * | 8/2012 | Moehlenbrock | 383/95 |
| 2012/0207412 | A1 * | 8/2012 | Moehlenbrock et al. | 383/105 |
| 2012/0224795 | A1 * | 9/2012 | Moehlenbrock | 383/211 |

FOREIGN PATENT DOCUMENTS

| | | | |
|---|---|---|---|
| EP | 1584562 | A1 | 10/2005 |
| EP | 1676 785 | A1 | 7/2006 |
| EP | 1714894 | B1 | 10/2006 |
| EP | 1842785 | A1 | 10/2007 |
| EP | 1908696 | A1 | 4/2008 |
| EP | 1930252 | A1 | 6/2008 |
| EP | 2108507 | A1 | 10/2009 |
| EP | 2108596 | A1 | 10/2009 |
| GB | 2438393 | A | 11/2007 |
| IT | 01319964 | | 11/2003 |
| JP | 2006/224984 | A | 8/2006 |
| JP | 2007/246137 | A | 9/2007 |
| JP | 2008/230666 | A | 2/2008 |
| WO | WO 96/40504 | | 12/1996 |
| WO | WO 02/66341 | A1 | 2/2001 |
| WO | WO 2007/073895 | A1 | 7/2007 |
| WO | WO 2008/022308 | A2 | 2/2008 |
| WO | WO 2008/030924 | A2 | 3/2008 |

OTHER PUBLICATIONS

"Amcor EasyPack[2]", on or about Apr. 2008 (document undated), 2 pages.
"Curwood Introduces Next-Generation Peel-Reseal Technology for Tray & Lid Systems", Nov. 5, 2008, 2 pages.
"Dole's Easy-Open Bags . . . ", May 15, 2009, 7pages.
"EZ Zip Reclosable Zipper", 2 pages.
"Inno-Lok® pre-zippered film", Jun. 2005, 4 pages.
"Label-aire", Apr. 27, 2009, 4 pages.
"Milk Link Launches New 'Grip Strip' Cheese Packaging", Jun. 7, 2010, 5 pages.
Mondi Consumer Flexibles sets new standard in convenience, Feb. 23, 2010, 2 pages.
Mondi/Innovative and Flexible Packaging Solutions, 8 pages.
Mondi/SwiftUp-innovative easy opening solution for flexible packaging, Jun. 7, 2010, 2 pages.
"New choices in flexible packaging: new material options for flexible packaging", Pira Acc. No. 20294555, from Pharm.Med. Packag. News, vol. 14, No. 10, Oct. 2006, 1 page.
"New Opportunities in cheese packaging", from *Dairy Foods*, May 2007, 2 pages.
"New Peelable Seal Technology for Easy-Open Packaging", (McKenna et al.), Polyolefins 2007 Conference, on or about Feb. 26, 2007, 5 pages.
"Packaging Machinery/The world of cheese", 17 pages.
PCT International Search Report, mailed Oct. 5, 2010, re: PCT/US2010/043457 (3 pages).
PCT International Search Report, mailed Mar. 28, 2011, re: PCT/US2010/043618 (4 pages).
PCT International Search Report, mailed Oct. 5, 2010, re: PCT/US2010/043815 (3 pages).
"Perfecting the Breakable Seal", Packaging Digest, Jun. 1990, 1 page.

(56) References Cited

OTHER PUBLICATIONS

"PFM Zenith Inox", 13 pages.
"Pour & Lok™ Resealable Packaging", on or about Nov. 2008, 2 pages.
"Pressure Sensitive Adhesives (PSA) and Contact Adhesives", Mar. 13, 2007, 3 pages.
"QuickSeals™—Add Reclosable Seals to Most Packag . . . ", Oct. 5, 2009, 4 pages.
"Sealed Air adds resealable applicator to line-up", Mar. 11, 2005, 1 page.
"Snack brand gets turned on its side", Packaging World, May 2008, pp. 18-19.
US Office Action, mailed Aug. 3, 2010, re: U.S. Appl. No. 11/788,544 (11 pages).
"Virtually unlimited applications for unique packaging design—Mondi", May 19, 2010, 4 pages.
Wausau Coated, Custom Retail Packaging, color brochure, on or about Sep. 2006, (document undated), 4 pages.
Wausau Coated, Custom Sheets, color brochure, on or about Sep. 2006, (document undated), 4 pages.
Wausau Coated, Innovation, color brochure, on or about Sep. 2006, (document undated), 4 pages.
Wausau Coated, Liners, color brochure, on or about Sep. 2006, (document undated), 4 pages.
Wausau Coated, Offering You the Perfect Blend of Products and Services, color brochure, on or about Sep. 2006, (document undated), 6 pages.
Wausau Coated, Products for HP Indigo Digital Presses, color brochure, 4 pages, Jun. 2005.
"Welcome to Sealstrip.com", 2005, 11 pages.
"Zip-Pak and Paramount Packaging Launch New Flow Wrapper with Resealable Closure . . . ", Dec. 12, 2008, 3 pages.

* cited by examiner

EASY OPEN AND RECLOSABLE PACKAGE WITH DISCRETE TAPE AND DIE-CUT WEB

This application claims the benefit of U.S. Provisional Application No. 61/274,247, filed Aug. 14, 2009, that application incorporated herein by reference in its entirety.

FIELD OF THE INVENTION

This invention relates to an easy-open and reclosable package with a discrete tape and die-cut web, and to methods of making the package.

BACKGROUND OF THE INVENTION

Food and non-food products, including produce, snack foods, cheese and the like have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes horizontal form/fill/seal (HFFS), vertical form/fill/seal (VFFS), thermoforming/lidstock, and continuous horizontal packaging (sometimes referred to as Flow-wrap). In each case, the product is manually or automatically placed in a pouch, bag, formed web, tray, etc., the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of plastic zipper closures; press-to-close or slide zippers; interlocking closures; reclosable fasteners with interlockable fastener elements; interlocking rib and groove elements having male and female profiles; interlocking alternating hook-shaped closure members, and the like. These terms appear in the patent literature, and to some extent may overlap in meaning. These features provide reclosability, and in some cases may provide an easy-open feature to the package. However, such features are not always easy to open or reclose.

Also relatively common is the use of pressure sensitive adhesive to provide a reclosability feature to a package. However, based on the position of the adhesive relative to the package, the adhesive can sometimes be contaminated by the contained product before the package is opened, or once the package is opened, when product is removed from the package and comes in contact with the adhesive. This phenomenon can compromise the reclosability of the package.

There is need in the marketplace for a package, and methods of packaging that can be used in a manner that requires little or no modification to the packager's packaging equipment, while providing a manually (i.e. by hand, without the need for tools such as scissors or knives) openable and easy to reclose feature, optionally while maintaining hermeticity of the package when made, and without the use of plastic zipper closures; press-to-close or slide zippers; interlocking closures; reclosable fasteners with interlockable fastener elements; interlocking rib and groove elements having male and female profiles; interlocking alternating hook-shaped closure members, and the like.

Some retail packages currently do not offer an easy-open and/or reclosable feature. Examples are some produce bags and snack food bags. In the produce market, there is a need for a cost-effective way to manually open, and repeatably reclose, retail produce bags, e.g. a package made in HFFS, VFFS, thermoforming/lidstock, or continuous horizontal packaging processes.

The present invention relates to a package, and methods of making the package, which package is manually openable and reclosable, i.e. can be opened and reclosed a number of times, and adapted to package non-food products, as well as food products such as e.g. produce, snack foods, cheese, luncheon meat, sausage, culinary nuts, trail mix, etc. The package optionally maintains a hermetic seal until the package is opened.

SUMMARY OF THE INVENTION

Statement of Invention/Embodiments of the Invention

In a first aspect, an easy-open and reclosable package comprises:

a pouch comprising
- a first and second side panel each comprising an outer and inner surface, a first and second side edge, and a first and second end, the first and second side panels joined together along their respective first and second side edges;
- a first end defined by the first end of at least one of the first and second side panels;
- a second end defined by the second ends of the first and second side panels respectively;
- the first and second side panels joined together along their respective second ends;
- a discrete tape, disposed between the first and second side panels, comprising a base strip comprising a first and second surface, a first and second end, and a first and second side edge, wherein
  - the base strip is spaced apart from the first end of the pouch, and spaced apart from the second end of the pouch,
  - at least a first portion of the first surface is coated with a pressure sensitive adhesive, and
  - the at least first portion of the first surface is adhered by the pressure sensitive adhesive to the inner surface of the first side panel at a first location on the first side panel, and a second portion of the first surface is anchored to the inner surface of the first side panel at a second location on the first side panel; and
- a die cut disposed in the first side panel, the die cut defining a die cut segment, the die cut segment so arranged with respect to the discrete tape that when the package is opened, the package can thereafter be reclosed by adhering one of the first and second panels to the pressure sensitive adhesive; and
- the first end of the first side panel joined to the second side panel; and a product disposed in the pouch.

Optionally, according to various embodiments of the first aspect of the invention, taken alone or in any suitable combination of these embodiments:
- at least one of the first and second surfaces of the base strip comprises a sealant.
- at least one of the first and second surfaces of the base strip is sealed to the inner surface of the first or second side panel respectively with an easy-open seal.
- the first and second side panels are joined together along their respective first and second side edges with a seal.
- the first and second side panels are joined together along their respective first and second side edges with a fold.

the first end of the first side panel, and the second side panel, are joined together with a seal.

the first end of the first side panel, and the second side panel, are joined together with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a second aspect, an easy-open and reclosable package comprises:

a pouch comprising a folded web having an interior surface;

a first transverse seal at a first end of the folded web;

a second transverse seal at a second end of the folded web;

a longitudinal seal extending along the length of the folded web, a discrete tape positioned adjacent to and spaced apart from the longitudinal seal, the discrete tape comprising a base strip comprising a first and second surface, a first and second end, and a first and second side edge, wherein at least a first portion of the first surface is coated with a pressure sensitive adhesive, and the at least first portion of the first surface is adhered by the pressure sensitive adhesive to the interior surface of the folded web at a first location on the folded web, and a second portion of the first surface is anchored to the interior surface of the folded web at a second location on the folded web; and a die cut disposed in the folded web, the die cut defining a die cut segment, the die cut segment so arranged with respect to the discrete tape that when the package is opened, the package can thereafter be reclosed by adhering the folded web to the pressure sensitive adhesive; and a product disposed in the pouch.

Optionally, according to various embodiments of the second aspect of the invention, taken alone or in any suitable combination of these embodiments:

at least one of the first and second surfaces of the base strip comprises a sealant.

at least one of the first and second surfaces of the base strip is sealed to the interior surface of the folded web with an easy-open seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the folded web, and a second portion wherein the die cut extends entirely through the folded web.

a supplemental seal seals the folded web to the first end of the base strip.

In a third aspect, a method of making an easy-open and reclosable package in a horizontal form/fill/seal process comprises:

providing a lay-flat web on a first roll, the lay-flat web having a first and second longitudinal edge, and a die cut;

providing a discrete tape comprising a base strip comprising a first and second surface, a first and second end, and a first and second side edge, at least a first portion of the first surface coated with a pressure sensitive adhesive; advancing the lay-flat web to a forming device to convert the lay-flat web to a folded web having an interior surface;

advancing the discrete tape such that when the package is made, the discrete tape is disposed between a first and second side panel of the package;

making side seals in the folded web to produce an open pouch comprising the first and second side panels each comprising an outer and inner surface, first and second side edges, and a first and second end, the first and second side panels joined together along their respective first and second side edges by a seal, a first end defined by the first end of at least one of the first and second side panels, a second end defined by the second ends of the first and second side panels respectively, the first and second side panels joined together along their respective second ends, and the discrete tape spaced apart from the first end and the second end of the pouch;

putting a product in the open pouch; and sealing the first end of the first side panel to the second side panel to close the pouch;

wherein the die cut is disposed in the first side panel, the die cut defining a die cut segment, the die cut segment so arranged with respect to the discrete tape that when the package is opened, the package can thereafter be reclosed by adhering the first or second panel to the pressure sensitive adhesive;

at any time before putting a product in the open pouch, the at least first portion of the first surface of the base strip is adhered, by the pressure sensitive adhesive, to the lay-flat web or the folded web:

at any time before or during the step of making side seals in the folded web, anchoring a second portion of the first surface of the base strip to the lay-flat web, the interior surface of the folded web, or the inner surface of the first side panel; and the web is cut at the side seals during the step of making side seals in the folded web, or before, during or after any subsequent steps.

Optionally, according to various embodiments of the third aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the first end of the first side panel, and the first end of the second side panel, are joined together with a seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a fourth aspect, a method of making an easy-open and reclosable package in a horizontal form/fill/seal process comprises:

providing a lay-flat web on a first roll, the lay-flat web having a first and second longitudinal edge, and a die cut;

providing a discrete tape comprising a base strip comprising a first and second surface, a first and second end, and a first and second side edge, at least a first portion of the first surface coated with a pressure sensitive adhesive, the at least first portion of the first surface adhered, by the pressure sensitive adhesive, to the lay-flat web, and a second portion of the first surface of the base strip anchored to the lay-flat web;

advancing the lay-flat web with the base strip anchored thereto to a forming device to convert the lay-flat web to a folded web having an interior surface;

making side seals in the folded web to produce an open pouch comprising a first and second side panel each comprising an outer and inner surface, first and second side edges, and a first and second end, the first and second side panels joined together along their respective first and second side edges by a seal, a first end defined by the first end of at least one of the first and second side panels, a second end defined by the second ends of the first and second side panels respectively, the first and second side panels joined together along their respective second ends, and the discrete tape disposed between the first and second side panels, and spaced apart from the first end and the second end of the pouch; putting a product in the open pouch; and sealing the first end of the first side panel to the second side panel to close the pouch;

wherein the die cut is disposed in the first side panel, the die cut defining a die cut segment, the die cut segment so arranged with respect to the discrete tape that when the package is opened, the package can thereafter be reclosed by adhering the first or second side panel to the pressure sensitive adhesive; and wherein the web is cut at the side seals during the step of making side seals in the folded web, or before, during or after any subsequent steps.

Optionally, according to various embodiments of the fourth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the first end of the first side panel, and the first end of the second side panel, are joined together with a seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a fifth aspect, a method of making an easy-open and reclosable package in a vertical form/fill/seal process comprises:

providing a lay-flat web on a first roll, the lay-flat web comprising, a first and second surface, and a die cut;

providing a discrete tape comprising a base strip comprising a first and second surface, a first and second end, and a first and second side edge, at least a first portion of the first surface coated with a pressure sensitive adhesive;

advancing the lay-flat web over a forming device to convert the lay-flat web to a folded web having an interior surface;

advancing the discrete tape such that when the package is made, the discrete tape is disposed between a first and second side panel of the package;

making a longitudinal seal in the folded web;

transversely sealing the folded web to produce a first transverse seal to define a first pouch, wherein the first transverse seal is a bottom transverse seal of the first pouch;

putting a product in the first pouch;

advancing the folded web, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web to separate the first pouch from the second pouch to make a package, the package comprising the first and second side panels each comprising an outer and inner surface, a first and second side edge, and a first and second end, the first and second side panels joined together along their respective first and second side edges, a first end defined by the first ends of the first and second side panels, a second end defined by the second ends of the first and second side panels, and the die cut disposed in the first side panel, the die cut defining a die cut segment, the die cut segment so arranged with respect to the discrete tape that when the package is opened, the package can thereafter be reclosed by adhering the first or second side panel to the pressure sensitive adhesive;

wherein at any time before or during the step of making a longitudinal seal in the folded web, the at least first portion of the first surface of the base strip is adhered, by the pressure sensitive adhesive, to the lay-flat web or the folded web; and at any time before or during the step of making a longitudinal seal in the folded web, anchoring a second portion of the first surface of the base strip to the lay-flat web, the folded web, or the first side panel.

Optionally, according to various embodiments of the fifth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the first and second side panels are joined together along their respective first and second side edges with a seal.

the first and second side panels are joined together along their respective first and second side edges with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a sixth aspect, a method of making an easy-open and reclosable package in a vertical form/fill/seal process comprises:

providing a lay-flat web on a first roll, the lay-flat web comprising a first and second surface, and a die cut;

providing a discrete tape comprising a base strip comprising a first and second surface, a first and second end, and a first and second side edge, at least a first portion of the first surface coated with a pressure sensitive adhesive, the at least first portion of the first surface adhered, by the pressure sensitive adhesive, to the first surface of the lay-flat web, and a second portion of the first surface of the base strip anchored to the first surface of the lay-flat web;

advancing the lay-flat web with the base strip adhered thereto over a forming device to convert the lay-flat web to a folded web having an interior surface;

making a longitudinal seal in the folded web;

transversely sealing the folded web to produce a first transverse seal to define a first pouch, wherein the first transverse seal is a bottom transverse seal of the first pouch;

putting a product in the first pouch;

advancing the folded web, with the first pouch, downward a predetermined distance;

transversely sealing the folded web to produce a top transverse seal in the first pouch, and a bottom transverse seal in a second pouch, the second pouch disposed above the first pouch; and transversely cutting the folded web to separate the first pouch from the second pouch to make a package, the package comprising a first and second side panel each comprising an outer and inner surface, a first and second side edge, and a first and second end, the first and second side panels joined together along their respective first and second side edges, a first end defined by the first ends of the first and second side panels, a second end defined by the second ends of the first and second side panels, and the die cut disposed in the first side panel, the die cut defining a die cut segment, the die cut segment so arranged with respect to the discrete tape that when the package is opened, the package can thereafter be reclosed by adhering the first or second side panel to the pressure sensitive adhesive.

Optionally, according to various embodiments of the sixth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the first and second side panels are joined together along their respective first and second side edges with a seal.

the first and second side panels are joined together along their respective first and second side edges with a fold.

the first end of the first side panel, and the first end of the second side panel, are joined together with a seal.

the first end of the first side panel, and the first end of the second side panel, are joined together with a fold.

the second end of the first side panel, and the second end of the second side panel, are joined together with a seal.

the second end of the first side panel, and the second end of the second side panel, are joined together with a fold.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a seventh aspect, a method of making an easy-open and reclosable package having a formed web comprises:

providing a formed web comprising a product cavity;

providing a product;

providing a lidstock, having a first and second surface, comprising a lay-flat web, and a die cut disposed in the lidstock, the die cut defining a die cut segment;

providing a discrete tape comprising a base strip comprising a first and second surface, a first and second end, and a first and second side edge, at least a first portion of the first surface coated with a pressure sensitive adhesive; placing the product in the product cavity;

sealing the lidstock to the formed web, such that the discrete tape is disposed between the lidstock and the formed web; and cutting the lidstock and formed web to make the package; wherein the die cut segment is so arranged with respect to the discrete tape that when the package is opened, the package can thereafter be reclosed by adhering the lidstock to the pressure sensitive adhesive;

at any time before or during the step of sealing the lidstock to the formed web, the at least first portion of the first surface of the base strip is adhered, by the pressure sensitive adhesive, to the first surface of the lidstock; and at any time during the method of making the package, a second portion of the first surface of the base strip is anchored to the first surface of the lidstock.

Optionally, according to various embodiments of the seventh aspect of the invention, taken alone or in any suitable combination of these embodiments:

at least one of the first and second surfaces of the base strip comprises a sealant.

at least one of the first and second surfaces of the base strip is sealed to the first surface of the lidstock and the formed web respectively with an easy-open seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the lidstock, and a second portion wherein the die cut extends entirely through the lidstock.

a supplemental seal seals the lidstock to the first end of the base strip.

the first side edge of the base strip is disposed between and sealed to a first side edge of the lidstock and formed web respectively, and the second side edge of the base strip is disposed between and sealed to a second side edge of the lidstock and formed web respectively.

In an eighth aspect, a method of making an easy-open and reclosable package having a formed web comprises:

providing a formed web comprising a product cavity;

providing a product;

providing a lidstock, having a first and second surface, comprising a lay-flat web, and a die cut disposed in the lidstock, the die cut defining a die cut segment;

providing a discrete tape comprising a base strip comprising a first and second surface, a first and second end, and a first and second side edge, at least a first portion of the first surface coated with a pressure sensitive adhesive, the at least first portion of the first surface adhered, by the pressure sensitive adhesive, to the first surface of the lidstock, and a second portion of the first surface of the base strip anchored to the first surface of the lidstock;

placing the product in the product cavity;

sealing the lidstock to the formed web, such that the discrete tape is disposed between the lidstock and the formed web; and cutting the lidstock and formed web to make the package:

wherein the die cut segment is so arranged with respect to the discrete tape that when the package is opened, the package can thereafter be reclosed by adhering the lidstock to the pressure sensitive adhesive.

Optionally, according to various embodiments of the eighth aspect of the invention, taken alone or in any suitable combination of these embodiments:

at least one of the first and second surfaces of the base strip comprises a sealant.

at least one of the first and second surfaces of the base strip is sealed to the first surface of the lidstock and formed web respectively with an easy-open seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the lidstock, and a second portion wherein the die cut extends entirely through the lidstock.

a supplemental seal seals the lidstock to the first end of the base strip.

the first side edge of the base strip is disposed between and sealed to a first side edge of the lidstock and formed web respectively, and the second side edge of the base strip is disposed between and sealed to a second side edge of the lidstock and formed web respectively.

In a ninth aspect, a method of making an easy-open and reclosable package in a continuous horizontal packaging process comprises:

providing a lay-flat web, the lay-flat web comprising a die cut;

providing a discrete tape comprising a base strip comprising a first and second surface, a first and second end, and a first and second side edge, at least a first portion of the first surface coated with a pressure sensitive adhesive;

advancing the lay-flat web to a forming device to convert the lay-flat web into a folded web having an interior surface;

advancing the discrete tape such that when the package is made, the discrete tape is disposed between a first and second side panel of the package;

advancing a product to the forming device such that the folded web envelopes the product;

longitudinally sealing the folded web to make a longitudinal seal;

transversely sealing the folded web, with the product therein, to produce a leading transverse seal to define a first pouch;

advancing the folded web, with the leading transverse seal, forward a predetermined distance;

transversely sealing the folded web to produce a trailing transverse seal in the first pouch, and a leading transverse seal in a second pouch, the second pouch disposed upstream of the first pouch; and cutting the folded web to separate the first pouch from the second pouch to form an individual package comprising the first and second side panel;

wherein the die cut is disposed in the package, the die cut defining a die cut segment, the die cut segment so arranged with respect to the discrete tape that when the package is opened, the package can thereafter be reclosed by adhering the folded web to the pressure sensitive adhesive;

at any time before or during the step of longitudinally sealing the folded web, the at least first portion of the first surface of the base strip is adhered, by the pressure sensitive adhesive, to the lay-flat web or the folded web: and at any time before or during the step of making a longitudinal seal in the folded web, a second portion of the first surface of the base strip is anchored to the lay-flat web, the folded web, or the first side panel.

Optionally, according to various embodiments of the ninth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the folded web, and a second portion wherein the die cut extends entirely through the folded web.

a supplemental seal seals the first side panel to first end of the base strip.

the first side edge of the base strip is disposed between and sealed to the first side edge of the first and second side panels respectively, and the second side edge of the base strip is disposed between and sealed to the second side edge of the first and second side panels respectively.

In a tenth aspect, a method of making an easy-open and reclosable package in a continuous horizontal packaging process comprises:

providing a lay-flat web, the lay-flat web having a first and second surface, and a die cut;

providing a discrete tape comprising a base strip comprising a first and second surface, a first and second end, and a first and second side edge, at least a first portion of the first surface coated with a pressure sensitive adhesive, the at least first portion of the first surface adhered, by the pressure sensitive adhesive, to a first surface of the lay-flat web, and a second portion of the first surface of the base strip anchored to the first surface of the lay-flat web;

advancing the lay-flat web with the base strip adhered thereto to a forming device to convert the lay-flat web into a folded web having an interior surface;

advancing a product to the forming device such that the folded web envelopes the product;

longitudinally sealing the folded web to make a longitudinal seal; transversely sealing the folded web, with the product therein, to produce a leading transverse seal to define a first pouch;

advancing the folded web, with the leading transverse seal, forward a predetermined distance;

transversely sealing the folded web to produce a trailing transverse seal in the first pouch, and a leading transverse seal in a second pouch, the second pouch disposed upstream of the first pouch; and cutting the transversely sealed first pouch, with the product therein, to form an individual package comprising a first and second side panel;

wherein the die cut is disposed in the folded web, the die cut defining a die cut segment, the die cut segment so arranged with respect to the discrete tape that when the package is opened, the package can thereafter be reclosed by adhering the first or second side panel to the pressure sensitive adhesive.

Optionally, according to various embodiments of the tenth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the package is absent any zipper.

the package is absent a discrete release liner for a PSA layer or coating.

the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In an eleventh aspect, a pouch comprises:

a first and second side panel each comprising an outer and inner surface, a first and second side edge, and a first and second end, the first and second side panels joined together along their respective first and second side edges;

a first end defined by the first end of at least one of the first and second side panels; a second end defined by the second ends of the first and second side panels respectively;

the first and second side panels joined together along their respective second ends; a discrete tape, disposed between the first and second side panels, comprising a base strip comprising a first and second surface, a first and second end, and a first and second side edge, wherein the base strip is spaced apart from the first end of the pouch, and spaced apart from the second end of the pouch, at least a first portion of the first surface is coated with a pressure sensitive adhesive, and the at least first portion of the first surface is adhered by the pressure sensitive adhesive to the inner surface of the first side panel at a first location on the first side panel, and a second portion of the first surface is anchored to the inner surface of the first side panel at a second location on the first side panel; and a die cut disposed in the first side panel, the die cut defining a die cut segment, the die cut segment so arranged with respect to the discrete tape that when the pouch is sealed to make a package, and the package is then opened, the package can thereafter be reclosed by adhering one of the first and second side panels to the pressure sensitive adhesive.

Optionally, according to various embodiments of the eleventh aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the first and second side panels are joined together along their respective first and second side edges with a seal.

the first and second side panels are joined together along their respective first and second side edges with a fold.

the second end of the first side panel, and the second end of the second side panel, are joined together with a seal.

the second end of the first side panel, and the second end of the second side panel, are joined together with a fold.

the pouch, and a package made from the pouch, is absent any zipper.

the pouch, and a package made from the pouch, is absent a discrete release liner for a PSA layer or coating.

when the pouch is sealed to make a package, the package can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

In a twelfth aspect, a method of making a bag with a die cut and a discrete tape disposed thereon comprises:

extruding a thermoplastic tube to make a bag tubing;

providing a discrete tape comprising a base strip comprising a first and second surface, a first and second end, and a first and second side edge, at least a first portion of the first surface coated with a pressure sensitive adhesive;

slitting the tubing at a longitudinal edge thereof to make a slit bag tubing;

placing the discrete tape inside the slit bag tubing; and transversely cutting and sealing the slit bag tubing at predetermined intervals to make a plurality of individual bags, each bag having a die cut disposed thereon, each bag comprising a first and second side panel each comprising a first and second end, an outer and inner surface, and first and second side edges, the first and second side panels joined together along at least a portion of their respective first and second side edges by a seal, a first end defined by the first end of at least one of the first and second side panels, an end fold defined by the second ends of the first and second side panels respectively, and the discrete tape disposed between the first and second side panels, and spaced apart from the first end and the end fold of the bag;

wherein the die cut is disposed in the first side panel, the die cut defining a die cut segment, the die cut segment so arranged with respect to the discrete tape that when the bag is sealed to make a package, and the package is then opened, the package can thereafter be reclosed by adhering the first or second side panel to the pressure sensitive adhesive;

at any time before transversely cutting the bag tubing to produce a bag, the bag tubing or slit bag tubing is die cut at predetermined intervals to make a plurality of die cuts in the bag tubing or slit bag tubing respectively;

at any time before transversely cutting the bag tubing to produce a bag, the at least first portion of the first surface of the base strip is adhered, by the pressure sensitive adhesive, to the bag tubing or slit bag tubing; and at any time during the method of making the bag, a second portion of the first surface of the base strip is anchored to the bag tubing, the slit bag tubing, or the inner surface of the first side panel.

Optionally, according to various embodiments of the twelfth aspect of the invention, taken alone or in any suitable combination of these embodiments:

at least one of the first and second surfaces of the base strip comprises a sealant.

at least one of the first and second surfaces of the base strip is sealed to the inner surface of the first or second side panel respectively with an easy-open seal.

the bag, and a package made from the bag, is absent any zipper.

the bag, and a package made from the bag, is absent a discrete release liner for a PSA layer or coating.

a package made from the bag can be opened with a peel force of from 25 grams/inch to 5 pounds/inch.

a first portion of the die cut segment is underlain by pressure sensitive adhesive, and a second portion of the die cut segment is underlain by a clear area of the first surface of the base strip; the die cut segment so arranged with respect to the discrete tape that when the die cut segment is displaced or removed, at least a portion of the pressure sensitive adhesive is exposed, and at least a portion of the first end of the base strip is exposed.

the die cut segment is completely underlain by the base strip.

the die cut segment is partially underlain by the base strip.

when the package is opened, the base strip is not torn through the entire thickness of the base strip.

the second surface of the base strip is substantially free from PSA.

the package is absent a discrete thread or tear strip.

the die cut segment includes a first portion wherein the die cut extends partially through the first side panel, and a second portion wherein the die cut extends entirely through the first side panel.

a supplemental seal seals the first side panel to the first end of the base strip.

the first side edge of the base strip is disposed between and sealed to the first side edge of the first and second side panels respectively, and the second side edge of the base strip is disposed between and sealed to the second side edge of the first and second side panels respectively.

BRIEF DESCRIPTION OF THE DRAWINGS

The present invention is illustrated by reference to the following drawing figures, encompassing different views of various embodiments of the invention, wherein.

DEFINITIONS

Figure 1:
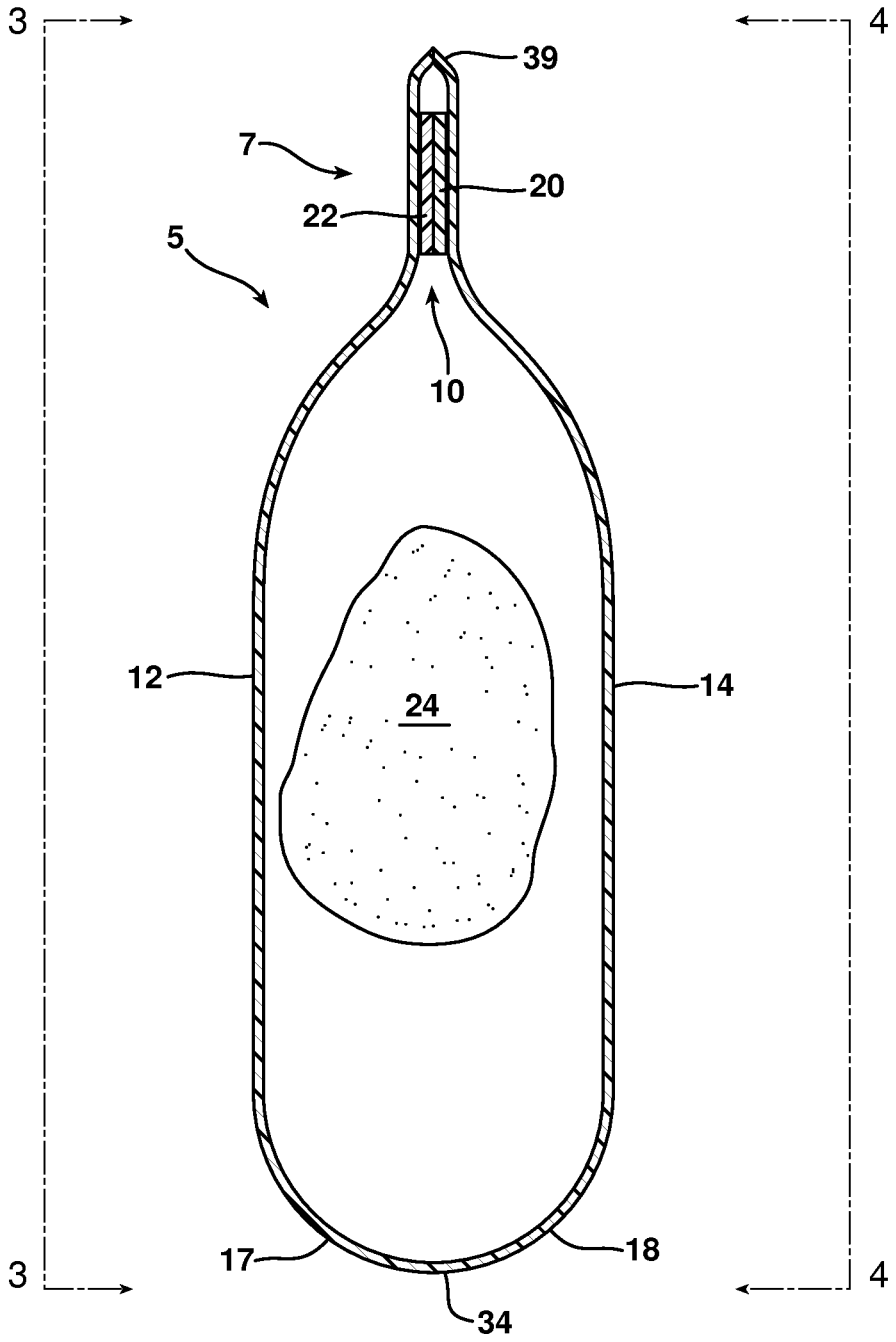
FIG. 1 is an elevational view of a package.

"Anchored", "anchoring" and the like herein refers to sealing or adhering two surfaces together, and refers to the resulting bond between surfaces. Sealing is done by means of a sealant. Adhering is done by means of PSA or permanent adhesive. In processes described herein where a strip is anchored to a web or side panel, either during the process wherein the web and strip are advanced, or when a strip has been pre-anchored to the web before the start of the process, anchoring can be done by use of any suitable continuous or discontinuous sealing or adhesive material and method. Such anchoring is done to hold the strip to the web during the relevant packaging process.

In some embodiments, wherein the anchor is already relatively strong or continuous, e.g. a heat seal that constitute either a relatively strong heat seal, or an easy-open seal as defined herein, the anchor functions not only to hold the strip to the web during the relevant packaging process, but also as a final seal of that surface of the strip to the web (lay-flat or folded) or panel made from the web.

Any subsequent disclosed or recited step in the process of sealing one of the surfaces (i.e. the anchored surface) of the strip to a web or panel, is in these embodiments already completed by the anchoring step. In these embodiments, then, contact of a seal device, e.g. a seal bar in the region of the anchor, in a subsequent step, may add no further or separate seal to that surface of the strip.

Any subsequent step in the process of sealing the other surface of the strip to a web or panel, then, may in some embodiments add no further or separate seal to the anchored surface of the strip.

Sealing of a surface of the strip to a web, as a process step disclosed or recited herein, should be understood in this light.

In some embodiments where the bond is a relatively weak or discontinuous one, e.g. a discontinuous seal, spots or narrow stripes of adhesive. etc., in a subsequent step of sealing one of the surfaces of the strip to the web or panel, a seal bar that seals one of the surfaces of the strip to the web or panel can contact the web or panel in the region where the anchor is already disposed. The seal in that region may be either enhanced, or initially created, by the subsequent sealing step.

"Clear area" herein refers to a selected portion or portions of a first surface of the base strip that has substantially no PSA thereon. The clear area(s) can be provided by 1) not applying PSA to the selected portion(s), or 2) applying the PSA over the entire first surface of the strip, followed by removing most or all of the PSA in the selected portion(s), e.g. by scraping the PSA off the strip by suitable means such as a shim or scraper; removal of most or all of the PSA in this manner will typically be done before the PSA has been cured; or 3) applying the PSA relatively uniformly over the entire first surface of the base strip, as is done in the manufacture of labels, followed by masking or deadening the PSA in the selected portion(s) by any suitable means. Masking or deadening agents that are used will substantially reduce or nullify the adhesive effect of the PSA in the selected portion(s), compared with the adhesive effect of the PSA in portions of the first surface adjacent to the selected portion(s). In general, deadening or masking of the PSA is done after the PSA has been cured; removal of most or all of the PSA is done before the PSA has been cured.

"Closed-loop" herein refers to a die cut that defines a closed pattern or path in the first side panel whereby the web material within the path (the die-cut segment) can be removed from the panel.

"Die cut" and the like herein refers to methods of cutting or scoring materials, including rotary die, steel rule die, platen die cutting, and laser cutting or scoring. A die cut can extend entirely or partially through the relevant layer or web, and can leave intact a certain amount of material. "Score" and the like herein refers to a partial die cut that extends partly but not entirely through the thickness of a material, layer, web, panel, etc, The purpose of the score in the present invention is to provide for controlled tear or separation of material in the act of displacing or removing the die cut segment. The depth of the cut can vary from package to package, and within a single die cut or die cut segment on a given package.

"Die-cut segment" herein refers to a portion of the first side panel that can be displaced or completely removed because of the presence of a closed-loop or open-loop die cut. The die-cut segment is a piece of the first side panel, and when displaced or removed can function as a tamper evidence device, and facilitates access to the interior of the package. In some embodiments such as FIG. 2*c*, it provides access to the PSA to allow reclosing.

"Discrete" with respect to the discrete tape is used herein to mean independently made (the tape is not an integral part of the web when the web is made) or constituting a separate entity from the web.

"Easy-open" herein refers to a package that can be manually opened relatively easily. The physical mode of opening may include any one or more of a) actual peeling at the base strip/web interface (adhesive failure), or b) a sealant layer of the base strip breaking completely through, and peeling then occurring between the sealant layer and an adjacent layer within the strip (delamination failure), or c) breaking within a sealant layer by rupturing of the sealant material itself (cohesive failure), or d) simply peeling of a flap away from the PSA, the flap comprising a piece of the first side panel, the piece being a die cut segment as described herein, formed by an open loop die cut, such that the die cut segment is displaced from its original position; or removing a piece of the first side panel, the piece being a die cut segment as described herein, formed by a closed-loop die cut. The peel force required to open the package can be measured by an evaluation of seal strength or peel strength in accordance with the test procedure set out in ASTM F88, incorporated herein by reference in its entirety, using a crosshead speed of 8 to 12 inches/minute and an initial jaw gap of from 1.00 inch to 2.00 inch. Typical peel forces for opening the package of the invention can range from e.g. 25 grams/inch to 3 pounds/inch, e.g. from 100 grams/inch to 2 pounds/inch, such as from 200 grams/inch to 1.5 pounds/inch. In some cases, the sealant may actually peel away from the surface to which it is adhered (adhesive failure), or breakage of the sealant and delamination along an adjacent layer interface may occur (delamination failure) or a rupture of the sealant can occur (cohesive failure). Depending on the design and geometry of the seal, peel forces can in some embodiments be higher than 3 pounds/inch, e.g. 3.5, 4.0, 4.5, or 5 pounds/inch, or values intermediate these values. When a die cut segment is displaced or removed from the first side panel, such that the PSA is exposed, in some embodiments some part of the scored portion of the die cut segment that remains after the die cutting process, may be torn through in the act of opening the package. The peel force required for this step in the opening process will be within the parameters discussed herein.

"Easy-open seal" herein refers to a seal involving the base strip and web in which materials and sealing conditions are chosen for the base strip and web such that the package is easy-open with a physical mode of opening that includes any one or more of adhesive failure, delamination failure, or cohesive failure as described herein.

"Easy-open sealant" herein refers to a material chosen for one or both surfaces of the base strip, such that when such surface is sealed to a web, it provides a package that is easy-open with a physical mode of opening that includes any one or more of adhesive failure, delamination failure, or cohesive failure as described herein.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Ethylene homopolymer or copolymer" herein refers to polyethylene (PE) such as ethylene homopolymer such as low density polyethylene (LDPE), medium density polyethylene (MDPE), high density polyethylene (HDPE); ethylene/alpha olefin copolymer such as those defined herein; ethylene/vinyl acetate copolymer (EVA); ethylene/alkyl acrylate copolymer such as ethylene/methyl acrylate copolymer (EMA) or ethylene/ethyl acrylate copolymer (EEA), or ethylene/butyl acrylate copolymer (EBA); ethylene/(meth)acrylic acid copolymer; or ionomer resin (IO).

"Fig." herein refers to drawing figure; "Figs." to drawing figures.

"Film" is used herein to mean a thermoplastic film, laminate, or web, either multilayer or monolayer, that may be used in connection with the present invention. Film can be of any suitable thickness, e.g. between 0.1 and 30 mils.

"Fin seal" is used herein to mean, in the case of a single web, folding one edge of a web towards the opposite edge of the web, and sealing the facing inner surfaces together. In the case of two webs, a fin seal is a seal formed by sealing the inner surface of the edge of one web to the inner surface of a corresponding edge of another web.

"Lap seal" is used herein to mean a seal made by sealing an inside surface of a web to an outside surface of a web. The inside and outside surfaces can both be on a single web; or the inside surface can be of one web, and the outside surface of a second web.

"Lidstock" herein refers to a film used to cover a container or tray that carries a product, and can be sealed to the tray, typically as a perimeter heat seal. Lidstock typically is supplied to a food processor in a lay flat film rolled onto a roll.

"Longitudinal seal" herein refers to a fin seal or lap seal.

"Olefinic" and the like herein refers to a polymer or copolymer derived at least in part from an olefinic monomer.

"Open-loop" herein refers to a die cut that defines an open pattern or path in the first side panel whereby the web material within the path or pattern (the die-cut segment) can be displaced from its original position on the panel, e.g. by acting as a flap.

"Oxygen barrier" and the like herein refers to materials having an oxygen permeability, of the barrier material, less than 500 $cm^3$ $O_2/m^2$·day·atmosphere (tested at 1 mil thick and at 25° C., 0% RH according to ASTM D3985), such as less than 100, less than 50, less than 25, less than 10, less than 5, and less than 1 $cm^3$ $O_2/m^2$·day·atmosphere. Examples of polymeric materials useful as oxygen barrier materials are ethylene/vinyl alcohol copolymer (EVOH), polyvinylidene dichloride (PVDC), vinylidene chloride/methyl acrylate copolymer, vinylidene chloride/vinyl chloride copolymer, polyamide (nylon), and polyester (PET).

"Polymer" and the like herein means a homopolymer, but also a copolymer thereof, including terpolymer, tetrapolymer, block copolymer, etc.

"Pouch" herein means a pouch or bag.

"Pressure sensitive adhesive" (PSA) herein refers to a repositionable adhesive that bonds firmly with the application of light pressure. It adheres to most surfaces with very slight pressure; is available in solvent and latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical (peroxide) means. They are available in a wide variety of chemical compositions and systems including acrylic and methacrylate adhesives, emulsion-based acrylic adhesive; rubber-based pressure sensitive adhesive, styrene copolymers (styrene/isoprene/styrene and styrene/butadiene/styrene block copolymers), and silicones. In some embodiments, hot melt adhesives may be useful as well, and are included herein for those embodiments as "PSA"; a hot melt adhesive is a thermoplastic adhesive compound, usually solid at room temperature which becomes fluid on heating for use. Suitable commercial examples of PSA include PS-2000™ from Dow, and "acResin®", available from BASF, and comprising a UV-curable polyacrylate that can be applied by conventional hot-melt coaters at temperatures of about 120° C. Suitable tackifiers can be added to acResin® or like compositions to control the tackiness of the adhesive; examples are FORAL® 85 synthetic resin available from Pinova. Tackifiers can be added to the base adhesive composition in any suitable amount, e.g. from 15% to 25% by weight of the total composition of PSA and tackifier.

"Reclosable" herein refers to a feature or function of a package in accordance with the invention whereby a package can be reclosed by bringing a folded web, panel, or portion of a folded web or panel into contact with the PSA of the base strip.

"Registration device" herein refers to any mark, pattern, die cut or feature of a web or strip, that facilitates the advancement of the web or discrete tape, in a controlled manner, into a packaging machine, where the web or discrete tape is used to make individual packages. The device can be e.g. printed or placed in uniformly spaced fashion along or near an edge of the web or discrete tape, i.e. registration marks, or in an area near the middle of a web that does not interfere with decorative printed graphics. These marks are used in connection with appropriate sensors to controllably advance the web or strip. Where die cuts are used as a registration device, detected by sensors, it may not be necessary to print registration marks on the web or discrete tape.

"Seal" herein means a bond between two thermoplastic surfaces, e.g. as produced by heat sealing, radio frequency (RF) sealing, ultrasonic sealing, or permanent adhesive, but excluding repositionable adhesive or PSA.

"Sealant" is a polymeric material or blend of materials, such as olefinic polymer or copolymer such as an ethylenic polymer or copolymer, that can form a surface of the base strip of the invention, or a web to which the base strip is sealed, and form a bond between two thermoplastic surfaces. A permanent adhesive can also be a sealant. "Sealant" herein, with respect to the base strip, or a web to which the base strip is attached, excludes a repositionable adhesive or PSA.

"Strip" herein refers to an elongate piece of thermoplastic material, typically longer in a first direction than in a direction perpendicular to the first direction, e.g. rectangular; but can also be square, round, oblong, elliptical, or any appropriate shape in plan view. The strip can be of any suitable thickness, e.g. between 0.1 and 30 mils.

"Tamper evidence", "tampering", and the like herein refers to visual evidence of a breach in a package; i.e. that someone has accidentally or intentionally opened or partially opened the package, or attempted to do so.

"Tape" herein refers to a strip with PSA adhered to at least a portion of a first surface of the strip.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Tray" herein refers to a formed member that has a tray bottom, tray sides, and a tray flange around the upper perimeter of the tray, where the tray bottom and tray sides form an internal cavity within which a product can be placed. The cavity can be enclosed by a lidstock sealed to the tray flange.

"Web" is used herein to mean a thermoplastic film, laminate, or web, either multilayer or monolayer, that may be used in connection with the present invention. The web can be of any suitable thickness, e.g. between 0.1 and 30 mils, and the web can be of any suitable length and width.

"Zipper" and the like herein refers to a plastic zipper closure; press-to-close or slide zipper; interlocking closure; reclosable fastener with interlockable fastener elements; interlocking rib and groove elements having male and female profiles; interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Package

Referring to the drawings, a package 5 according to the invention is shown. Package 5 includes a pouch 7 that can be made from either a single web, or two webs, to form a first or front side panel 12, and a second or back side panel 14.

A. Web(s)

In either embodiment, the web or webs comprises a thermoplastic material of any suitable composition, including those having as at least one component olefinic materials such as ethylene or propylene polymers or copolymers, e.g. polyethylene or ethylene/alpha olefin copolymers; polyethylene terephthalate (PET); and including webs typically used in, or useful in, HFFS, VFFS, lidstock/tray, and continuous horizontal packaging apparatus and processes. The web or webs can be monolayer or multilayer in construction, can be coextruded, laminated, or made by any suitable film making process, and can have any suitable thickness.

Examples of web(s) useful in the invention include H7225B™, a barrier hybrid material used for products requiring a high oxygen barrier, such as shredded cheese; H7525B™, a barrier hybrid material used for products requiring a high oxygen barrier, such as bacon and smoked and processed meat; H7530B, like H7525B but having a thickness of about 3 mils; CP04140™, a low barrier (high OTR) material used in produce packaging, CPM4090, a microwaveable packaging film for fresh cut produce; and T7225B™, a barrier material used as lidstock for products requiring a high oxygen barrier, such as luncheon meat. These are all commercial products produced by the Cryovac business unit of Sealed Air Corporation.

H7225B™ is a laminate having the construction PET//adhesive//coextruded barrier film, where the PET is a biaxially oriented polyester film, and the barrier film has in one embodiment the construction LDPE (low density polyethylene)/EVA tie/nylon/EVOH+nylon/nylon/EVA tie/EAO. The overall thickness of the laminate can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7225B™ can be used as a lidstock (non-forming) web.

H7525B™ is a laminate having the construction PET//adhesive//coextruded barrier film, where the PET is a biaxially oriented polyester film, and the barrier film has in one embodiment the construction LDPE (low density polyethylene)/EVA/LLDPE tie/EVOH/LLDPE tie/EVA/EAO. The overall thickness of the laminate can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7525B™ can be used as a lidstock (non-forming) web.

CP04140™ is a laminate having the construction BOPP//adhesive/monolayer LLDPE film. A typical gauge for the laminate is about 1.8 mils. The LLDPE typically acts as the heat sealant layer of the finished laminate, and in packaging made from the laminate, the LLDPE will form the inner or sealant surface of the package, facing the contained product, and the BOPP will form the outer or skin surface of the package.

CPM4090™ is a laminate having the construction BOPP//adhesive/monolayer LLDPE+LDPE film. A typical gauge for the laminate is about 2 mils. The LLDPE+LDPE layer typically acts as the heat sealant layer of the finished laminate, and in packaging made from the laminate, the LLDPE+LDPE will form the inner or sealant surface of the package, facing the contained product, and the BOPP will form the outer or skin surface of the package.

T7225B™ film has the construction EAO/EAO/LLDPE tie/nylon/EVOH/nylon/EVA tie/EVA tie/nylon. The first layer of EAO typically acts as the heat sealant layer of the film, and in packaging made from the laminate, the EAO will form the inner or sealant surface of the package, facing the contained product, and the nylon of the last layer will form the outer or skin surface of the package. T7225B™ is used as a lidstock (non-forming) web.

Referring to the drawings, the first side panel 12 has a top portion 9, a first side edge 31, a second side edge 33, and a lower portion 17. The second side panel 14 has a top portion 11, a first side edge 35, a second side edge 37, and a lower portion 18. The first and second side panels 12 and 14 are joined together along their respective first and second side edges by either a seal or a fold. As shown, first side edge 31 of first side panel 12 is joined to first side edge 35 of second side panel 14 by a seal 30. Second side edge 33 of first side panel 12 is joined to second side edge 37 of second side panel 14 by a heat seal 32. The second end 34 of the pouch 7 can be either a seal or a fold. Where a single web is used to make the pouch, second end 34 will typically be a fold, although even after the web is folded, a seal such as a heat seal can optionally be installed in the area of the fold. Where two webs of film are used to make panels 12 and 14, second end 34 will be a seal that joins panels 12 and 14 together along their respective lower portions 17 and 18. The two webs can be from the same material, or can be different in composition, structure, etc.

B. Discrete Tape

Figure 4:
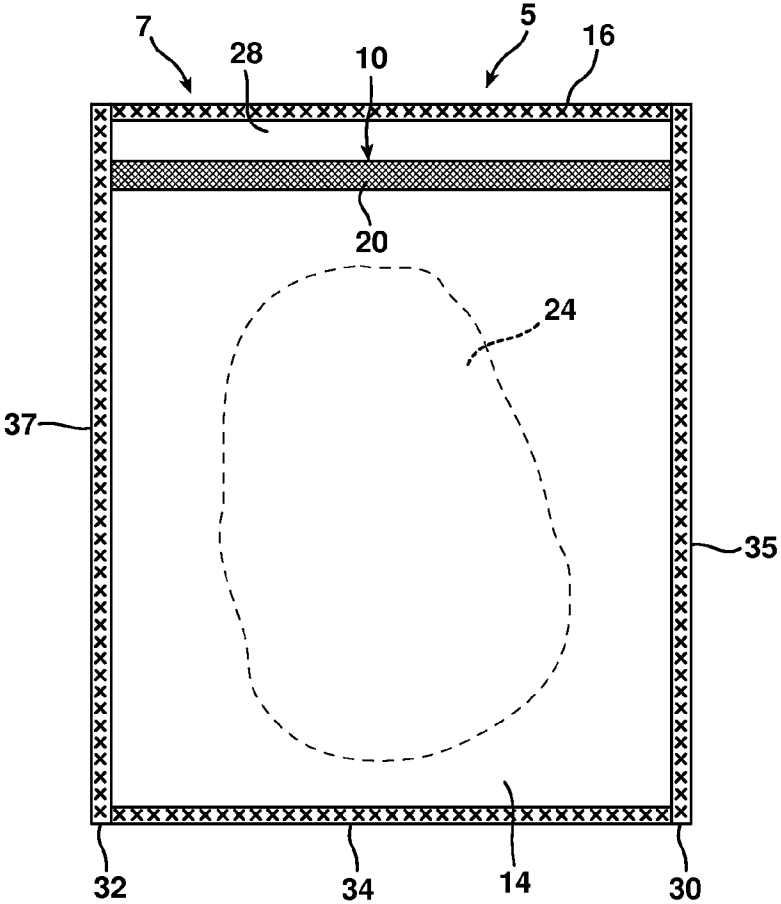
FIG. 4 is a back view of the package of FIG. 1, viewed along lines 4-4 of FIG. 1.
Figure 3:
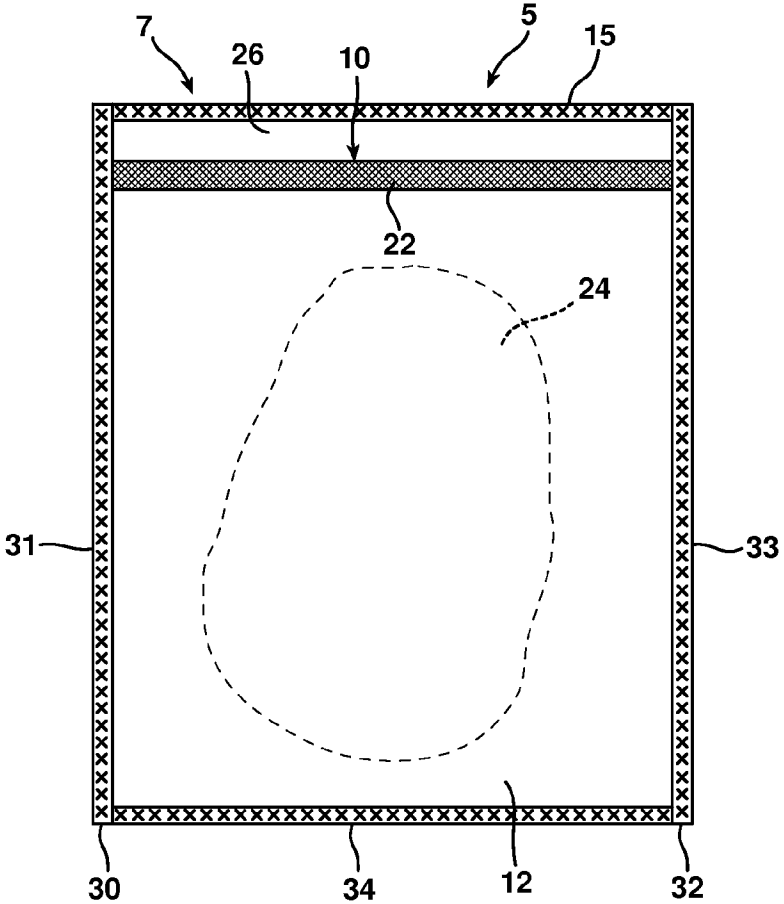
FIG. 3 is a front view of the package of FIG. 1, viewed along lines 3-3 of FIG. 1.

A discrete tape 8 comprising a base strip 10 and a PSA layer 19 is disposed between first panel 12 and second panel 14, typically near and spaced apart from the first end of the pouch, and spaced apart from the second end of the pouch. The base strip 10 can be of any suitable dimension, and will typically be longer in length than in width, with the length of the strip 10 being e.g. greater than two times the width of the strip, e.g. greater than 3, 4, or 5 times the width. A typical dimension for the strip 10 is a width of from about 1 to 1.5 inches and a length of about 7 inches. The strip 10 will be shorter in at least one dimension than the pouch and package. For example, the strip can extend across the transverse width of a pouch made in a HFFS or VFFS process, but will be significantly narrower than the length of the package (see e.g. FIGS. 3 and 4). In one embodiment, the strip will occupy less than 50%, such as less than 40%, less than 30%, less than 20%, or less than 10% of the length of the package. The strip can in another embodiment be shorter in both dimensions than the pouch and package (see e.g. FIGS. 18 and 19). The strip can occupy e.g. less than 50%, such as less than 40%, less than 30%, less than 20%, or less than 10% of each of the length and width of the package. "Near" herein means that the first end 28 of the base strip closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch. The base strip and the PSA layer can each be of any suitable thickness. The base strip can for example have a thickness of between 2.0 and 5.0 mils, such as between 2.5 and 4.5 mils, between 3.0 and 4.0 mils, or any thicknesses therebetween. Factors such as the composition of the base strip, arrangement of layers within the base strip, and flexural modulus of the materials used may affect the choice of appropriate thickness of the base strip. The PSA can also have any suitable thickness, typically 0.5 mils, e.g. between 0.1 mil and 1 mil, or 0.2 mils and 0.8 mils, etc.

In some embodiments, an opening flap 26 (FIGS. 29A to 29D) provides a device that can be manually grasped and pulled back to open the package, and access the contents of the package. The size of the package, type of materials used for the pouch and the strip, the seal strength of the materials used in the strip, and the type of product being packaged can all have some effect on the choice of the optimal length and dimensions of flap 26.

Base strip 10 comprises a first surface 23 and a second surface 25. In one embodiment, these first and second surfaces each comprise a sealant. In some embodiments, the first surface 23 is sealed to the inner surface 27 of the first side panel 12, and the second surface 25 is sealed to the inner surface 29 of the second side panel 14. Either or both of the sealants are in one embodiment an easy open sealant. In yet another embodiment, only the first surface comprises a sealant, either an easy-open sealant, or a relatively strong sealant. The film strip can be of multilayer or monolayer construction. In some embodiments, the sec- and surface 25 of the base strip is sealed to the inner surface 29 of second side panel 14 only along the first and second side edges of the package. In other embodiments, the second surface 25 of the base strip is sealed to the inner surface 29 of second side panel 14 along the entire width of the package, with an easy-open seal.

When a product 24 is placed in the pouch 7, by processes herein disclosed, and the pouch 7 is closed, the package 5 is made.

In the embodiment of FIGS. 15 to 19, hybrid materials of the type described herein for web materials, e.g. H7225B or a non-barrier analog of such material, can be used to make the base strip 10. In embodiments where no seal is required between surfaces 25 and 29, the seal between surfaces 23 and 27 can be made either before or after the finished package is made.

In some embodiments, the PSA layer covers the entire first surface 23 of the base strip. The PSA serves to adhere the base strip to the inner surface 27 of the first side panel 12. In these embodiments, it is not necessary to seal the base strip to the inner surface of the first side panel in anchor region "A" because the PSA acts as the anchor 38. In these embodiments, there is no clear area on the first surface of the base strip. To facilitate opening of the package, at least one of the die cuts in the first side panel should be disposed outside the portion of the first side panel underlain by the PSA layer 19.

In some embodiments, at least one die cut, or a portion of a die cut, is disposed closer to the first end of a pouch than the first end 28 of the base strip of the tape, i.e. the end of the base strip of the tape closest to the first end of the pouch.

In the embodiments disclosed in the drawings, a second portion of the first surface of the base strip is shown as substantially free of pressure sensitive adhesive, the first portion of the first surface of the base strip positioned closer to the first end of the pouch than the second portion. The second portion of the first surface can be anchored to the inner surface of the first side panel at a second location on the first side panel, shown as anchor 38. The portion of the first surface coated with PSA can be at one terminal portion of the strip, either closest to the first end of the package, or furthest from the first end of the package. Alternatively, the first portion can be disposed intermediate from, and spaced apart from, the two longitudinal (with respect to the first and second ends of the package) ends of the strip, such that clear areas of the base strip are present on both sides of the intermediate portion coated with PSA. Thus, the PSA layer can be coextensive with the first surface of the base strip, or can extend along only one or more terminal or intermediate portions of the strip, and the first surface of the strip can consequently have no clear areas, one clear area, or two or more clear areas C.

Opening Mechanisms and Strip Construction

The package of the invention can be easily manually opened. Any suitable mechanism or combination of mechanisms for obtaining this functionality and feature can be used according to the invention. The following are examples of such mechanisms.

1. Adhesive Failure

In this embodiment, surface 25 and inner surface 29 each comprises a polymeric composition that, when surface 25 is sealed to surface 29, forms an easy-open seal. This seal provides the interface that breaks apart upon manually opening the package. The interlaminar bonds between layers of the base strip itself (where the strip is of multilayer construction), the cohesive strength of each layer within the strip or of the single layer of a monolayer strip, and the seal that holds surface 23 to inner surface 27, are stronger than the seal that holds surface 25 to surface 29.

In some embodiments, the polymeric composition of surfaces 25 and 29 will be the same or similar. Useful in these embodiments are the peel systems disclosed in U.S. Pat. No. 4,189,519 (Ticknor) (blend of EVA or EMA or EEA with crystalline isotactic polybutylene, and optionally with anhydride grafted EVA); U.S. Pat. No. 4,252,846 (Romesberg et al.) (blend of EVA and HDPE, optionally with IO or polybutylene (PBU)); U.S. Pat. No. 4,550,141 (Hoh) (blend of IO and polypropylene/ethylene copolymer (EPC)); U.S. Pat. No. 4,666,778 (Hwo) (three component blend of PE, that can be LLDPE, LDPE, MDPE, or HDPE, or EVA or EMA, with PBU, and PP or EPC); U.S. Pat. No. 4,882,229 (Hwo) (butene-1 polymer or copolymer blended with modified or unmodified LDPE); U.S. Pat. No. 4,916,190 (Hwo) (blend of butylene polymer or copolymer, with PE polymer or copolymer (LLDPE, LDPE, MDPE, EVA, EMA, EEA, EBA, or HDPE), with propylene polymer or copolymer); U.S. Pat. No. 4,937,139 (Genske, et al.) (propylene polymer or copolymer blended with HDPE); U.S. Pat. No. 5,547,752 (Yanidis) (blend of PBU and IO); and U.S. Pat. No. 5,997,968 (Dries et al.)(blend of Component 1 (a copolymer of ethylene and propylene or ethylene and butylene or propylene and butylene or ethylene and another -olefin having 5 to 10 carbon atoms or propylene and another -olefin having 5 to 10 carbon atoms or a terpolymer of ethylene and propylene and butylene or ethylene and propylene and another -olefin having 5 to 10 carbon atoms) and Component 2 (HDPE, MDPE, LDPE, LLDPE or VLDPE); these U.S. patents all incorporated herein by reference in their entirety.

In other embodiments, the composition of surfaces 25 and 29 will differ, i.e. dissimilar sealants are used. Useful in these embodiments are the peel systems disclosed in U.S. Pat. No. 3,655,503 (Stanley et al.) (LDPE or MDPE sealed to polypropylene (PP), EPC, saran, nylon 6, polycarbonate (PC), polyvinyl chloride (PVC), or polyethylene oxide (PEO); PP sealed to saran, nylon 6, PC, PVC, PEO, IO, phenoxy, or EVA; or nylon sealed to IO); U.S. Pat. No. 4,729,476 (Lulham et al.) (a blend of EVA and IO sealed to IO); U.S. Pat. No. 4,784,885 (Carespodi) (PP, HDPE, or LLDPE sealed to substantially linear PE (HDPE, LLDPE) blended with a polyolefinic thermoplastic elastomer such as ethylene propylene diene monomer (EPDM), EPM, butyl rubber, halogenated butyl rubber, isoprene rubber, and styrene butadiene rubber); U.S. Pat. No. 4,859,514 ((Friedrich et al.) (IO or IO blended with EVA, sealed to a blend of EVA and ethylene butene copolymer (EBC) and PP); U.S. Pat. No. 5,023,121 (Pockat, et al.)(a blend of PBU and PP and a third polymeric material selected from EVA, LDPE, LDPE, and IO, sealed to EVA, LDPE, LLDPE, or IO); these U.S. patents all incorporated herein by reference in their entirety.

Alternatively, the seal between surfaces 23 and 27, instead of or in addition to the seal between surfaces 25 and 29, can function as the easy-open seal.

In some embodiments, surface 25 is not sealed to surface 29, and strip 10 thus remains unattached to second side panel 14 in the finished package, except for any side seals in the package that hold the two ends of base strip 10 between the first and second side panels.

2. Delamination Failure

In this embodiment, one of the interlaminar bonds between layers of the base strip itself (where the strip is of multilayer construction) can be broken. Thus, the interlaminar bond provides the interface that will break apart upon manually opening the package. The seal between surfaces 25 and 29, and between surfaces 23 and 27, and the cohesive strength of each layer within the strip, are stronger than the interlaminar bond. Useful in this embodiment are the peel systems disclosed in U.S. Pat. No. 4,944,409 (Busche et al.), this patent incorporated herein by reference in its entirety.

3. Cohesive Failure

In this embodiment, one of the layers of the base strip itself (where the strip is of multilayer construction) or the monolayer base strip, fractures when the package is opened. The seal between surfaces 25 and 29, and between surfaces 23 and 27, and the interlaminar bonds between layers of the strip itself (where the strip is of multilayer construction) are stronger than the layer that fractures. Useful in this embodiment is the peel system disclosed in U.S. Pat. No. 6,476,137 (Longo) (internal rupture of a sealant layer comprising a blend of an ionomer having a melt flow index of less than 5, and a modified ethylene/vinyl acetate copolymer having a substantially higher melt flow index, where the melt flow indices of the two polymers in the seal layer differ by at least 10), this patent incorporated herein by reference in its entirety.

Other peel systems useful in connection with the present invention are those disclosed in U.S. Pat. No. 4,058,632 (Evans et al.), U.S. Pat. No. 4,615,926 (Hsu et al.); U.S. Pat. No. 5,128,414 (Hwo); U.S. Pat. No. 6,395,321 (Schaft et al.), U.S. Pat. No. 7,055,683 (Bourque et al.), and US Patent Publication Nos. 20030152669 (Vadhar et al.) and 2008/0260305 (Shah et al.) (disclosing as easy-open sealant), DuPont APPEEL™ resins, such as those based on EVA, modified EVA, EAA, or modified EAA; polyethylenes such as LDPE and/or EVA blended with PP; LDPE or EVA blended with polybutene-1, or random propylene/ethylene copolymer blended with polybutene-1; EVA or LDPE blended with PP; LDPE blended with EVA and PP; such blends provide an easy-open sealant when adhered to polyethylene sealants); these U.S. patents and publications all incorporated herein by reference in their entirety.

4. Failure Involving PSA

In some embodiments, a package can be made where no easy-open seal and no easy-open sealant is present, and easy-open functionality is provided in the package by the PSA. Opening can involve e.g. the PSA preferentially adhering to one of two surfaces, as the two surfaces are pulled apart; or adhering to both of two surfaces as the two surfaces are pulled apart. These embodiments are used in combination with displacing or removing the die cut segment from the front panel. A first portion of the die cut segment is underlain by a clear area of the first surface of the base strip, and a second portion of the die cut segment is underlain by pressure sensitive adhesive. The die cut segment is so arranged with respect to the discrete tape that when the die cut segment is displaced or removed from the first side panel, at least a portion of the pressure sensitive adhesive, as well as at least a portion of the first end 28 of the base strip is exposed, i.e. is visible to the viewer facing the first side panel. By grasping the first end 28 of the base strip after removing the die cut segment, and pulling towards the user, the package contents can be accessed. The package can thereafter be reclosed by adhering one of the first and second panels to the pressure sensitive adhesive. "First end of the base strip" herein means the end 28 of the base strip closest to the first end of the package.

Figure 2:
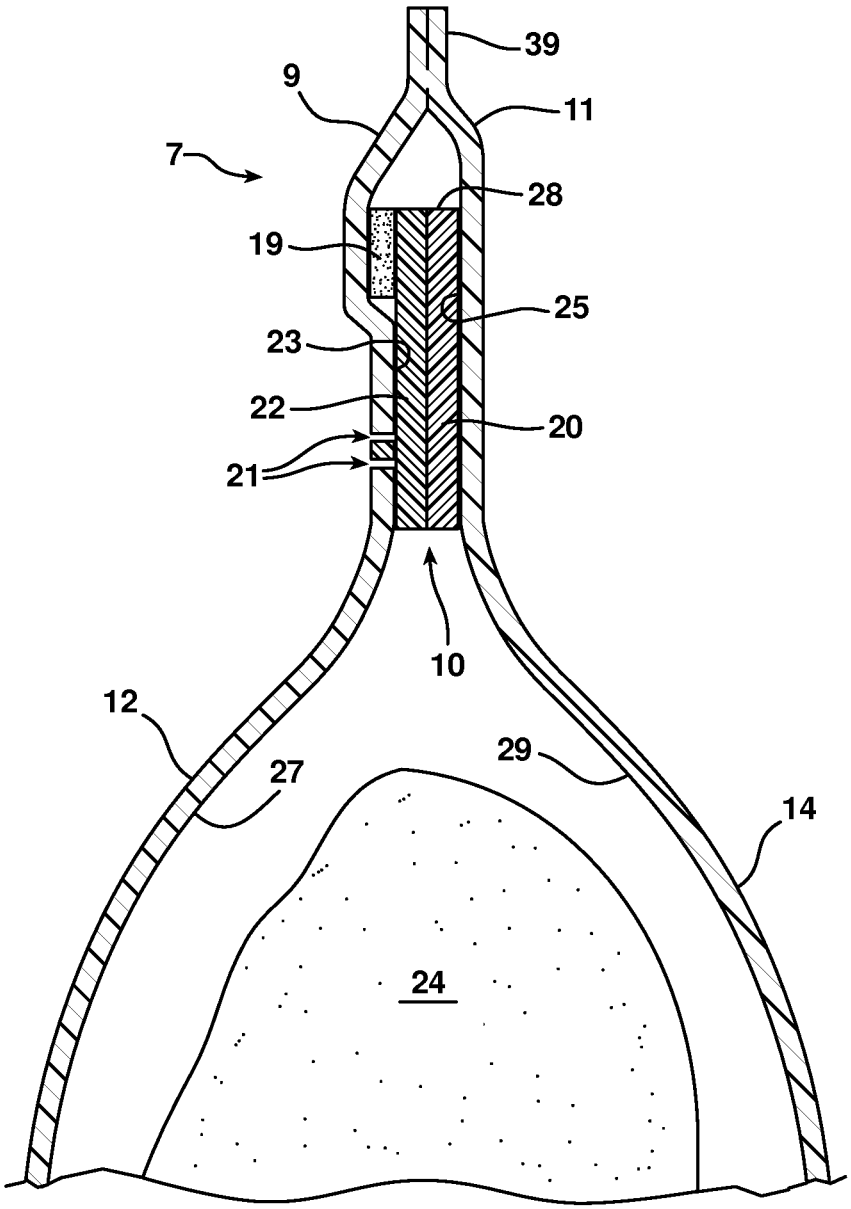
FIG. 2 is an enlarged view of the package of FIG. 1.

Optionally, especially for applications where hermeticity of the package is required before the package is first opened, a supplemental seal, of any suitable geometry, is disposed near the first end of the package, seals the first side panel to the first end of the base strip. See e.g. FIG. 2D, region "D". This seal reduces the possibility that, if the pressure sensitive adhesive becomes partially unadhered, oxygen from outside the package can enter the package. This supplemental seal is an easy-open seal. The supplemental seal can be located in the area of the base strip between the pressure sensitive adhesive and the first end of the base strip, or can be located in the area of the pressure sensitive adhesive itself. Thus, "the supplemental seal seals the first side panel to the first end of the base strip" is used herein to mean sealing of the first side panel to the base strip either in the region of the pressure sensitive adhesive (whether or not the pressure sensitive adhesive extends to the first end of the base strip) or in an area of the base strip between the pressure sensitive adhesive and the first end of the base strip. FIG. 2D shows an area near the first end of the base strip not coated with a pressure sensitive adhesive, and within which the supplemental seal is made.

In some embodiments, the first and second portion of the die cut segment will correspond to a first portion of the die cut segment having a score, and a second portion of the die cut having a through cut; and will also correspond to a first portion of the underlying base strip coated with a pressure sensitive adhesive, and a second portion of the underlying base strip with a clear area. However, those skilled in the art will appreciate, after a review of this disclosure, that some variation is possible in this arrangement, such that e.g. a first portion of the die cut segment may comprise to some extent a through cut, and a second portion of the die cut may comprise to some extent a score, in particular if both portions of the die cut segment are shadowed by the base strip. If the first portion of the die cut segment is closer to the first end of the package than the first end of the base strip, i.e. is not shadowed by the base strip, such an arrangement may suffice provided hermeticity of the package is not required. Likewise, some clear areas may be present in the first portion of the base strip (such as an area to accommodate the supplemental seal), provided the easy-open and reclosable functionality of the package is substantially maintained.

The base strip 10 can have any suitable number of layers. In FIGS. 1 and 2, a strip 10 has two layers. Layer 20 comprises a polymeric composition that in one embodiment provides an easy-open seal when sealed at surface 25 to inner surface 29. Layer 22 comprises a polymeric composition that exhibits a relatively strong seal when sealed at surface 23 to inner surface 27. In any strip construction, alternatively layer 22 or its equivalent can provide the easy-open seal, and layer 20 or its equivalent can provide the relatively strong seal, when sealed to respective web inner surfaces. Alternatively, both 20 and 22 or their equivalents, or neither of 20 and 22 or their equivalents, provide an easy-open seal.

Figure 5:
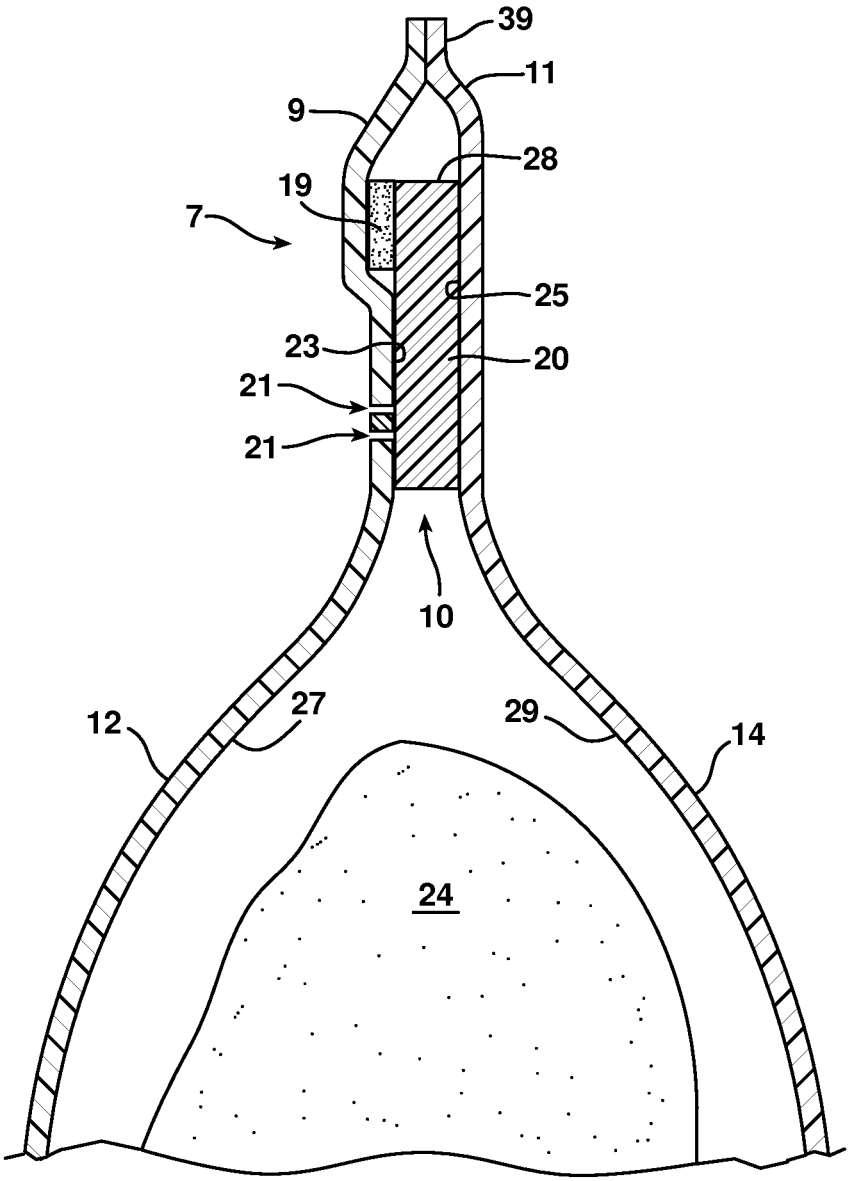
FIG. 5 an enlarged view of a portion of the package of FIG. 1 according to another embodiment.

Alternatively, (FIG. 5), base strip 10 is of monolayer construction. Layer 20 comprises a polymeric composition and includes first outer surface 23 and second outer surface 25 that can be like those disclosed herein for a multilayer base strip.

In any of these alternatives, the surface of the strip facing inner surface 29 in some embodiments is not sealed to inner surface 29 except at any side seals of the package.

Figure 2A:
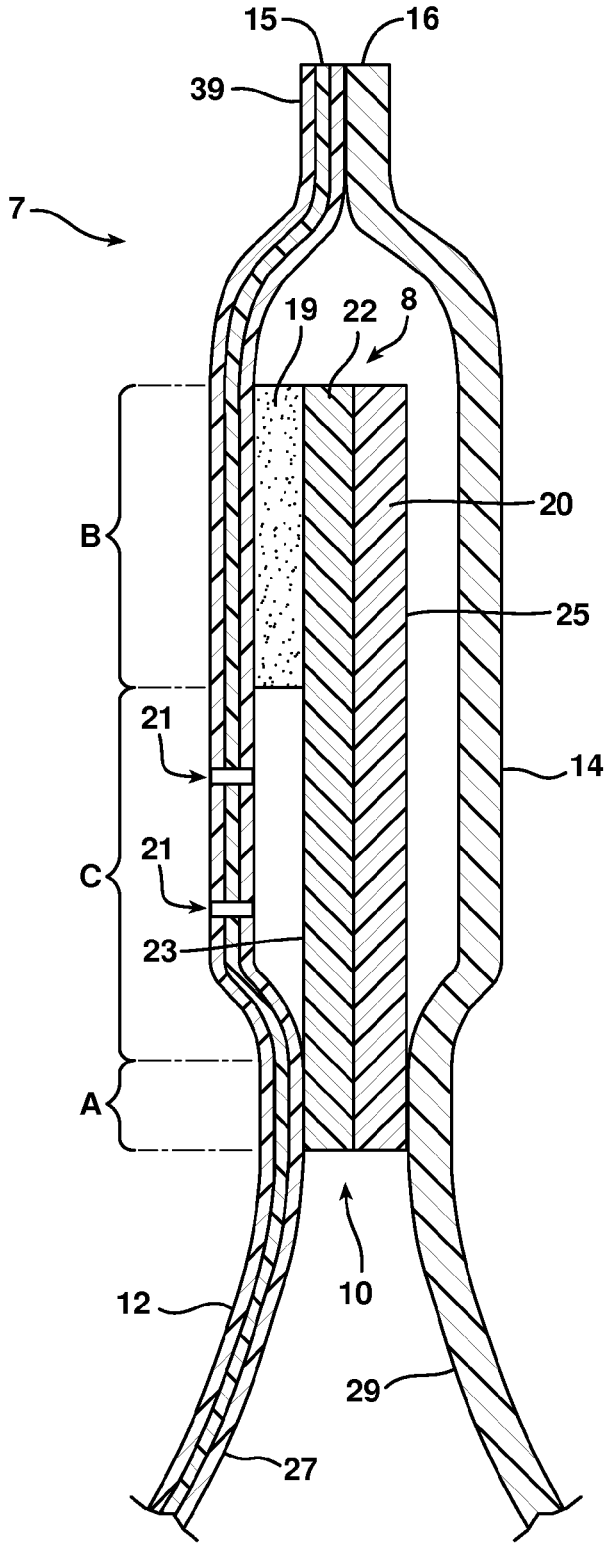
FIG. 2A is an enlarged cross-sectional view of a portion of FIG. 1.

Referring to FIG. 2A, the first side panel 12 includes at least one die cut 21. Strip 10 is adhered to a portion of the inner surface 27, with a PSA, at adhesive region "B". During manufacture of the package, another portion of the strip is sealed to a portion of the inner surface 27, e.g. with a relatively strong heat seal, at anchor region "A". Die cut region "C" of the first side panel is underlain by a portion of the strip that is neither sealed, nor adhered by PSA, to inner surface 27. The second surface 25 of strip 10 is sealed to inner surface 29 of second side panel 14 with an easy-open seal.

Figure 6:
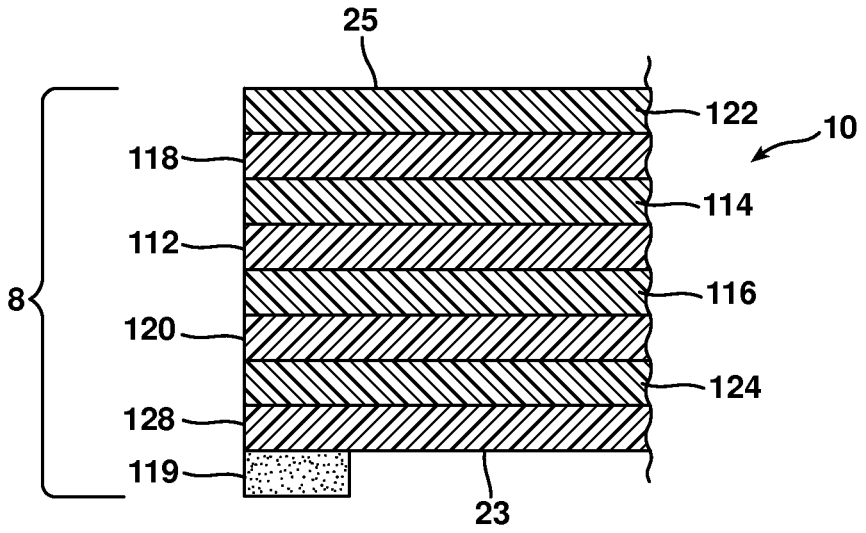
FIG. 6 is a cross-sectional view of a discrete tape.

A representative film structure "A1" suitable for use as the film strip 10 according to the invention is shown in FIG. 6. In one embodiment, this film has the composition shown in Table 1.

TABLE 1

(Example 1)

| Layer | Composition | Gauge (thickness %) | Gauge (mils) | Gauge (μm) |
|---|---|---|---|---|
| 122 | EZ1 | 25.00 | 0.50 | 12.7 |
| 118 | AD1 | 7.50 | 0.15 | 3.8 |
| 114 | 80% NY1 + 20% NY2 | 7.50 | 0.15 | 3.8 |
| 112 | OB1 | 10.0 | 0.20 | 5.1 |
| 116 | 80% NY1 + 20% NY2 | 7.50 | 0.15 | 3.8 |
| 120 | AD1 | 7.50 | 0.15 | 3.8 |
| 124 | 65% AD2 + 35% PE1 | 17.50 | 0.35 | 8.9 |
| 128 | PE1 | 17.50 | 0.35 | 8.9 |

This example of a material suitable as the base strip 10 is a barrier film with an easy-open sealant, and is currently used as a barrier/easy-open component of various laminated materials that also include a polyester film component, sold commercially by the Cryovac business unit of Sealed Air Corporation, under designations including H52XXBZ, and H72XXBZ. These are sold as primary packaging materials, i.e. webs that form the main body of the package, not as discrete strips to be used in combination with a primary web.

When used according to the invention, the easy-open sealant layer 122 of A1 exhibits a peel force of typically 2 pounds/inch (ASTM F88). Layer 128 of A1 yields a peel force of typically 8 pounds/inch.

The resins disclosed in Table 1, and other resins referred to elsewhere in the present application, are identified in Table 2.

TABLE 2

| Material Code | Tradename Or Designation | Source(s) |
|---|---|---|
| AB1 | 10853 ™ | Ampacet |
| AD1 | PLEXAR ™ PX1007 ™ | Equistar |
| AD2 | BYNEL ™ 39E660 ™ | DuPont |
| AD3 | PLEXAR ™ PX3236 ™ | LyondellBasell |
| EM1 | LOTADER ™ 4503 ™ | Arkema |
| EV1 | ESCORENE ™ LD318.92 ™ | ExxonMobil |
| EZ1 | APPEEL ™ 72D727 ™ | DuPont |
| NY1 | ULTRAMID ™ B33 01 ™ | BASF |
| NY2 | GRIVORY ™ G21 ™ | EMS |
| OB1 | SOARNOL ™ ET3803 ™ | Nippon Gohsei |
| PE1 | PE ™ 1042cs15 ™ | Flint Hills |
| PE2 | AFFINITY ™ PL 1888G ™ | Dow |
| PE3 | PETROTHENE ™ NA 345-013 ™ | LyondellBasell |
| PE4 | — | — |
| PE5 | EXCEED ™ 3512CB ™ | ExxonMobil |
| PE6 | AFFINITY ™ PT 1450G1 ™ | Dow |
| PE7 | MARFLEX ™ 1019 ™ | Chevron Phillips |
| PE8 | — | — |
| PET2 | MYLAR ™ M34 ™ | DuPont Teijin |

AB 1 is a masterbatch having about 81% linear low density polyethylene, and about 21% of an antiblocking agent (diatomaceous earth).

AD1 is a maleic anhydride modified EVA that acts as a polymeric adhesive (tie layer material).

AD2 is a maleic anhydride modified EVA that acts as a polymeric adhesive (tie layer material).

AD3 is a maleic anhydride modified LLDPE that acts as a polymeric adhesive (tie layer material).

EM1 is ethylene/methyl acrylate copolymer with a methyl acrylate content of about 20%.

EV1 is an ethylene/vinyl acetate copolymer with a vinyl acetate content of less than 10% by weight of the copolymer.

EZ1 is a compound polymer blend of 65% ionomer (SURLYN™ 1650SB), 30% EVA (ELVAX™ 3134Q), and 5% polybutylene (MONTELL™ PB8640), each by weight of the blend.

NY1 is nylon 6 (polycaprolactam).

NY2 is an amorphous copolyamide (6I/6T) derived from hexamethylene diamine, isophthalic acid, and terephthalic acid.

OB1 is EVOH with about 38 mole % ethylene.

PE1 is LDPE.

PE2 is a branched, single-site catalyzed ethylene/octene copolymer with a density of about 0.9035 grams/cubic centimeter.

PE3 is LDPE.

PE4 is a dry/pellet blend of 65% AD2 and 35% PE1.

PE5 is a linear, single-site catalyzed ethylene/hexene copolymer with a density of about 0.9120 grams/cubic centimeter.

PE6 is a branched, single-site catalyzed ethylene/octene copolymer with a density of about 0.902 grams/cubic centimeter.

PE7 is LDPE.

PE8 is a blend of between 0.01% and 100%, by weight of the total composition, PE5, and between 100% and 0.01%, by weight of the total composition, EV1.

PET2 is a saran-coated biaxially oriented polyester.

All percentages herein are by weight unless indicated otherwise.

Example 1 as shown has a total thickness ranging from about 2.0 mils to 3.5 mils.

Core layer 112 of the above film structure can comprise any suitable oxygen barrier material, such as EVOH, and can be blended in any suitable proportion with other polymeric materials or organic or inorganic additives as desired. In one embodiment, intermediate layers 114 and 116 can each comprise 100% semicrystalline polyamide such as nylon 6.

In another embodiment, Intermediate layers 114 and 116 each comprise a blend of an amorphous polyamide and a semicrystalline polyamide.

Tie layers 118 and 120 can comprise any suitable polymeric adhesive that functions to bond two layers together, e.g. EVA, EAO, LDPE, EMA, and anhydride grafted derivatives of these polymers. Tie layers 118 and 120 can be the same, or can differ.

Bulk layer 124 can comprise a suitable polyolefin, such as an EAO; and/or a polymeric adhesive such as those disclosed herein for tie layers 118 and 120.

In one embodiment, first outer layer 122 functions as an easy-open sealant layer of the film, and provides a surface 25 that can be sealed to the inner surface 29. Layer 122 can comprise any suitable material or blend of materials that provides an easy-open peelable seal when adhered to the inner surface 29. Layer 122 comprises EZ1 or any suitable resin or resin blend that provides an easy-open peelable sealant.

Second outer layer 128 functions as a sealant layer of the film, and provides a surface 23 that can be sealed to the inner surface 27. Layer 128 can comprise any suitable material or blend of materials that provides a relatively strong seal when adhered to the inner surface 27. Layer 128 comprises PE1 or any EAO such as EXACT™ 3024, a single-site catalyzed linear ethylene/butene copolymer from ExxonMobil with a density of 0.905 g/cc; or AFFINITY™PL 1888G, a single-site catalyzed long chain branched ethylene/octene copolymer from Dow with a density of 0.9035 g/cc.

Additional materials that can optionally be incorporated into one or more of the film layers, as appropriate, include antiblock agents, slip agents, antifog agents, fillers, pigments, dyestuffs, antioxidants, stabilizers, processing aids, plasticizers, fire retardants, UV absorbers, etc.

Alternatively, layer 122 can be sealed to inner surface 27, and layer 128 can be sealed to inner surface 29.

In any of these embodiments, the PSA layer (19, 119, 219) will occupy a portion of the surface of the strip that faces and contacts inner surface 27 of first side panel 12.

The invention is characterized by the fact that:

- the package before initial opening does not have a PSA on the exterior surface of the package,
- before opening the package, the PSA is in contact with the inner surface of the first side panel of the package, and not in direct contact with the product inside the package,
- after opening the package, the surface of the base strip on which the PSA is coated effectively forms a portion of the outer surface of the first side of the package,
- before opening the package, the PSA is not in direct contact with the outer surface of the first side panel, or of the outer surface of the second side panel,
- a portion of the first side panel acts functionally like a release liner for the PSA, although no discrete release liner is present in the final package.
- once the package is opened, the PSA is on the outside of the package on a strip that acts functionally like an extension of the first side panel,
- In some embodiments, a portion of the first side panel acts functionally as a closing flap.
- In some embodiments, after opening the package, the first and second side panels can be folded over and the exposed PSA can be brought in contact with the outer surface of the first side panel.
- because the PSA of the opened package, although exposed to the outside environment, faces away from the product, the chance of degradation of the PSA by contact with the product is reduced.

In general, strip 10 can have any total thickness desired, and each layer can have any thickness desired, so long as the strip and package provide the desired functionalities. Typical total film thicknesses are from 0.1 mils to 15 mils, such as 0.2 to 12 mils, such as 0.5 mils to 10 mils, 0.8 mils to 8 mils, and 1 mil to 4 mils. Suitable gauges include 1.5 mils, 2 mils (as in Example 1); and 3 mils.

Figure 7:
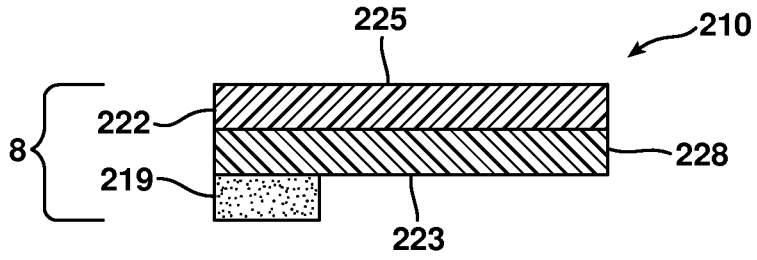
FIG. 7 is a cross-sectional view of a discrete tape according to another embodiment.

Thus, by way of example, FIG. 7 shows, in another embodiment, a two layer film 210 having a first outer layer 222 compositionally and functionally like layer 122 of FIG. 6, with a first outer surface 225; and having a second outer layer 228 compositionally and functionally like layer 128 of FIG. 6, with a second outer surface 223.

Two, three, four, five, six, seven, and eight or more layer films can thus alternatively be produced, that each include the layers described above with respect to the film strip of FIG. 7, with additional layers as needed, using suitable polymers such as olefin homopolymers or copolymers.

In some embodiments, such as the film strip of FIG. 7, an oxygen barrier layer is not necessary, for example in the packaging of produce. In these embodiments, the web or webs that comprise the pouch will typically also not have an oxygen barrier layer. In contrast, embodiments of film strip 10 that include an oxygen barrier layer will typically be suitable in connection with web or webs for the pouch that include an oxygen barrier layer.

Figure 2B:
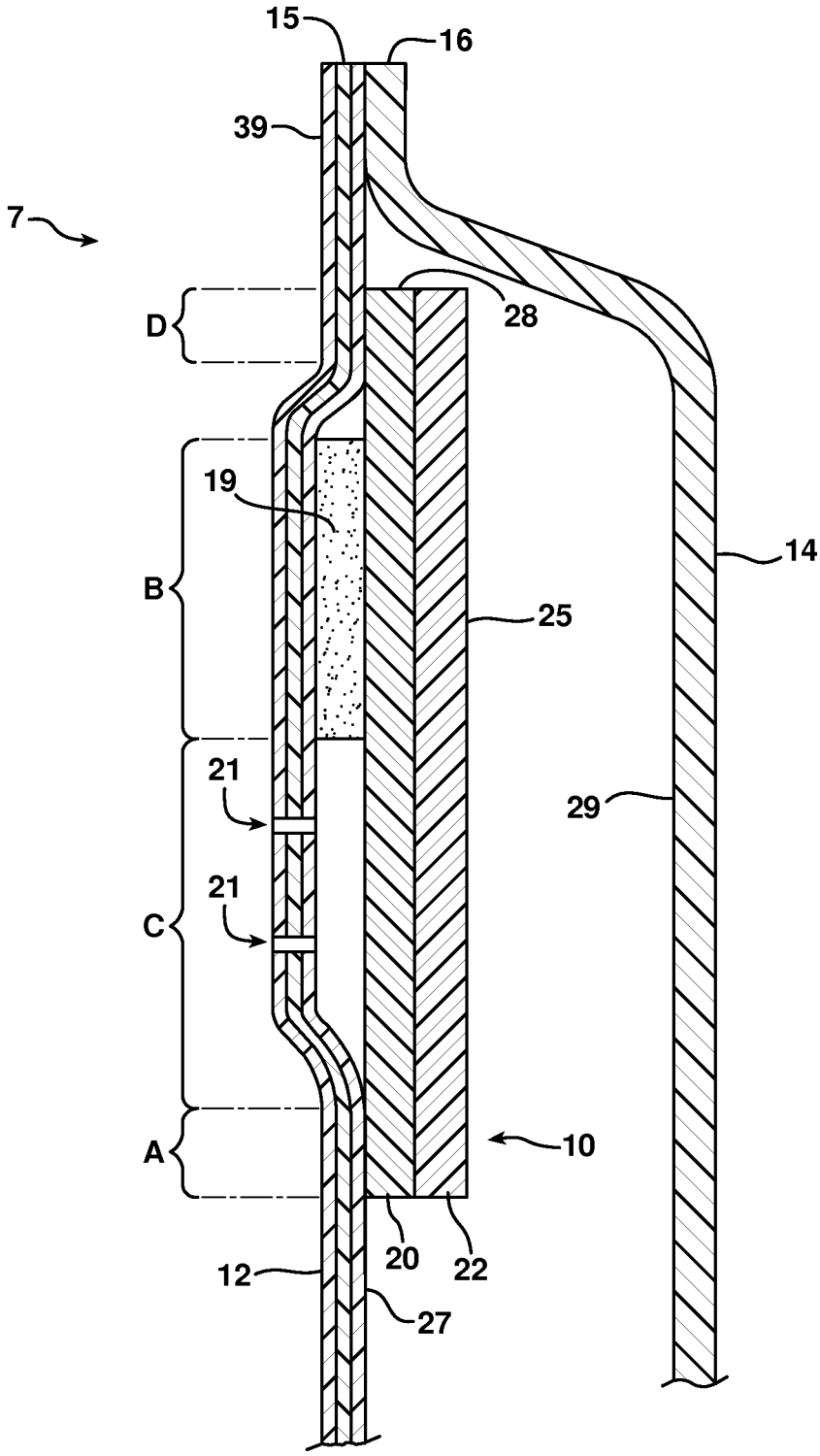
FIG. 2B is an enlarged cross-sectional view of another embodiment of a portion of FIG. 1.

FIG. 2B is similar to FIG. 2A, but in which 1) the surface of the strip providing an easy-open seal faces the inner surface 27 instead of inner surface 29; 2) a portion of the strip is sealed to a portion of the inner surface 27 with an easy-open or relatively strong anchor seal, at anchor region "A", 3) another portion of the strip is optionally sealed to a portion of the inner surface 27 with a supplemental seal, such as an easy-open seal, at seal region "D", and 4) the second surface 25 of strip 10 is not sealed to inner surface 29 of second side panel 14, except by side seals. The embodiment of FIG. 2B offers the benefit of more usable space inside the package, because there is no seal (except at the sides of the package) of surface 25 to surface 29, and therefore more space is available for product.

Figure 2C:
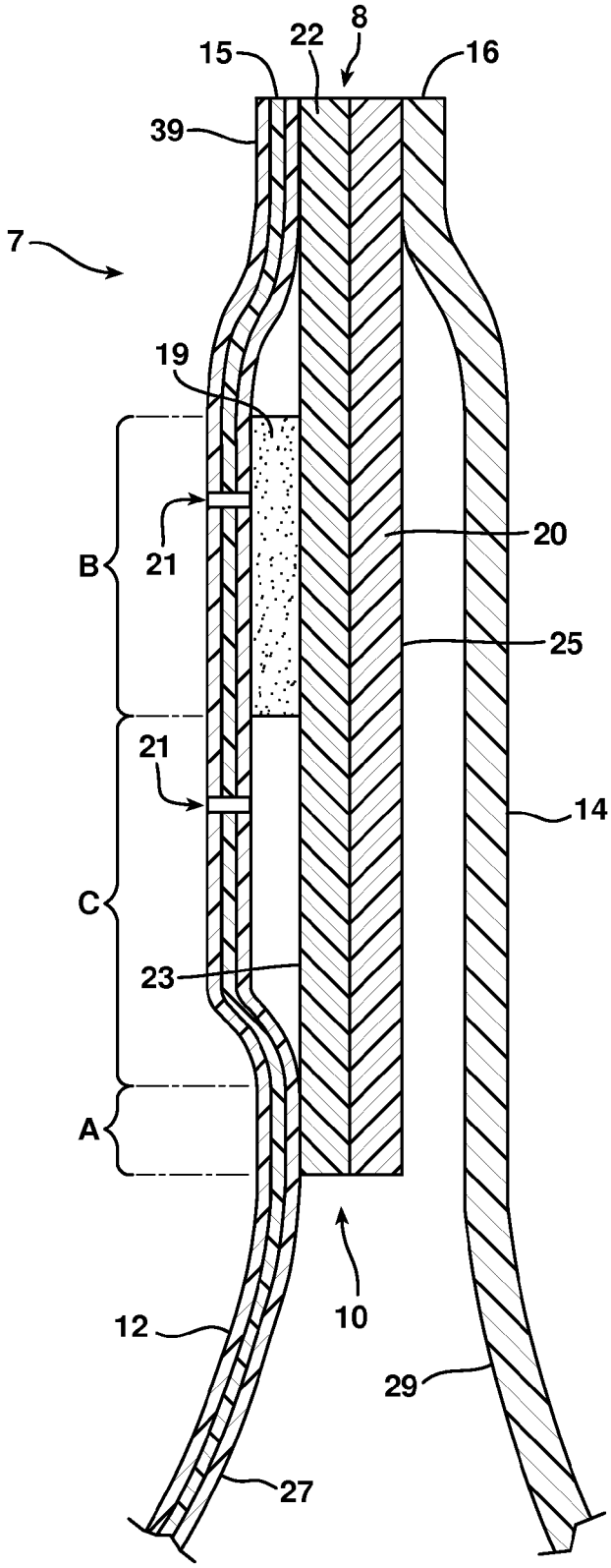
FIG. 2C is an enlarged cross-sectional view of another embodiment of a portion of FIG. 1.
Figure 2D:
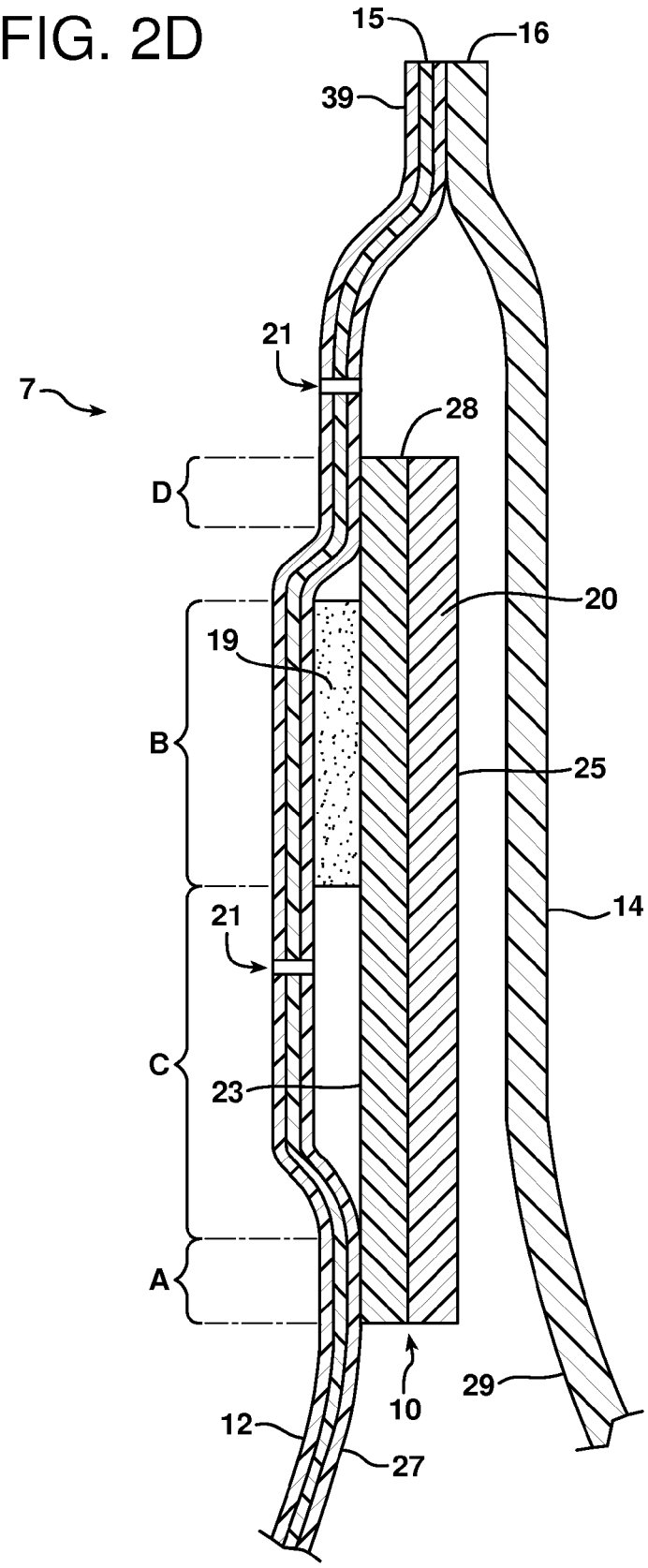
FIG. 2D is an enlarged cross-sectional view of another embodiment of a portion of FIG. 1.

In an alternative embodiment, FIG. 2C is similar to FIGS. 2A and 2B, but in which 1) the surface 25 of the strip 10 providing an easy-open seal faces the inner surface 29; 2) surface 23 of the strip 10 provides a relatively strong seal and faces inner surface 27 of the first side panel 12; 3) strip 10 is sealed at its first end 28 to the inner surfaces of the first ends of the first and second side panels respectively; 4) the package made from the pouch of this embodiment can be opened by grasping or pinching the first and second side panels and pulling them apart from one another, in the manner in which e.g. a potato chip bag is opened, such that the easy-open seal at the first end of the package is broken, and access is had to the contents of the package. After the package is opened, the package can be reclosed by removing the die cut segment defined by die cuts 21, exposing the PSA layer 19, and then folding over the first end of the package to contact and adhere to the PSA layer. Alternatively, the entire upper portion of the first side panel, including the PSA layer, can be folded down onto the lower part of the first side panel to reclose the package. In some embodiments, in the unopened package, the die cut is completely shadowed (underlain) by the strip 10. The embodiment of FIG. 2C offers the benefit of having the opening mechanism of the package (breaking apart the easy-open seal) different from the reclosing mechanism (removing the die cut segment, exposing the PSA, etc.). Thus, in this embodiment, the die cut segment does not need to be removed to open the package. This embodiment also allows for use of webs that do not respond particularly well to die cutting, e.g. laser die cutting. As an example, nylon, which is more difficult to laser die cut than PET, can be used as the web material. Even if a portion of the die cut is inadvertently cut all the way through the web, the underlying strip provides a backing material that protects the contents of the pouch and the initial hermeticity (if needed) of the package.

As shown in FIG. 2C, the strip extends to the first end of the package. An alternative to FIG. 2C is like the embodiment of FIG. 2C, but in which the first ends of first and second side panels respectively extend beyond the first end 28 of base strip 10, and define first and second opening flaps. In this embodiment, the package can be opened as described hereinabove, or alternatively the first and second opening flaps can be pulled apart to break the easy-open seal and access the contents of the package. An example of first and second opening flaps can be seen as flaps 509 and 511 respectively in FIG. 21A. Although these flaps are described in the context of a fin-sealed package made in a VFFS process, such opening flaps could be present in other described embodiments of the invention.

For many products, it is important to ensure hermeticity of the package during storage and distribution. This may be more difficult where one or more die cuts are present in the first side panel of the package. Hermeticity is achieved in various embodiments of the invention where a seal (either easy-open or strong seal) or a PSA anchors the first side panel to the strip in region "A", and a seal adheres the second side panel to the strip (FIG. 2A); or where a seal (either easy-open or strong seal) or a PSA anchors the first side panel to the strip in regions "A" and "D", even though no seal adheres the second side panel to the strip (FIG. 2B) except at the side seals of the package.

In each of the embodiments of the package and process disclosed herein, a non-hermetic or hermetic package can be made in accordance with the invention.

In some embodiments, a package can be made where no easy-open seal is present, and easy-open functionality is provided in the package by the PSA and displacement or removal of the die cut segment.

In one embodiment, layer 22 comprises a sealant that provides a relatively strong seal when layer 22 is sealed to surface 27. An example of a material suitable as a strip for this embodiment is a barrier/sealant component of various laminated materials that also include a polyester film component, sold commercially by the Cryovac business unit of Sealed Air Corporation, under designations including H52XXB, H75XXB, and H72XXB. These are sold as primary packaging materials, i.e. webs that form the main body of the package, not as discrete strips to be used in combination with a primary web. At least one open-loop or closed-loop die cut is disposed on the first side panel. Two or more die cuts can be disposed on the first side panel, one at a position closer to the first end of the package than the strip, as well as a second die cut below or in the vicinity of the strip. A die-cut segment of material can thus be displaced or entirely removed from the first side panel, exposing the first end 28 of the base strip sealed or adhered to the inner surface 27 of first side panel 12. This first end can then be grasped and pulled up, e.g. toward the user, allowing access to the contents of the package.

2. Method of Making a Package

A. Horizontal Form/Fill/Seal (HFFS)

HFFS packaging systems are generally well known to those of skill in the packaging industry, and can be used to make packages of the present invention.

Referring to FIGS. 8A, 8B, 9C and 9D, lay-flat web 300 is unwound from roll 302, then advanced to forming plow 304 to convert lay-flat web 300 to folded web 305 (typically a centerfold film). The second end of each of the pouches to be made will comprise a second end fold 306. Second end fold 306 therefore is equivalent to second end 34 of FIG. 1. This second end fold can be optionally sealed, or left as a folded second end of the pouch. Side seals 308 are made to define a plurality of vertically arranged pouches 309. Each pouch 309 is cut off from the trailing edge of web 300 by an appropriate cutting mechanism (not shown) at position 311, a product (not shown in FIG. 8, but see product 24 in FIGS. 1 to 5) is inserted or dropped into the open mouth 312 of each pouch, and the pouch mouth 312 is then closed by a suitable sealing mechanism such as a heat sealer (not shown) to create a seal 314. Web 300 includes die cuts made in a predetermined pattern (see FIGS. 29A to 30F) to produce packages according to the invention.

Discrete tape 310, equivalent to tape 8 of FIGS. 1 to 5, can be introduced into the HFFS process in a number of ways. For example, tape 310 can be unwound from a roll 315 in the vicinity of roll 302, and disposed on lay-flat web 300 prior to, or as web 300 is being folded into folded web 305. The tape is disposed on the web, typically near and spaced apart from, and parallel to, the first or second longitudinal edges 307 or 313 of the lay-flat web 300; or near the centerline of lay-flat web 300.

The tape 310 includes a base strip, a first portion of the first surface of the base strip coated with a pressure sensitive adhesive, and a second portion of the first surface of the base strip substantially free of PSA. The first portion is closer to a longitudinal end of the pouch, e.g. the first end of the pouch, than the second portion. The first portion of the first surface of the strip is adhered by the pressure sensitive adhesive to the inner surface of folded web 305. The second portion of the first surface of the base strip is sealed to the inner surface of the folded web at a second location on the folded web, by a suitable sealing mechanism such as a heat sealer (not shown). Optionally, the second surface of the strip is sealed to the inner surface of the folded web. Tape 310 would thus be installed on the pouch in the same overall HFFS process that achieves production of the pouch, loading of a product into the pouch, and completion of the final package. Tape 310 is incorporated into the pouch material and after cutting and sealing as described hereinabove, is disposed between and sealed to the two side panels of each pouch as shown in FIGS. 8A, 8B, and FIGS. 1 to 5.

Figure 9A:
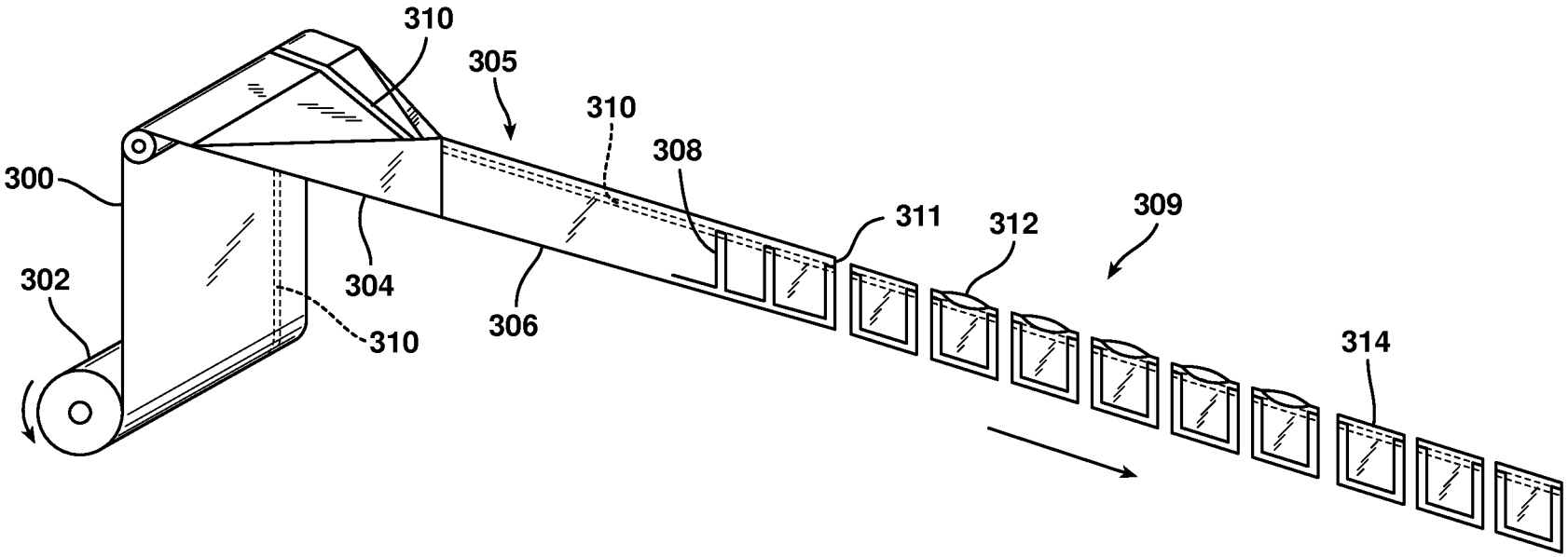
FIG. 9A is a perspective view of a HFFS process and apparatus for making a package according to another embodiment.
Figure 9B:
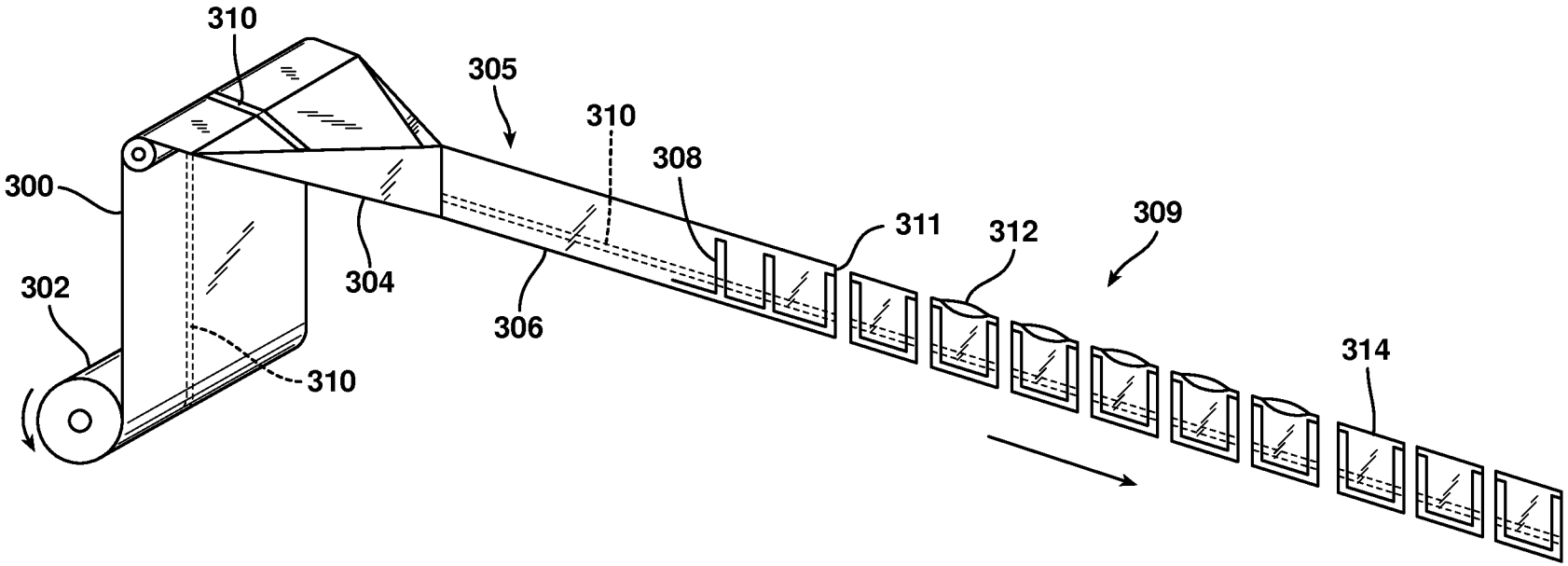
FIG. 9B is a perspective view of a HFFS process and apparatus for making a package according to another embodiment.

Alternatively, and referring to FIGS. 9A and 9B, tape 310 is shown as being installed on the lay-flat web prior to the start of the HFFS packaging process. This can be accomplished off-site from the processor, e.g. by the supplier of the web roll 302. A disadvantage of this embodiment is the asymmetry caused in the roll profile when the tape 310 is wound onto the roll, caused by the build-up in thickness of the roll in the region where the tape is applied, as the result of repeated winds of the roll.

Figure 8A:
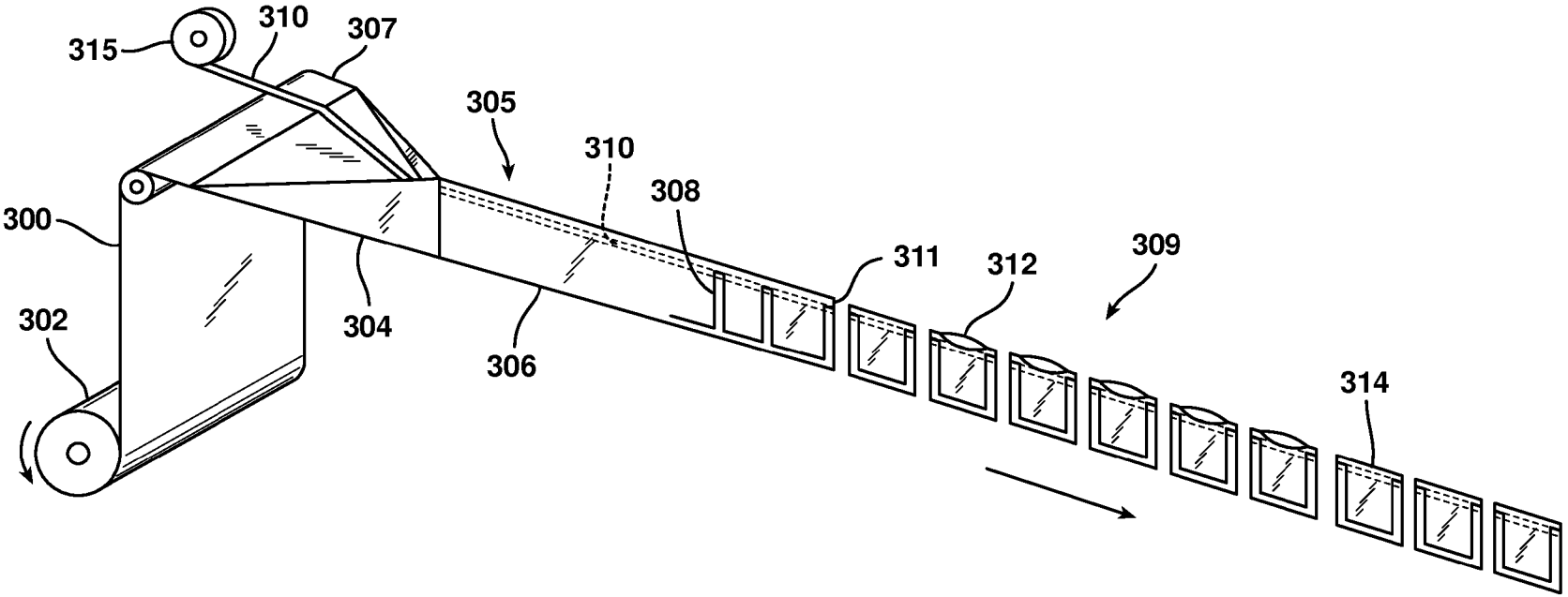
FIG. 8A is a perspective view of a HFFS process and apparatus for making a package.
Figure 8B:
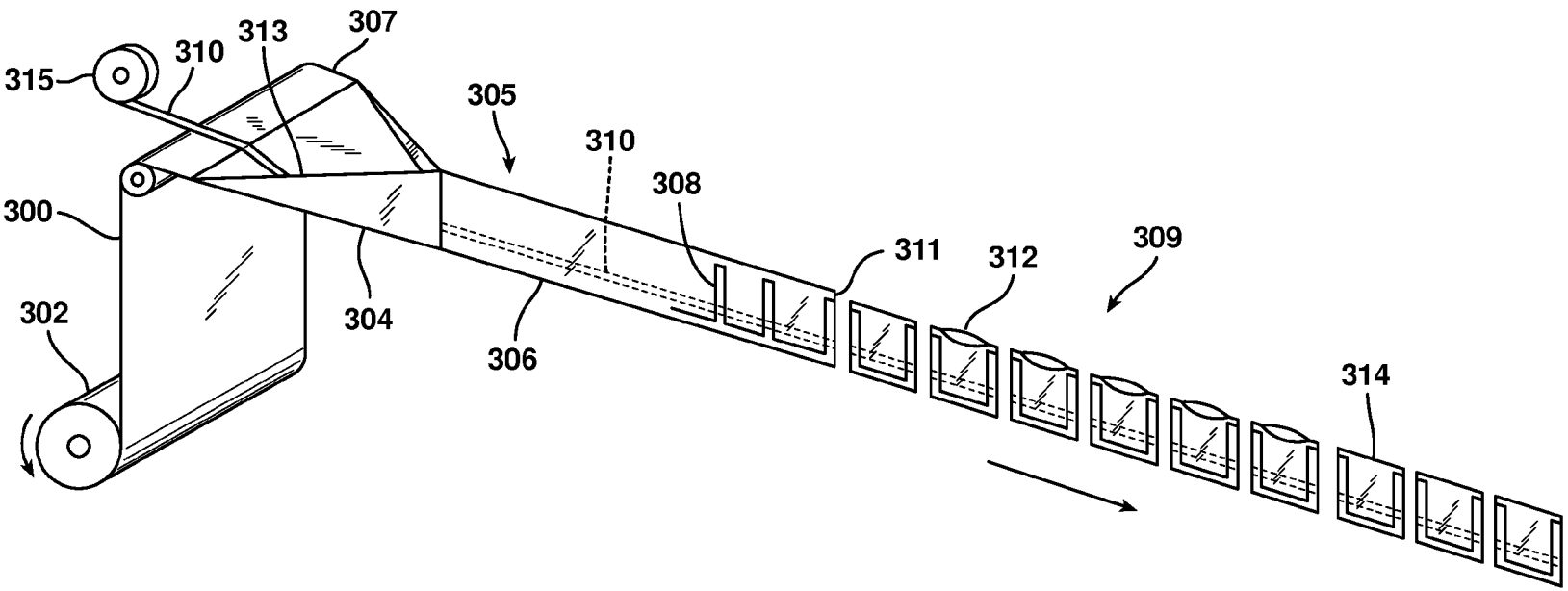
FIG. 8B is a perspective view of a HFFS process and apparatus for making a package according to another embodiment.
Figure 9C:
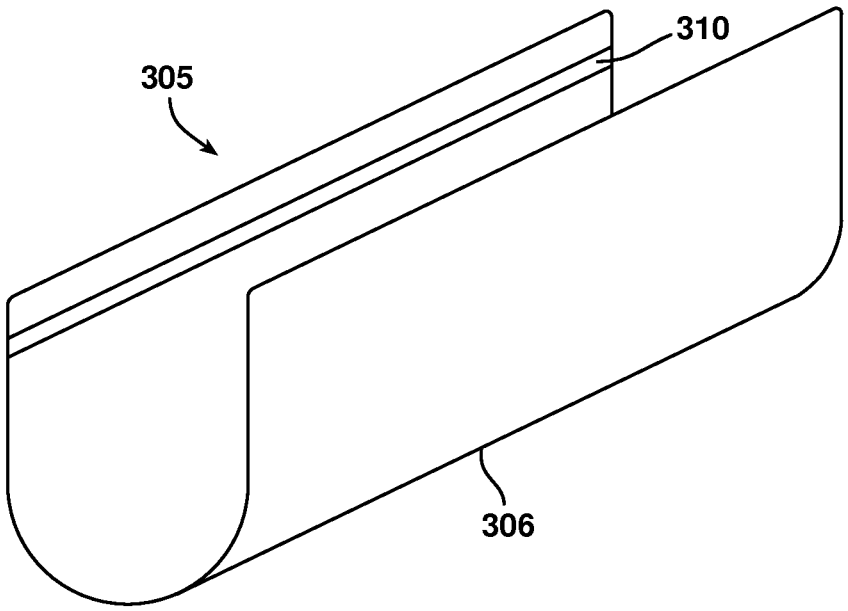
FIG. 9C is a perspective view of a section of folded web.

FIG. 9C is a perspective view of a section of folded web as shown in the HFFS process and apparatus of FIGS. 8 and 9, as the lay-flat web is folded to create folded web 305. The discrete tape 310 is shown disposed, and optionally attached to, an inner surface 27 of one panel 12 of the folded web 305, such that upon sealing the web to create a pouch, panels 12 and 14 (see FIGS. 1 and 2) will sandwich the discrete tape 310 between them.

Figure 9D:
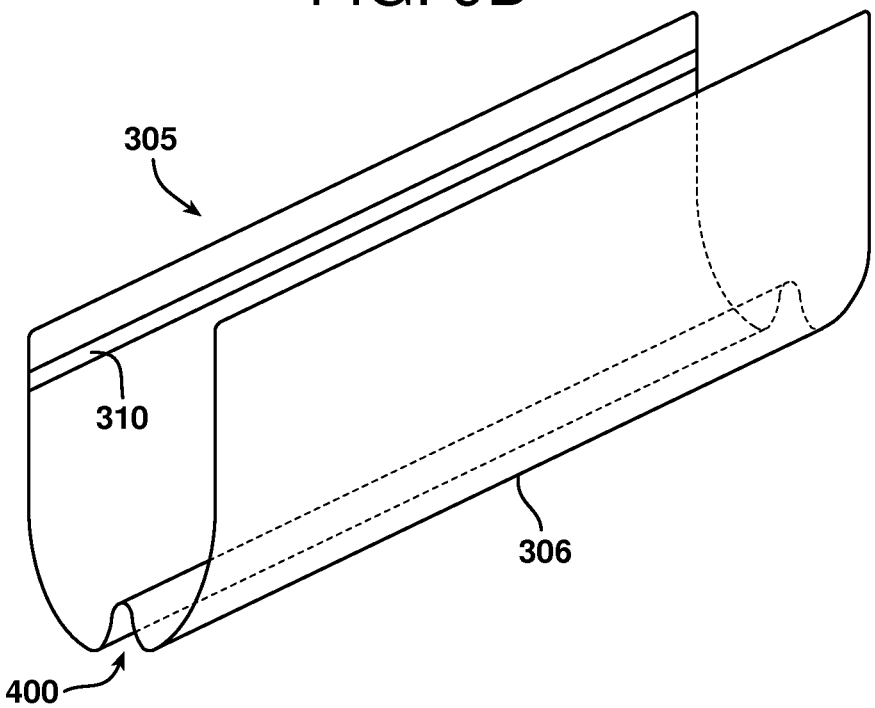
FIG. 9D is a perspective view of a section of gusseted folded web.

The embodiment of FIG. 9D is similar to FIG. 9C, but additionally shows an optional gusset 400 that can be made in the second end fold 306 of the folded web. The gusset can be optionally thereafter heat sealed. A gusseted second end provides a stand-up pouch feature in the final package. Gusseting can be accomplished by any suitable means known to those of skill in the art, such as a second forming plow (not shown) placed in-line in the manufacturing line at a position downstream of the forming plow 304. The bottom area of the folded web takes on a generally "W" shape, i.e. a gusseted shape, in cross-section, with the outside legs of the "W" extending upwardly, and two parallel reverse folds to create the gusseted bottom. Seal opening or holes are previously punched in the inner legs of the "W" shape and aligned with one another so that the two outside plies can be sealed together through these holes. When the seals are made the panels are sealed to one another through the holes. One or more static plows may be mounted above the seal zone to form the gussets. Gusset holes can be die punched by a static die at a hole-punch station which intermittently punches at least two holes at a predetermined position designed to be in general alignment with the side seal, adding rigidity to the gusset portion of the final package. This added rigidity enables the final package to stand up by itself when placed on a flat surface.

At any time during the method of making the package in an HFFS process, a second portion of the first surface of the base strip is anchored to the lay-flat web, the folded web, or the inner surface of the first side panel. This can be done e.g. on the lay-flat web prior to supplying the web to the processor, or prior to or as the lay-flat web is advanced to a forming device, or before or after a product is put in the open pouch.

In the embodiment of FIGS. 8A and 9A, the strip is disposed on the web near and spaced apart from, and parallel to, the first longitudinal edge 307 of the lay-flat web 300. This positions the strip, in each individual pouch made by the HFFS process, near and spaced apart from the first end of each pouch, i.e. near and below the open mouth.

In the embodiment of FIGS. 8B and 9B, the strip is disposed on the web near the centerline of the web, and parallel to, the first longitudinal edge 307 of the lay-flat web 300. This positions the strip, in each individual pouch made by the HFFS process, near and spaced apart from the end fold 306 of each pouch, i.e. near and above the end fold. In this embodiment, a package made from the pouch can be opened by having a line or lines of weakness, such as perforations (not shown), preinstalled and positioned on the web, near and parallel to the end fold 306, between the end fold and the first end 28 of the strip, such that a bottom portion of the package can be torn off, and the exposed side panels can function as first and second opening flaps, which can be pulled away from each other to open the package.

B. Vertical Form/Fill/Seal (VFFS)

Figure 10:
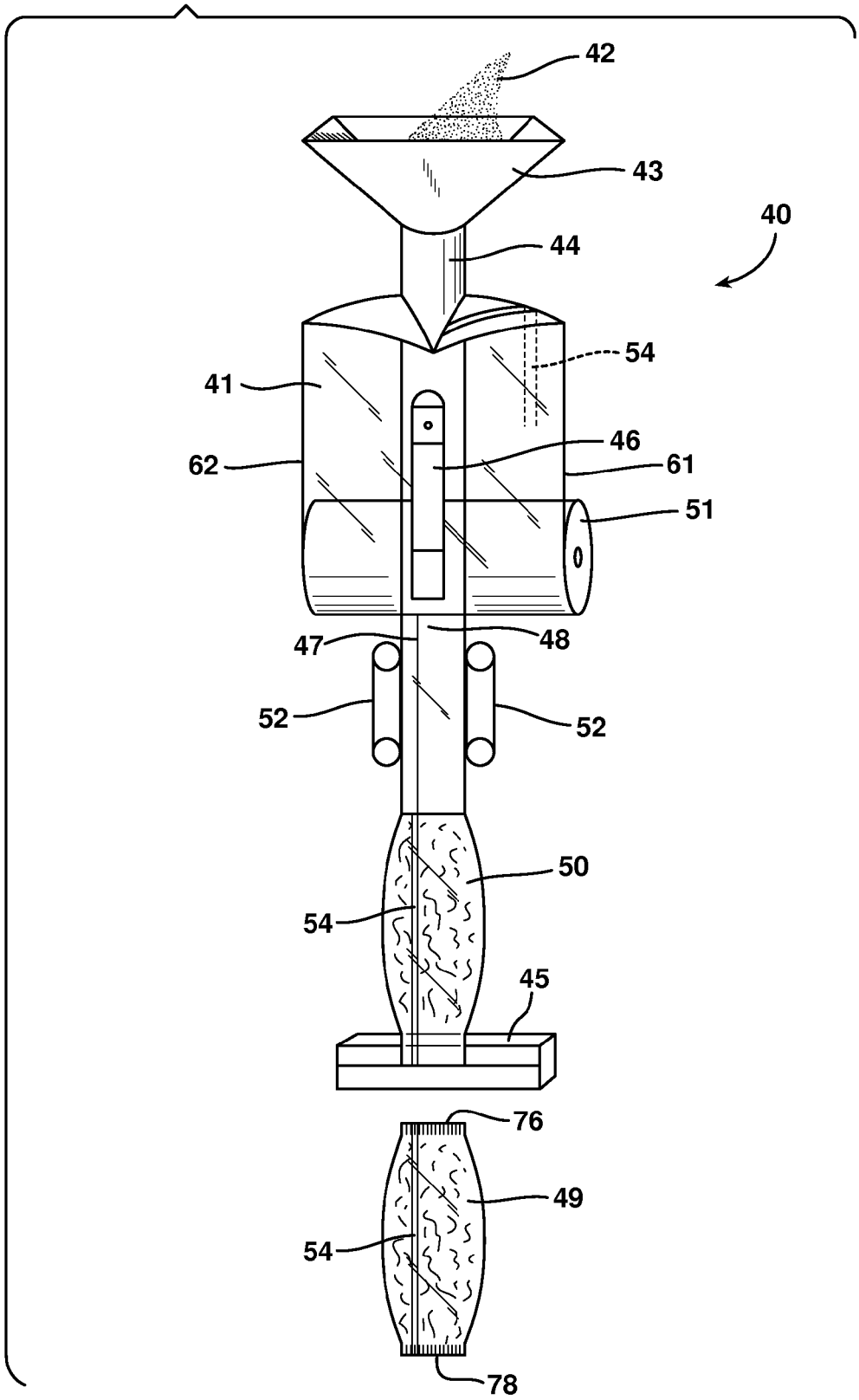
FIG. 10 is an elevational view of a VFFS process and apparatus for making a package.

FIG. 10 schematically illustrates a VFFS apparatus that can be used in conjunction with the apparatus and process according to some embodiments of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety.

Apparatus 40 utilizes a lay-flat web 41 as a rollstock. Web 41 includes die cuts made in a predetermined pattern (see FIGS. 29A to 30F) to produce packages according to the invention. Product 42 is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and web 41 from which the packages are formed is fed from feed roll 51 over certain forming bars (not illustrated), is wrapped about forming tube 44 (sometimes known as a "sailor's collar" or "forming collar") and is provided with a longitudinal fin seal or lap seal 47 by longitudinal heat sealing device 46, resulting in the formation of a vertically-oriented folded web in the form of a tube 48. Transverse heat seal bars 45 operate to close and seal horizontally across the lower end of vertically-sealed tube 48, to form a pouch 49 which is thereafter immediately packed with product 42. Film drive belts 52, powered and directed by rollers, as illustrated, or by suitable alternative motive means, advance tube 48 and pouch 49 a predetermined distance, after which seal bars 45 close and simultaneously seal horizontally across the lower end of vertically-sealed tube 48 as well as simultaneously sealing horizontally across upper end of sealed pouch 49, to form a product packaged in sealed pouch 49. The next pouch 50, thereabove, is then filled with a metered quantity of product 42, forwarded, and the packaging cycle is repeated. It is conventional to incorporate with the seal bars 45 a cut-off knife (not shown) which operates to sever a lower sealed pouch 49 from the bottom of upstream pouch 50.

Figure 11:
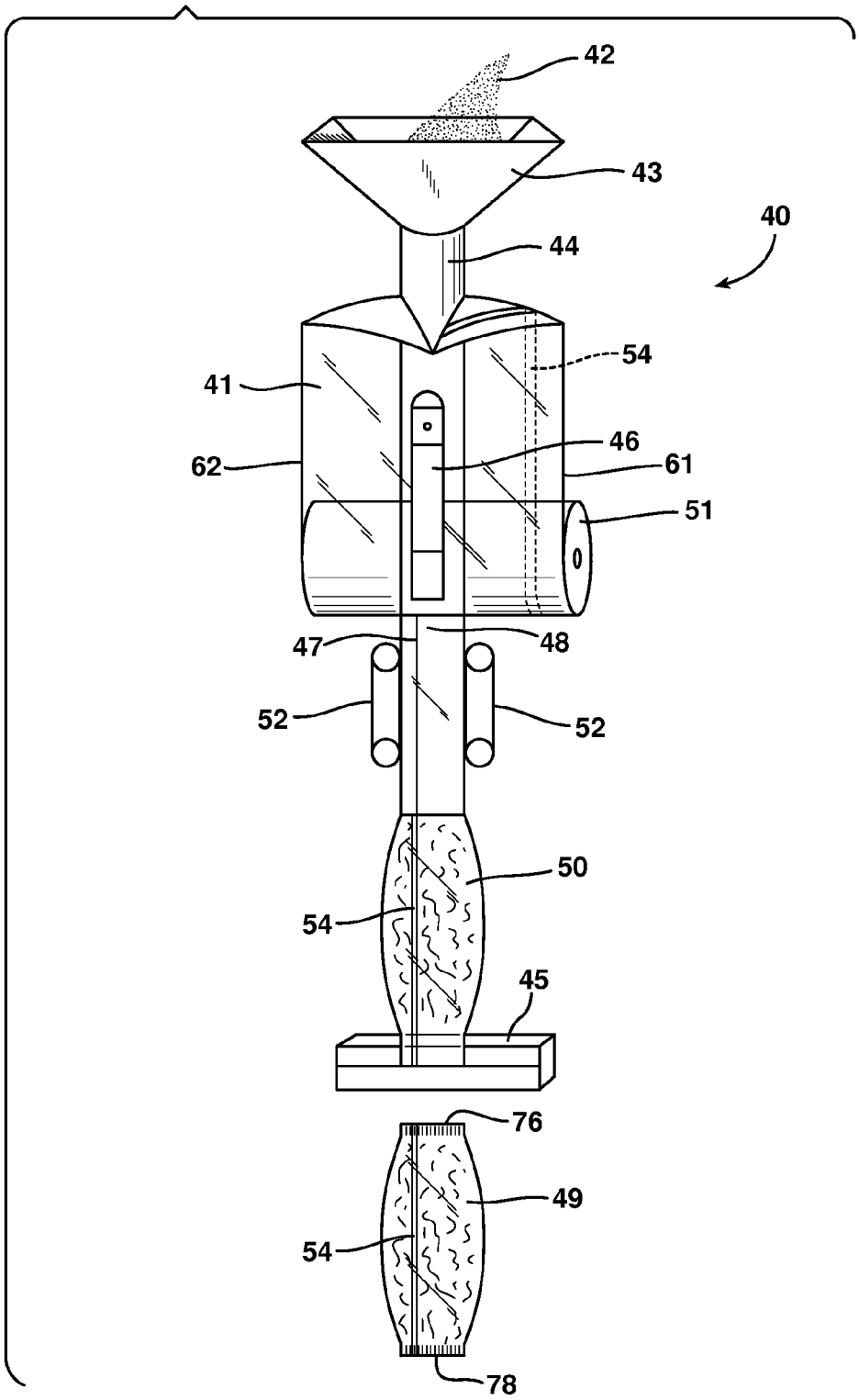
FIG. 11 an elevational view of a VFFS process and apparatus for making a package according to another embodiment.

Lay-flat web 41 of FIGS. 10 and 11 will in operation travel vertically upward from roll 51 to the forming tube 44, and then vertically downward for the remaining process steps. Discrete tape 54 is unwound from roll 53 (FIG. 12) to dispose tape 54 onto web 41 before, or as, web 41 is wrapped about forming tube 44, such that tape 54 is trapped between inner surfaces of the web 41 in the region near and spaced apart from where the longitudinal seal 47 is to be made. Fin seal 47 is made, and tape 54 is sealed to the inner surface of the formed web. As with the HFFS process, a coat of PSA will cover a first portion of tape 54.

Figure 12:
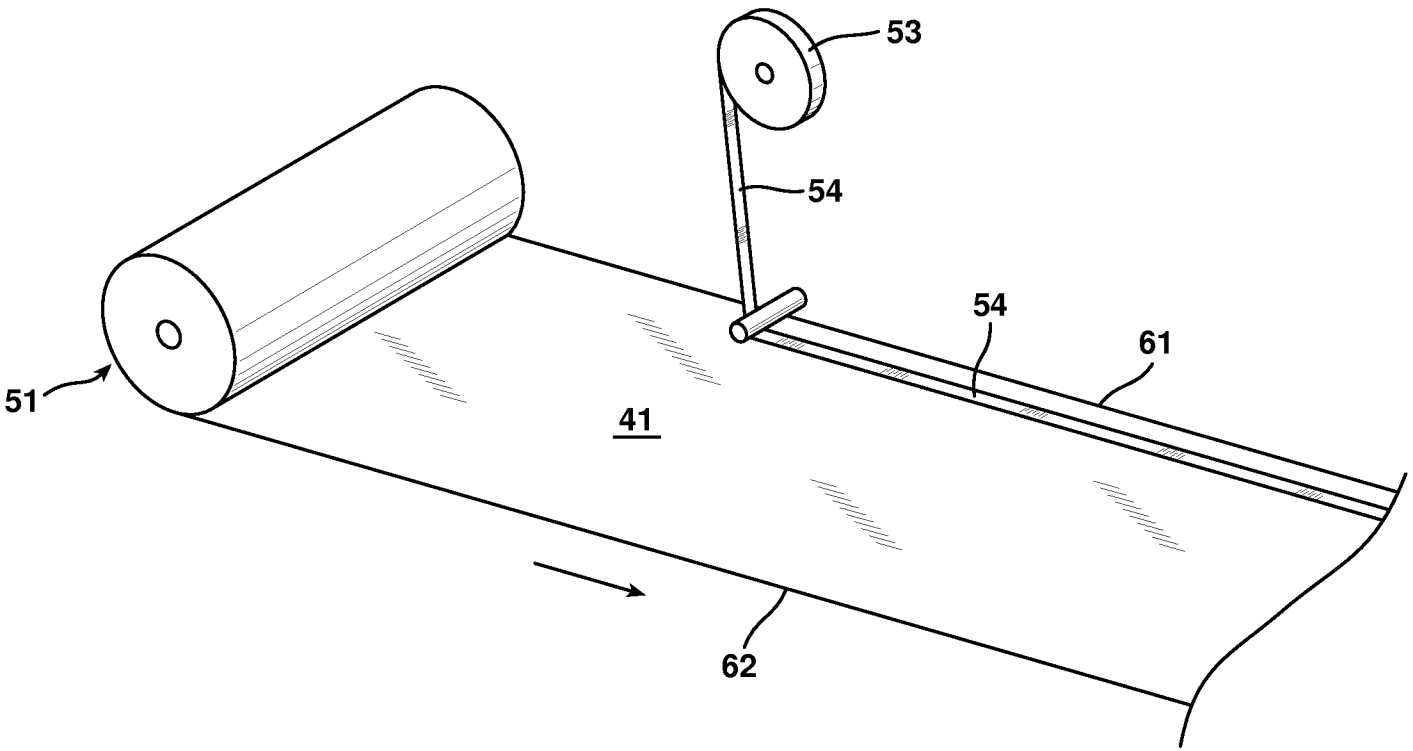
FIG. 12 is a perspective view of a roll of lay-flat film and a discrete tape.

FIG. 12 discloses the roll 51 of lay-flat web 41 according to one embodiment of the invention. Tape 54 is fed from roll 53 onto lay-flat web 41, the tape 54 disposed on web 41 near and spaced apart from, and parallel to, first or second longitudinal edges 61 or 62 of lay-flat web 41.

Figure 13:
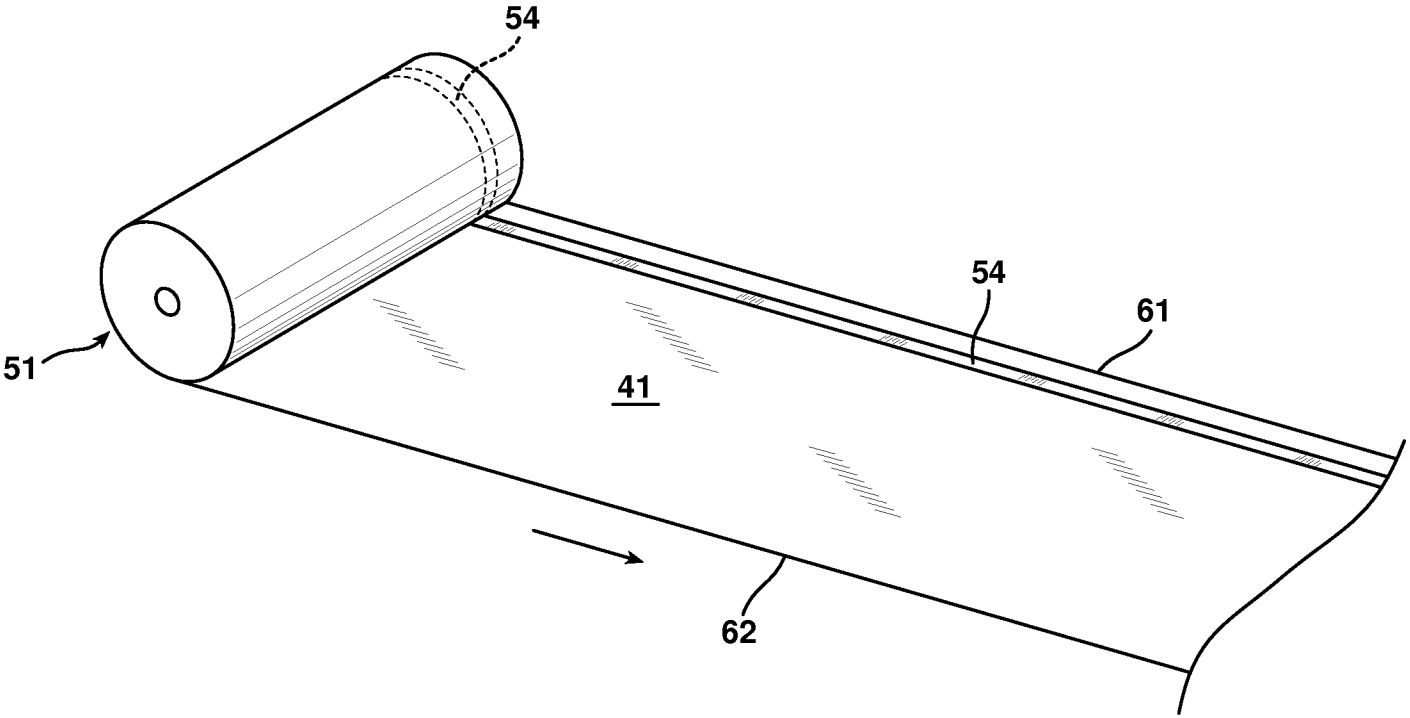
FIG. 13 is a perspective view of a roll of lay-flat film and a discrete tape according to another embodiment.

Alternatively, and referring to FIGS. 11 and 13, discrete tape 54 is already installed on the lay-flat web prior to the start of the VFFS packaging process. This can be accomplished off-site from the processor, e.g. by the supplier of the feed roll 51, but with the same disadvantage discussed for the embodiment of FIGS. 9A and 9B.

Alternatively (FIG. 14) discrete tape 74 is already installed on the lay-flat web prior to the start of the VFFS packaging process. This can be accomplished off-site from the processor, e.g. by the supplier of the feed roll 51. The disadvantage associated with the embodiments of FIGS. 9 and 13 can be avoided or minimized by spacing the consecutive tapes 74 such that they are staggered as installed in winds on the roll 51, so that they are installed on the roll in a manner that avoids or minimizes roll asymmetry. The tapes 74 of FIG. 14 are disposed on the web 41 spaced apart from, and perpendicular to, the first and second longitudinal edge 61 and 62.

Figure 14:
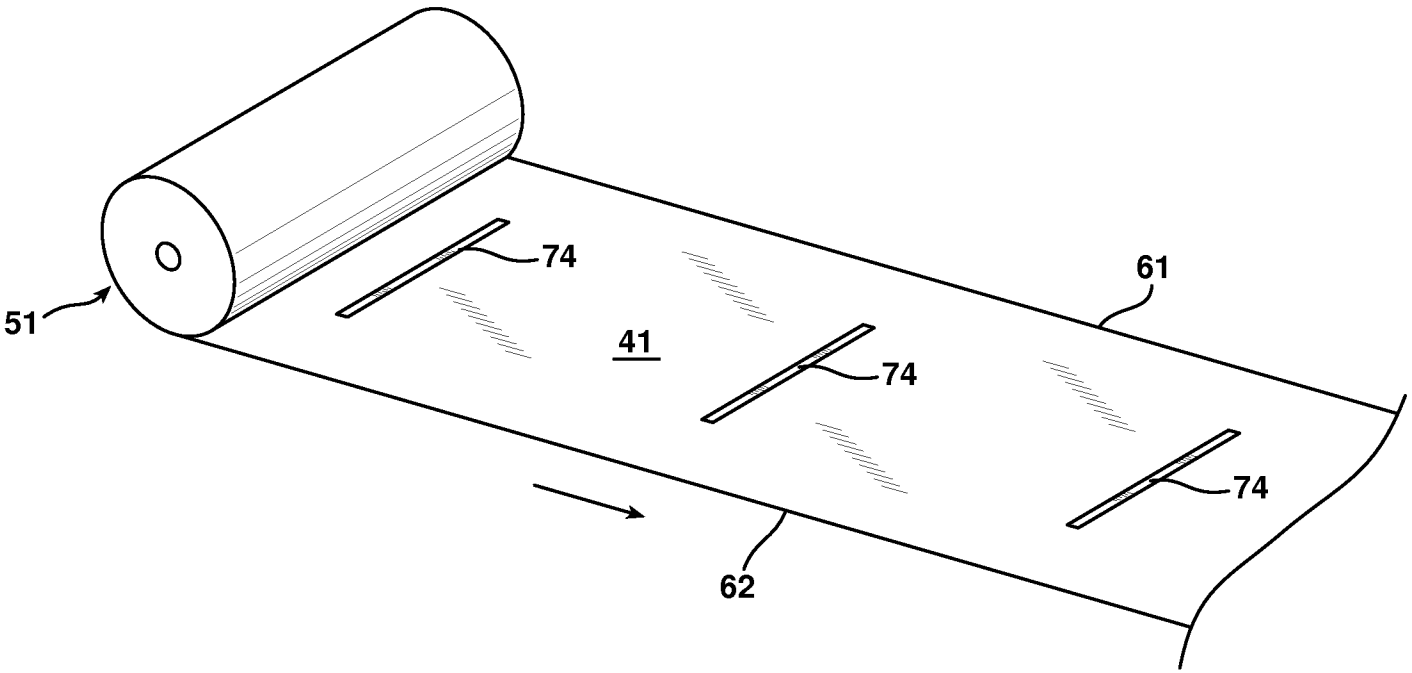
FIG. 14 is a perspective of a roll of lay-flat film and a discrete tape according to yet another embodiment.

In some embodiments, e.g. FIG. 14, at least one of the web and the discrete tape carries a registration device. Printed indicia can be in the form of registration marks, such as eye-spots. Those skilled in the art will be familiar with the use of eye-spots and registration marks in processing web material in packaging operations. Registration marks are printed in uniformly spaced fashion along or near an edge of the web or tape, and facilitate the controlled production of packages of the invention, and can be printed in conjunction with other decorative printing.

Figure 16:
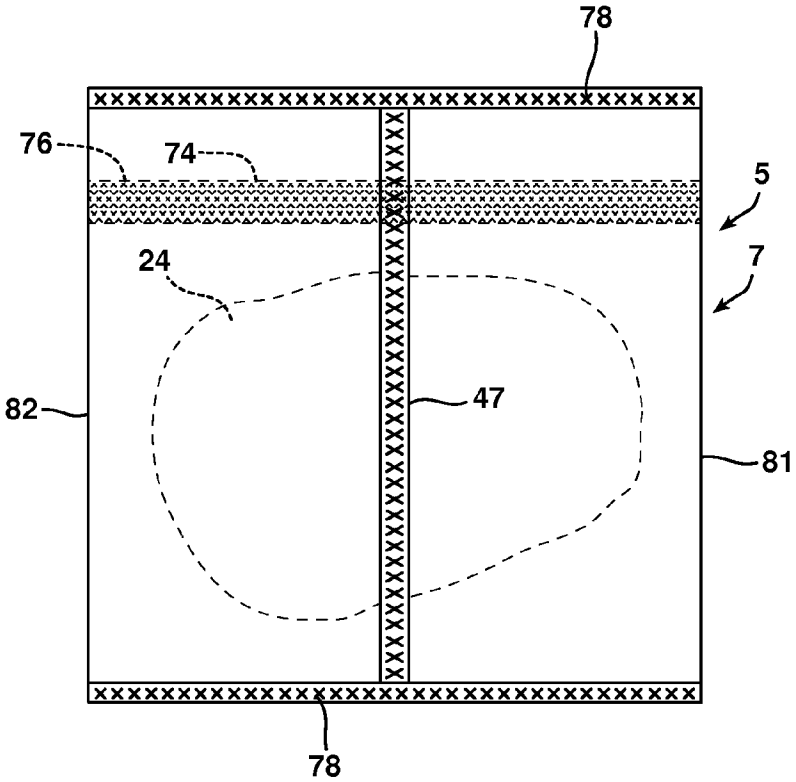
FIG. 16 is a back view of the package of FIG. 15.
Figure 15:
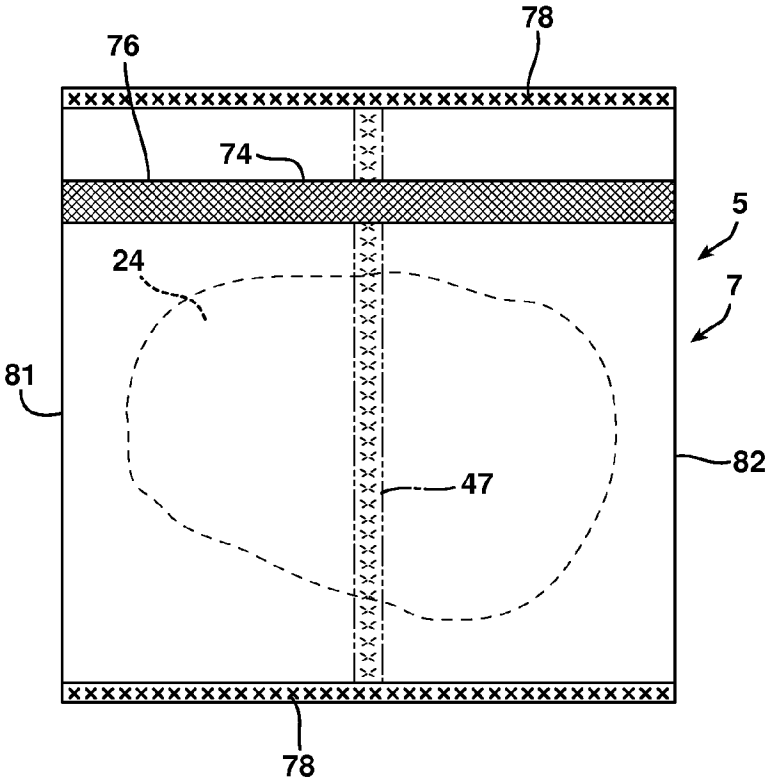
FIG. 15 is a front view of an alternative embodiment of the package.

FIG. 15 shows a front view of a VFFS package 5 made according to the embodiment of FIG. 14, and including a pouch 7 comprising first and second transverse seals 78, folded side edges 81 and 82, discrete tape 74, longitudinal seal 47; and product 24. Tape 74 is anchored to the interior surface of the first side panel of the pouch in region "A" (see FIGS. 2A and 2B) and optionally region "D" (FIG. 2B), and optionally the second side panel of the pouch. FIG. 16 shows a back view of package 5.

Figure 17:
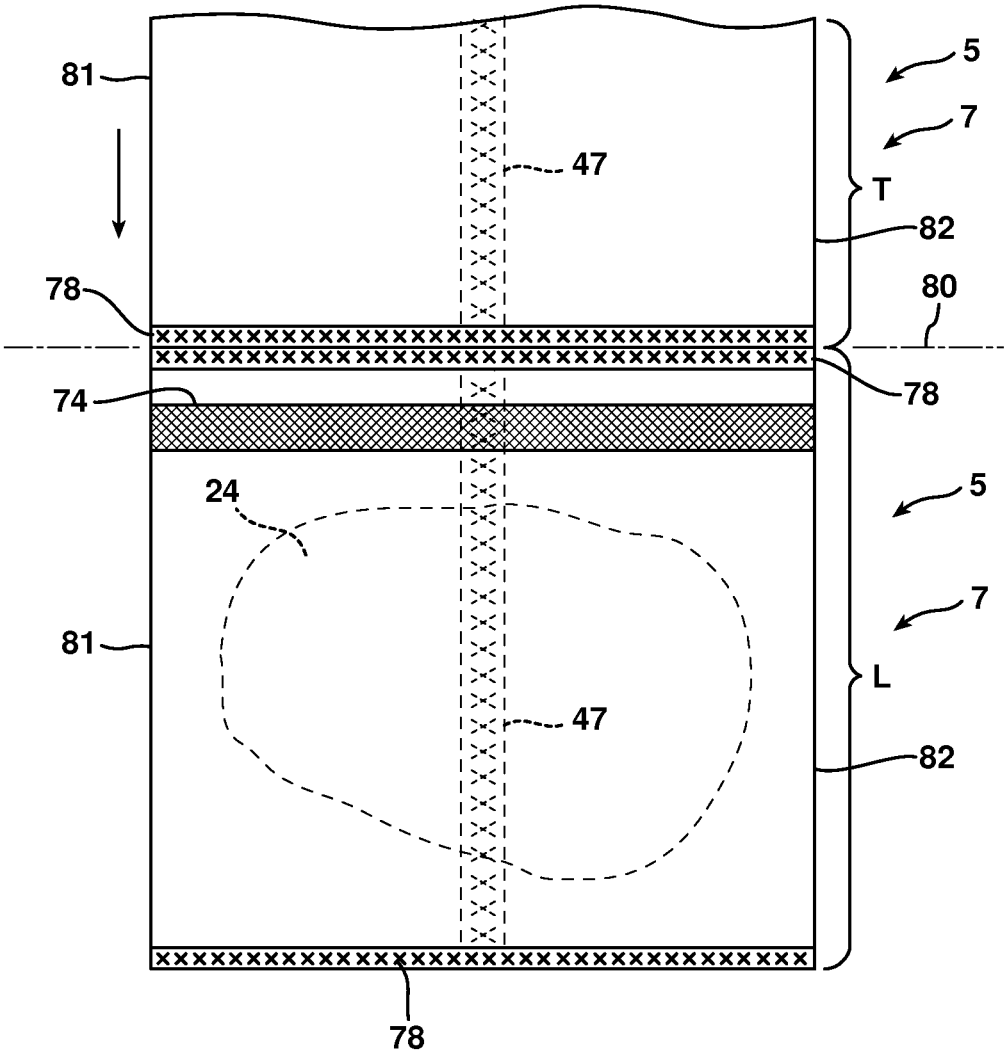
FIG. 17 is an elevational view of two consecutive pouches in a VFFS embodiment.
Figure 18:
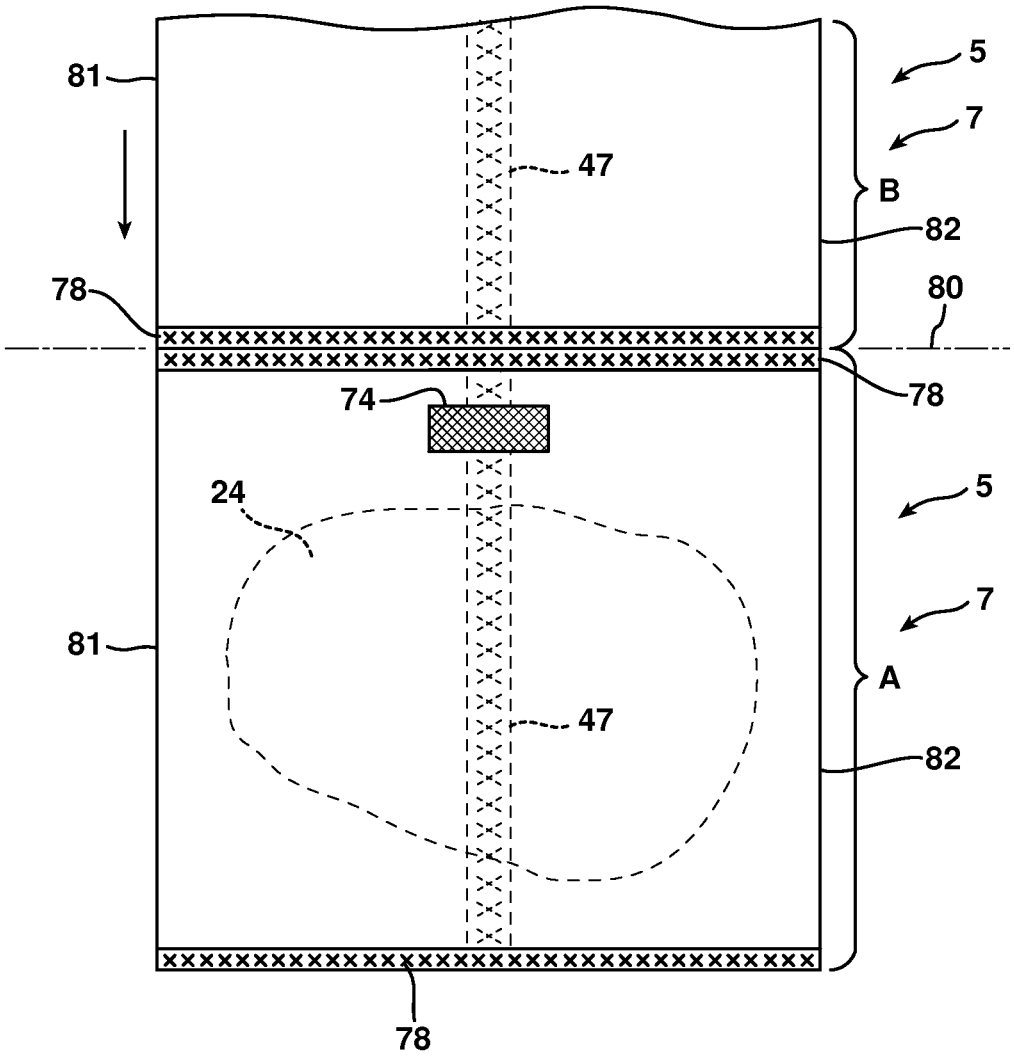
FIG. 18 is a front view of another alternative embodiment of the package.
Figure 19:
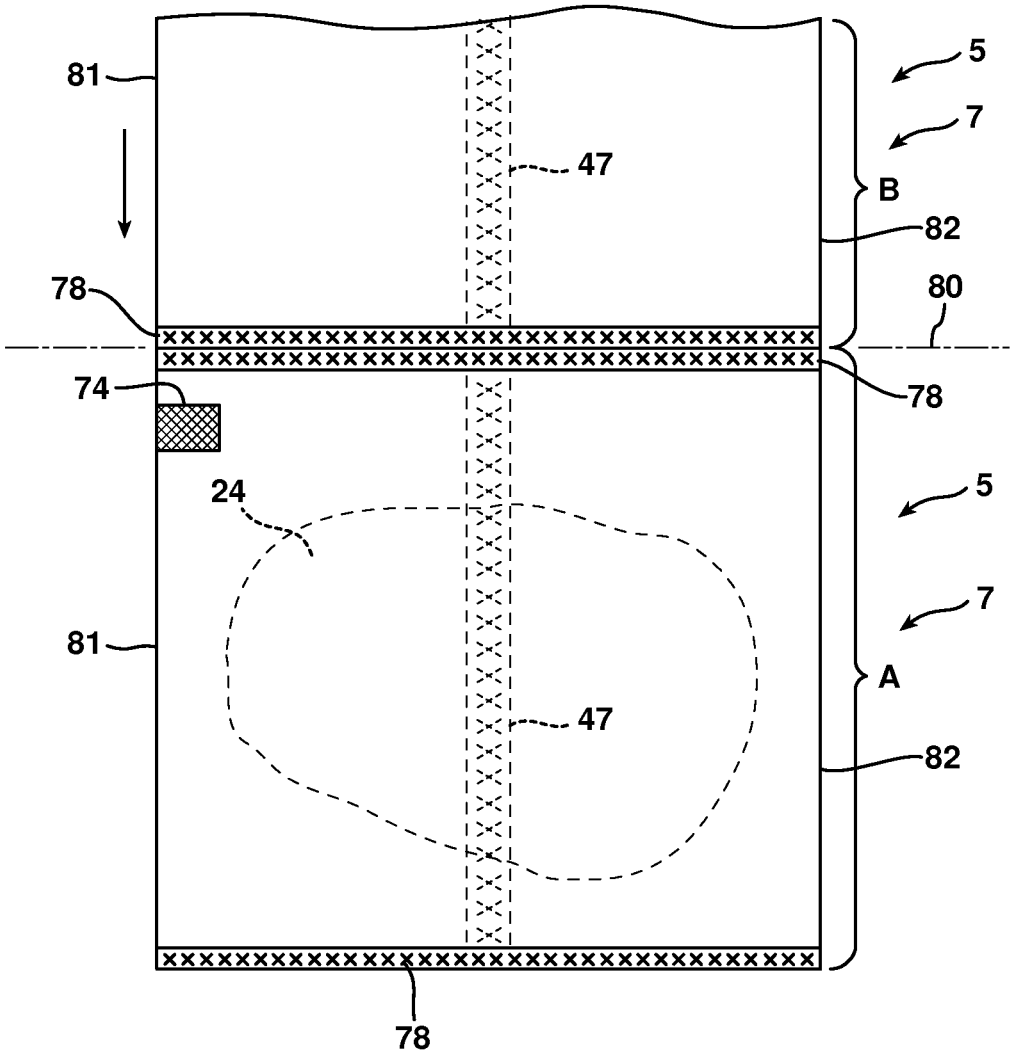
FIG. 19 is a front view of another alternative embodiment of the package.

Discrete tape 74 can extend entirely across the transverse width of pouch 7 (FIGS. 15 to 17) or across selected segments of the pouch (FIGS. 18 and 19). In FIG. 17, a leading or downstream pouch "L" includes a transverse bottom and top seals 78, folded side edges 81 and 82, tape 74, and longitudinal seal 47. Trailing or upstream pouch "T" has features similar to leading pouch "L". Leading pouch "L" is severed from upstream pouch "T" at cut line 80, and the seals 78, as well as the anchor 38 (see FIG. 30A) that anchors discrete tape 74 to the inner surface of the first side panel of the pouch in region "A", are made by suitable sealing equipment commonly used in VFFS packaging processes, such as heat sealing equipment, or anchoring equipment, not shown.

For the sake of clarity, die cuts 21 and optionally 36, present in lay-flat web 41 and the first side panel of the package, are not shown in all of the drawings, e.g. in FIGS. 3, 4, and 12 through 21B.

In embodiments where tape 74 extends across only selected segments of the pouch, easy-open access to the package (the ability to manually open the package under normal conditions) will be roughly proportionate to that part of the package occupied by the tape. Thus, In FIG. 18, tape 74 is relatively small, and centrally located within the region of seal 78. This embodiment provides easy-open access to pouch L through a relatively narrow opening defined by tape 74. In FIG. 19, a very small generally square shaped tape permits only a small easy-open access opening, functioning effectively as a pour spout. In these embodiments, the lateral extent of die cuts 21 and 36 can be proportionately small.

Figure 20:
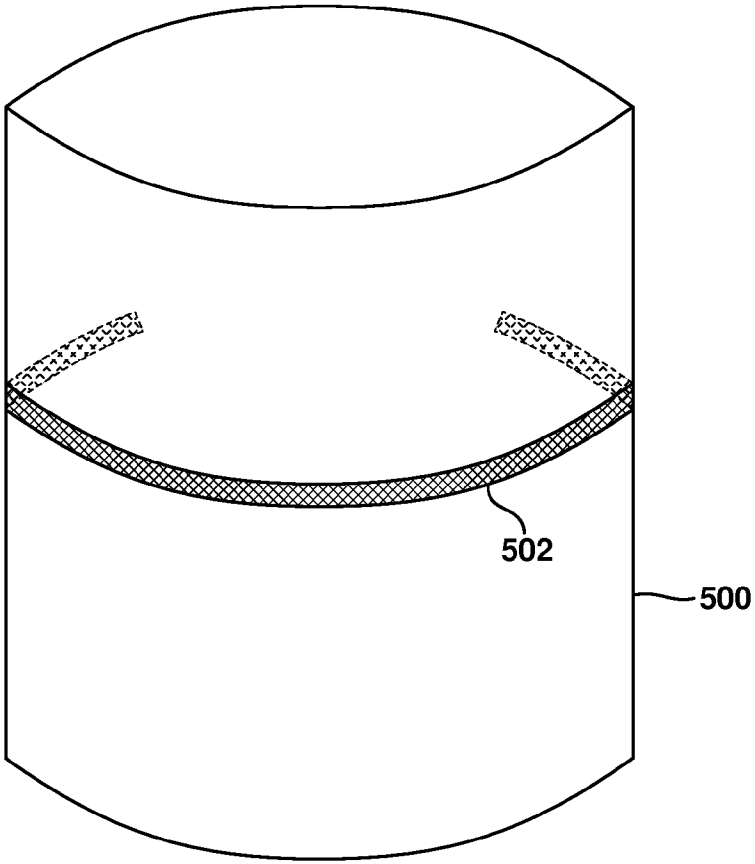
FIG. 20 is a perspective view of a folded web for use in the invention.
Figure 21B:
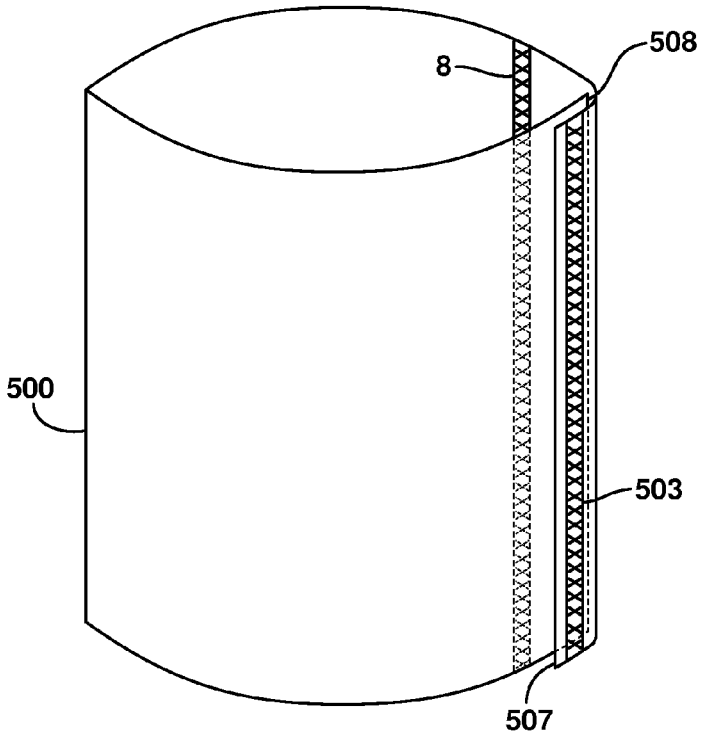
FIG. 21B is a perspective view of a folded web for use in the invention.

FIG. 20 shows folded web 500 in an embodiment in which discrete tape 502 spans one entire side panel, as well as a portion of the other side panel of the folded web. Thus, the discrete tape of the invention can occupy one side panel of a package, and part of a second side panel of the package.

Figure 21A:
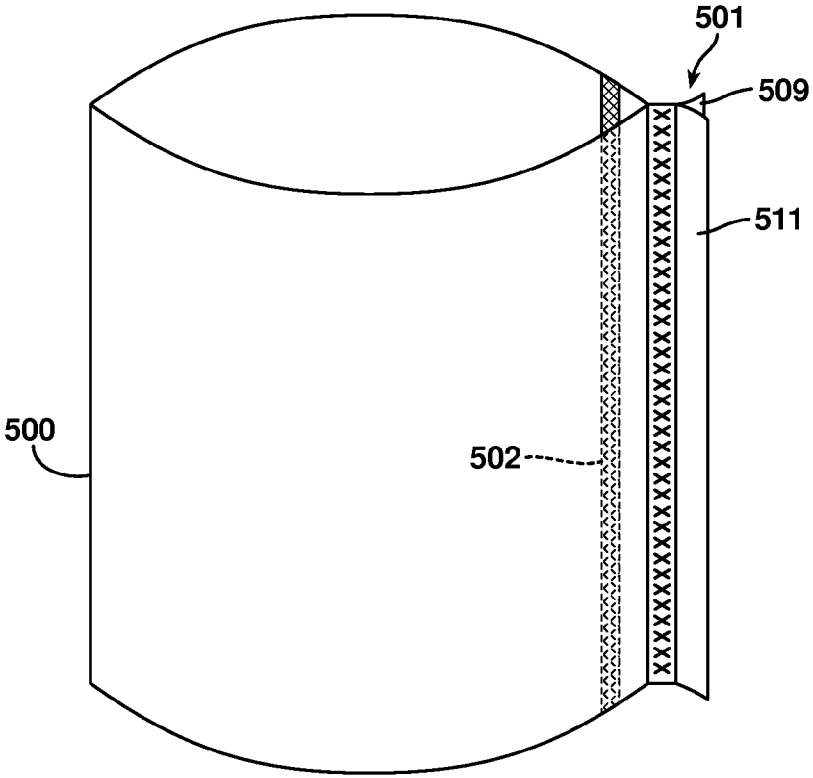
FIG. 21A is a perspective view of a folded web for use in the invention.

FIG. 21A shows folded web 500 in which the discrete tape 502 is sealed to a longitudinal portion of the folded web, and is positioned near and spaced apart from fin seal 501, formed as disclosed hereinabove. A finished package made according to FIG. 21A will thus look like the packages of FIGS. 3 and 4, when these are viewed at right angles to their position in FIGS. 3 and 4, i.e. with the strip 10 of tape 8 to the right side of each package, and the second end 34 representing a fold. The embodiment of FIG. 21A thus provides a method of producing packages on a VFFS apparatus where the longitudinal seal of the package effectively becomes the first end of the finished package (discounting any unsealed material between the longitudinal seal and the top edge of the package). The apparatus and methodology of U.S. Pat. No. 6,293,073 (Caudle) this patent incorporated herein by reference in its entirety, can be utilized in combination with the teachings herein, to produce packages according to this embodiment. A point of distinction is that in the present invention, the transverse seals will typically (although not necessarily) be rectilinear, whereas the transverse seals disclosed in Caudle '073 are wavy or sinusoidal.

Figure 31:
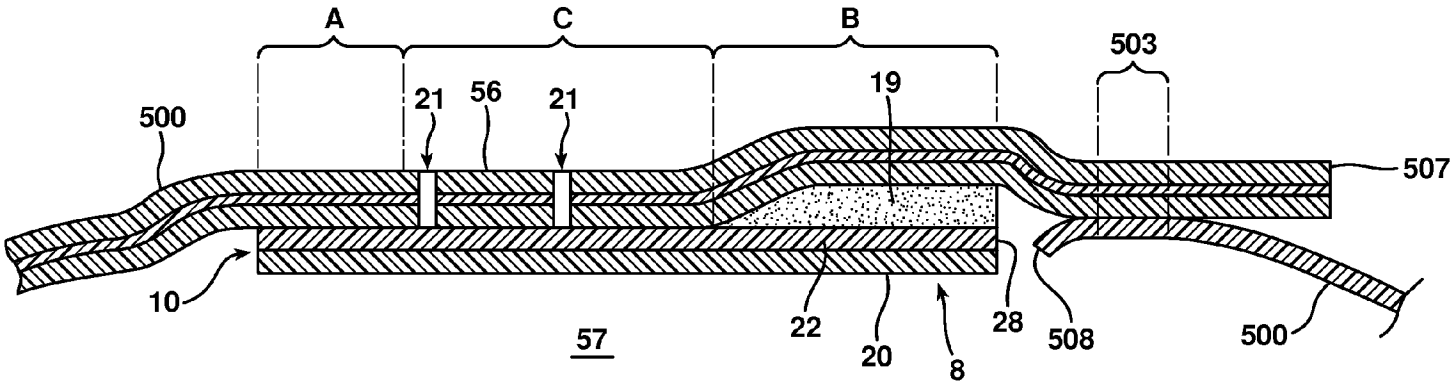
FIG. 31 is a cross sectional view of an alternative embodiment.

Alternatively (FIG. 21B), a package like the embodiment of FIG. 21A is shown, but where a lap seal 503 is shown, similar to the lap seal 503 of FIG. 31 (see below) wherein discrete tape 8 is sealed to a longitudinal portion of the folded web, near a first longitudinal edge 507 of the folded web, and is positioned near and spaced apart from lap seal 503 of the folded web, formed as disclosed hereinabove. In this as well as the other processes disclosed herein, a lap seal can be used in lieu of a fin seal when making a longitudinal seal according to the invention. A finished package 5 according to FIG. 21B has a product therein; the two longitudinal ends of the package are closed by a transverse seal; the lap seal runs down the middle or spine of the package, the package bounded on both ends by the transverse seals; and a discrete tape is anchored to an interior surface of the folded web.

At any time during the method of making the package in an VFFS process, a second portion of the first surface of the base strip is anchored to the lay-flat web, the folded web, or the inner surface of the first side panel. This can be done on the lay-flat web prior to supplying the web to the processor, or prior to or as the lay-flat web is advanced over a forming device, or before or after a product is put in a pouch.

C. Lidstock/Formed Web

Figure 22:
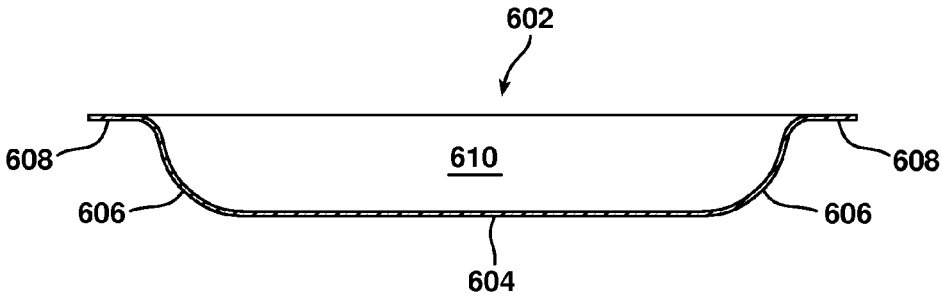
FIG. 22 is a side view of a tray for use in connection with the invention.
Figure 23A:
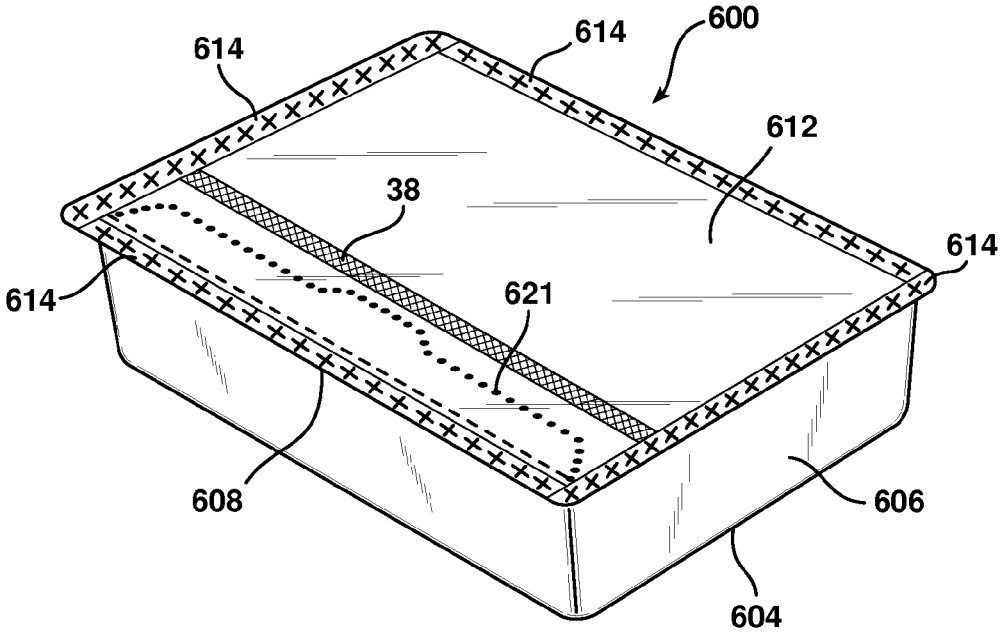
FIG. 23A is a perspective view of a package.
Figure 23B:
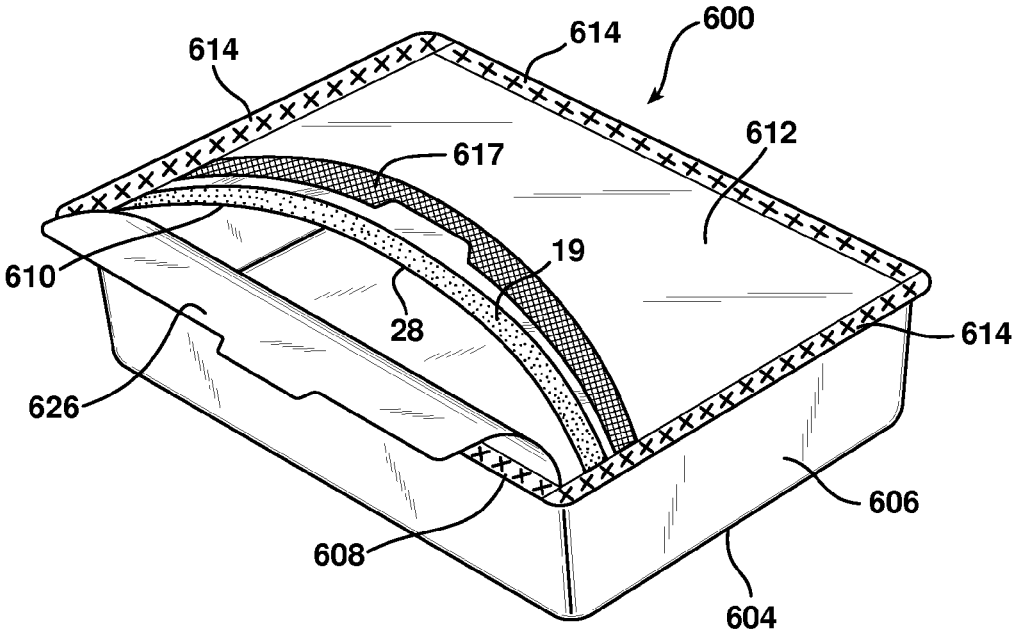
FIG. 23B is a perspective view of the package of FIG. 23A in an opened condition.

FIGS. 22, 23A, and 23B illustrate in another embodiment the use of a formed web, e.g. a tray, and a non-formed web, e.g. a lidstock, used in connection with the invention. Tray 602 will typically be made during the packaging process. Thermoforming equipment, available from e.g. Multivac, Tiromat, Ulma or Rapid Pak, is used to convert flat thermoplastic forming web into formed pockets to create trays for containing product such as food, various industrial and consumer items and sterile medical products. Trays are formed from a lower web by heat and pressure, and can be loaded with product manually or automatically on the machine. After that, the packages are vacuumized or backflushed with modified atmosphere (if required), hermetically sealed to an upper web, separated, and removed for distribution or storage. Alternatively, pre-formed trays can be used.

Each tray 602 has a tray bottom 604, tray sides 606, and a tray flange 608 along its perimeter to which the lidstock 612 can be sealed by heat or other means. Tray bottom 604 and tray sides 606 define tray cavity 610. Prior to any thermoforming step, tray 602 can be of any suitable thickness, e.g. from 2 to 30 mils thick, and any suitable construction.

If a pre-made tray is used according to the invention, it can be rigid or semi-rigid, can be in the form of a flat or shaped tray, and can be made from any suitable material, including solid or expanded embodiments, such as PP, polystyrene, polyamide, 1,4-polymethylpentene (e.g. TPX™ available from Mitsui), or crystallized polyethylene terephthalate (CPET). A tray liner can optionally be used that adheres to the surface of the pre-made tray on which the product is to be placed. This liner can be of any suitable design, and can be a multi-layer structure with at least one layer with gas-barrier properties. Such a liner can be adhered to the tray by heat lamination, extrusion lamination, extrusion coating, adhesives, corona treatment, etc. Tray 602 can be a flexible or semi-rigid, or rigid formed web.

Referring to FIGS. 23A and 23B, a package includes tray 602 to which lidstock 612 has been sealed with perimeter seal 614. Lidstock 612 is typically a lay-flat web formulated to function as a lid on a formed web, and can be any suitable monolayer or multilayer thermoplastic film as described herein with respect to webs useful in connection with the present invention. Lidstock 612 includes a discrete tape (see FIGS. 29C and 29D) of which anchor 38 and PSA layer 19 are represented in FIGS. 23A and 23B respectively. The discrete tape has an easy-open sealant on one surface thereof, and a sealant on a second surface thereof. The easy-open sealant can be present on the surface of the discrete tape that holds the PSA, or on the opposite surface of the discrete tape, or both. The tape has the easy-open characteristics and composition discussed herein with respect to the discrete tape of HFFS or VFFS packages. The tape is disposed between the lidstock and the tray flange such that the tape is trapped between and sealed to the lidstock and tray flange. The first side panel at die cut 621 (see also FIG. 30A) can be pulled back manually toward the end of the package, along hinge line 58, and the first side panel is grasped in the area of the tape below PSA layer 19 so that the package is easily opened and product can be removed as desired. After removing the product, the package can be reclosed by bringing flap 626 back down on PSA layer 19. In FIG. 23B, 617 is a part of lidstock 612, shadowed by the discrete tape, that remains attached to tray 602 when the flap 626 is pulled back to open the package.

Figure 24:
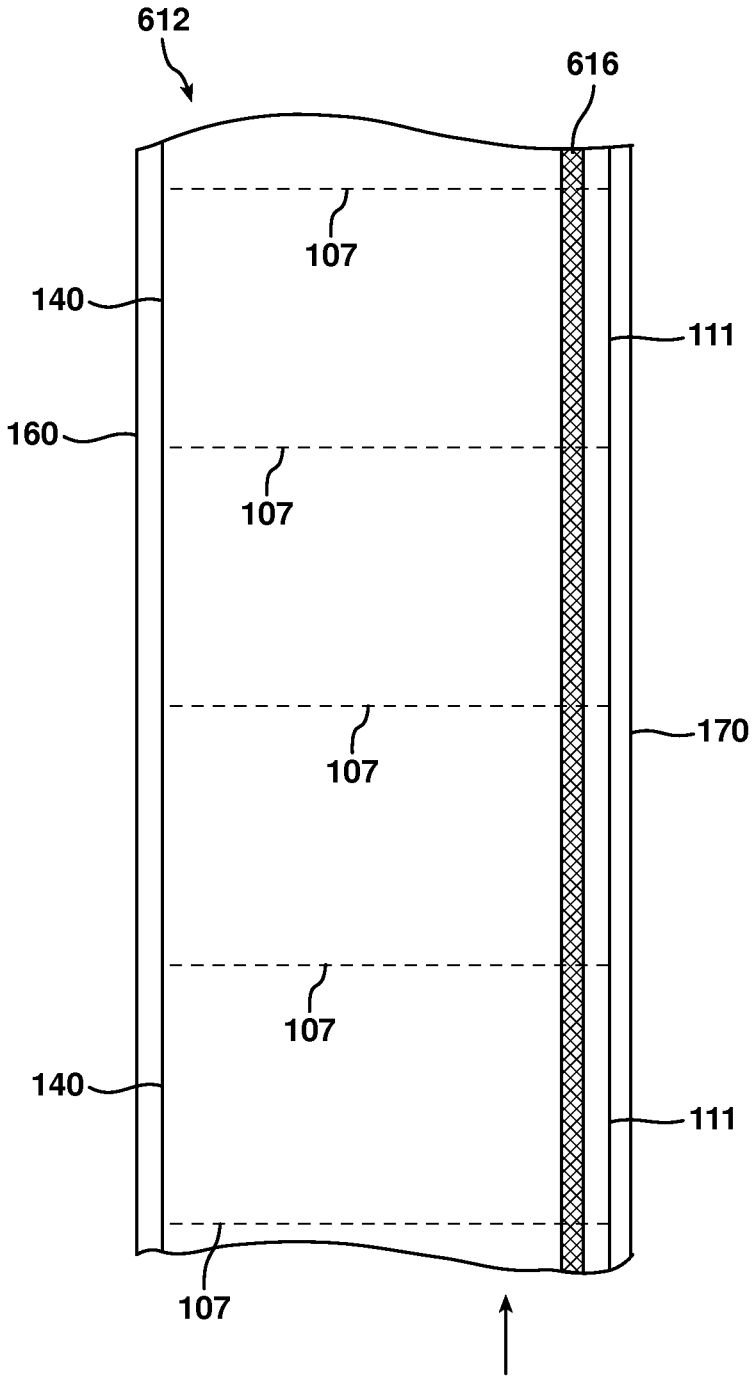
FIG. 24 is a plan view of a lidstock.

Referring to FIG. 24, dotted lines 107 indicate the location at which lidstock 612 is sealed and cut, e.g. perimeter heat sealed and cut, in registered fashion by otherwise conventional means as discussed herein, e.g. in thermoforming equipment, to create individual packages. Lines 107 represent what will become the side edges and seals of individual packages when lidstock 612 is advanced into a packaging system where it is progressively fed over filled trays, sealed to the trays, and cut to create finished packages. Lines 111 and 140 represent what will become the first and second end respectively of individual packages. Lidstock 612, as rolled up, and as it feeds into thermoforming equipment, has a second lateral edge 160 and first lateral edge 170. During the sealing and cutting operation to make individual, filled packages, the web will be cut such that the lidstock material between lines 170 and 111, and between lines 160 and 140, will be removed as scrap.

FIG. 24 shows tape 616 disposed on lidstock 612 near, parallel to, and spaced apart from, line 111. Tape 616 can be preinstalled on lidstock 612 by the supplier of the lidstock, as in the embodiments of FIGS. 9A and 9B, 11 and 13. Alternatively, tape 616 can be installed on the lidstock during the packaging process, as in the embodiments of FIGS. 8A and 8B, 10, and 12.

Figure 25A:
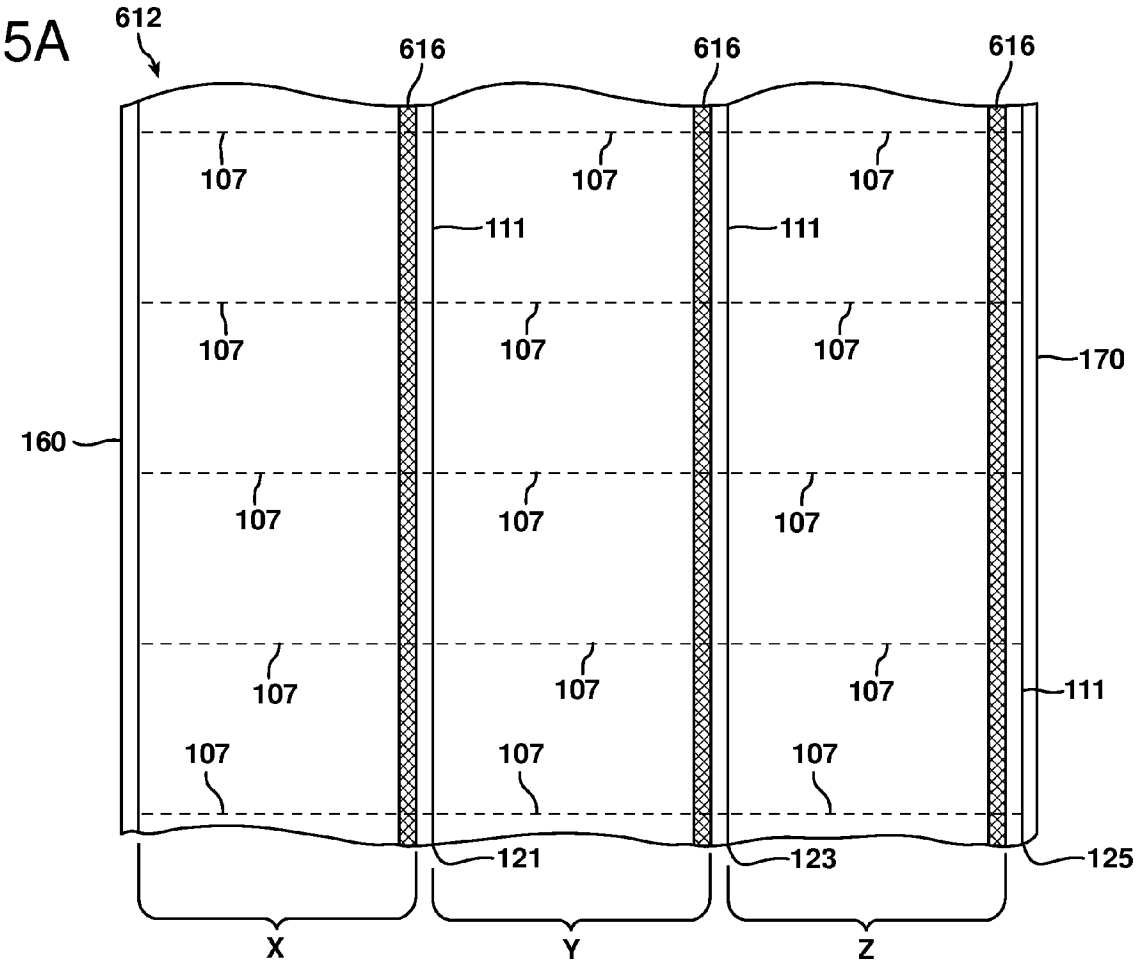
FIG. 25A is a plan view of a lidstock according to another embodiment.
Figure 25B:
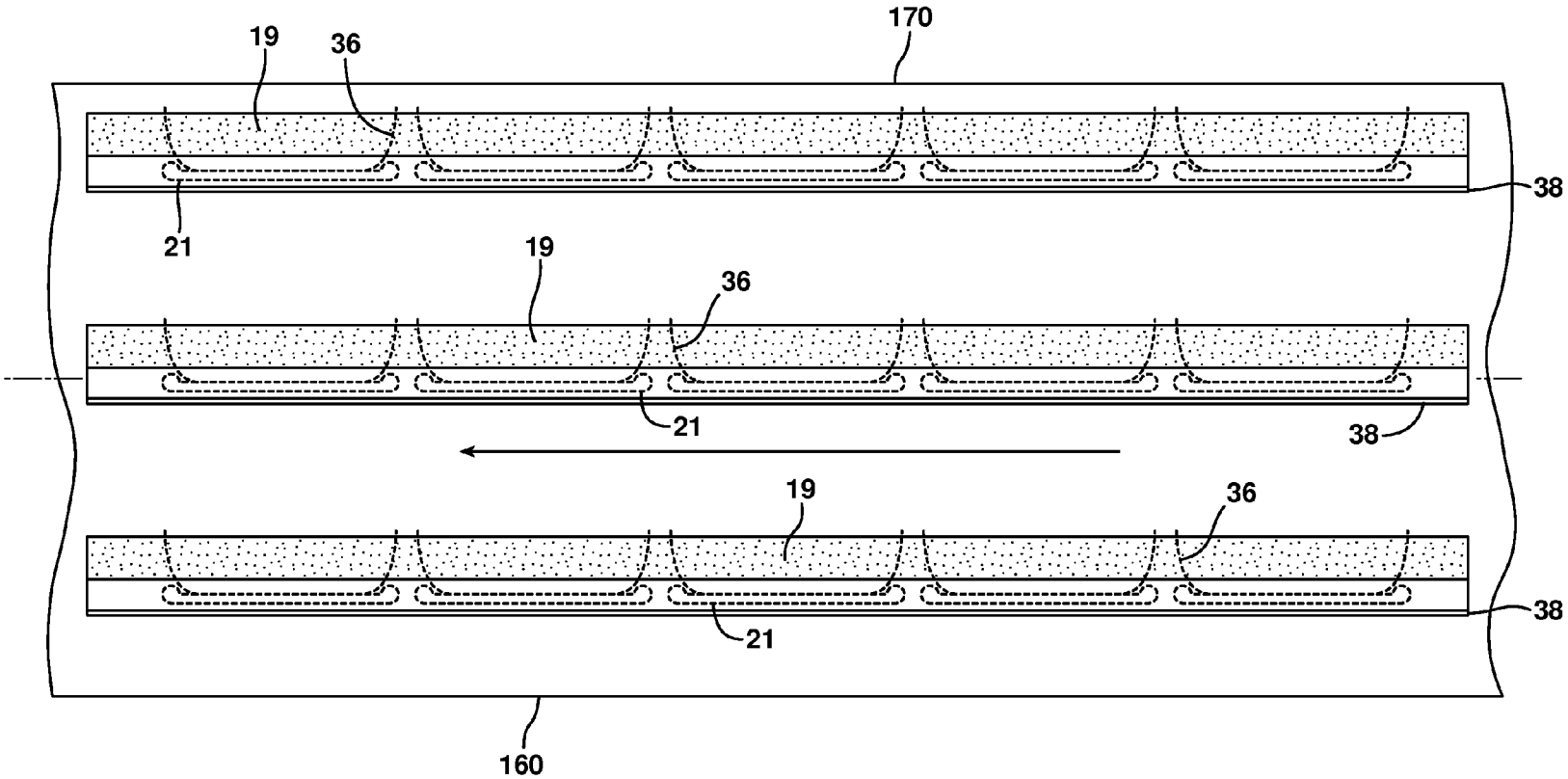
FIG. 25B is a plan view of a lidstock according to another embodiment.

FIG. 25A shows an alternative embodiment of FIG. 24, in which the lidstock is produced as described above, but "three across", so that when run in a packaging machine, with suitable machine die set-ups, three, six, etc. packages can be made simultaneously. In addition to the seal and cut steps at locations 107, the web is cut longitudinally along lines 121, 123, and 125 respectively, so that individual packages made from the longitudinal portion "X" of FIG. 25A will have a first end 121; individual packages made from the longitudinal portion "Y" of FIG. 25A will have a first end 123; and individual packages made from the longitudinal portion "Z" of FIG. 25A will have a first end 125. The discrete tape can instead be positioned at right angles to the direction of travel of web 612, and can be preapplied to the web, as in FIG. 14. FIG. 25B is similar to FIG. 25A, and includes die cuts 21 and 36 (see also FIG. 29A) and PSA layer 19.

At any time during the method of making the package having a formed web, a second portion of the first surface of the base strip is anchored to the lay-flat web. This can be done on the lay-flat web prior to supplying the web to the processor, or before or after sealing the lidstock to the formed web.

D. Continuous Horizontal Packaging

Figure 26:
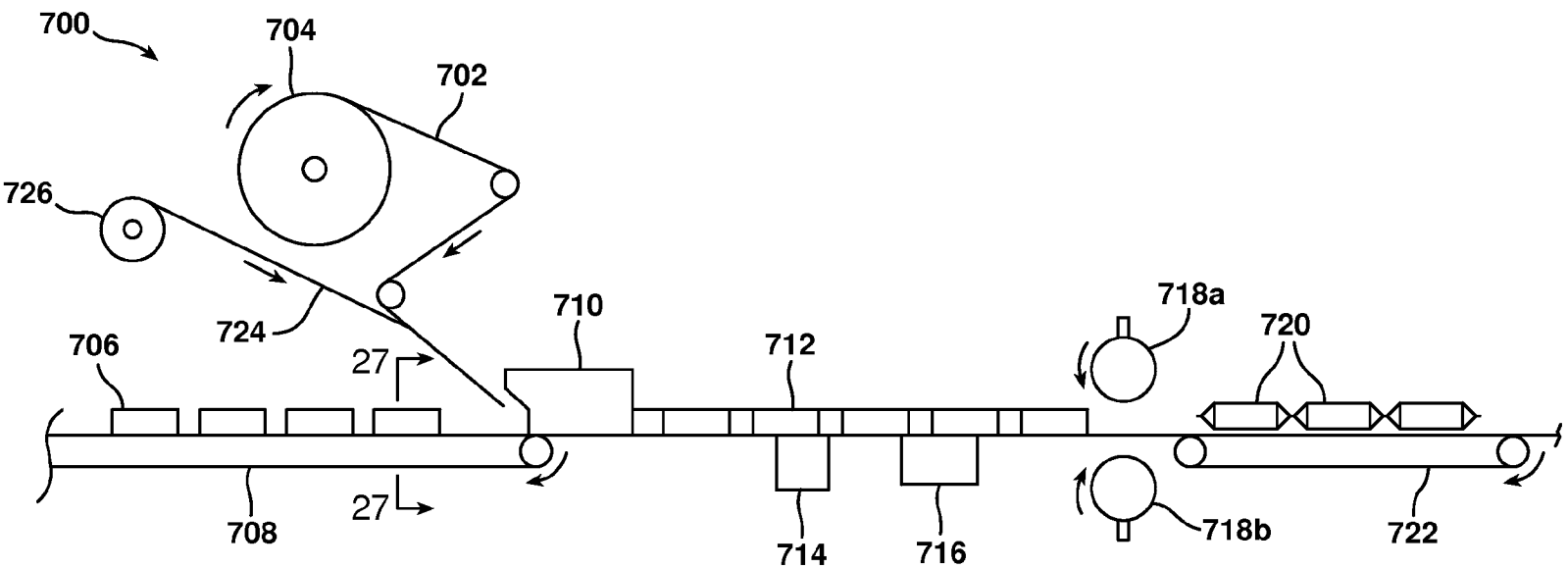
FIG. 26 is an elevational view of a continuous horizontal packaging process and apparatus for making a package.
Figure 27:
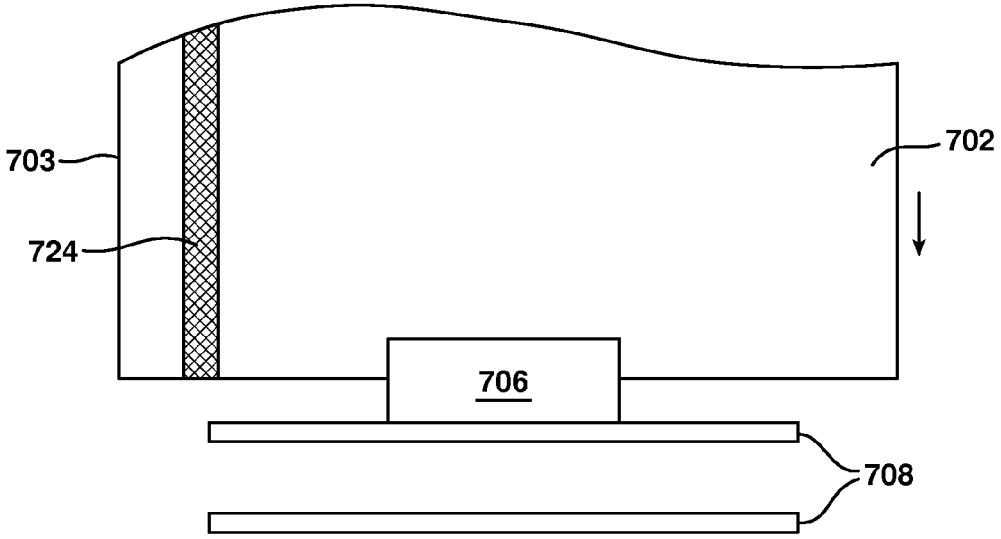
FIG. 27 a front end view of the apparatus of FIG. 26, viewed along lines 27-27 of FIG. 26.
Figure 28A:
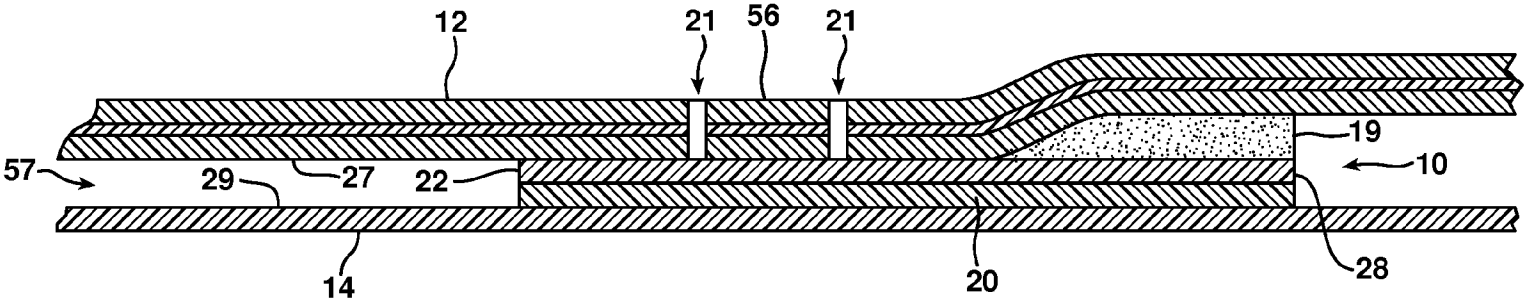
FIGS. 28A, 28B, 28C, and 28D are each cross-sectional views of a portion of the package, showing a sequence for opening the package.
Figure 28B:
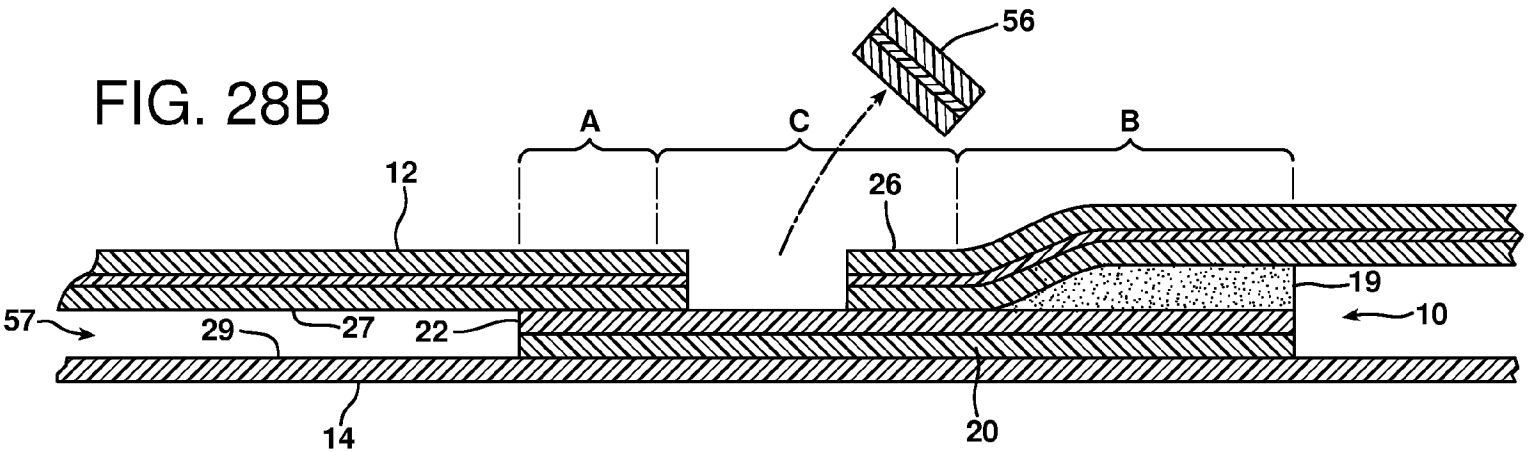
Figure 28C:
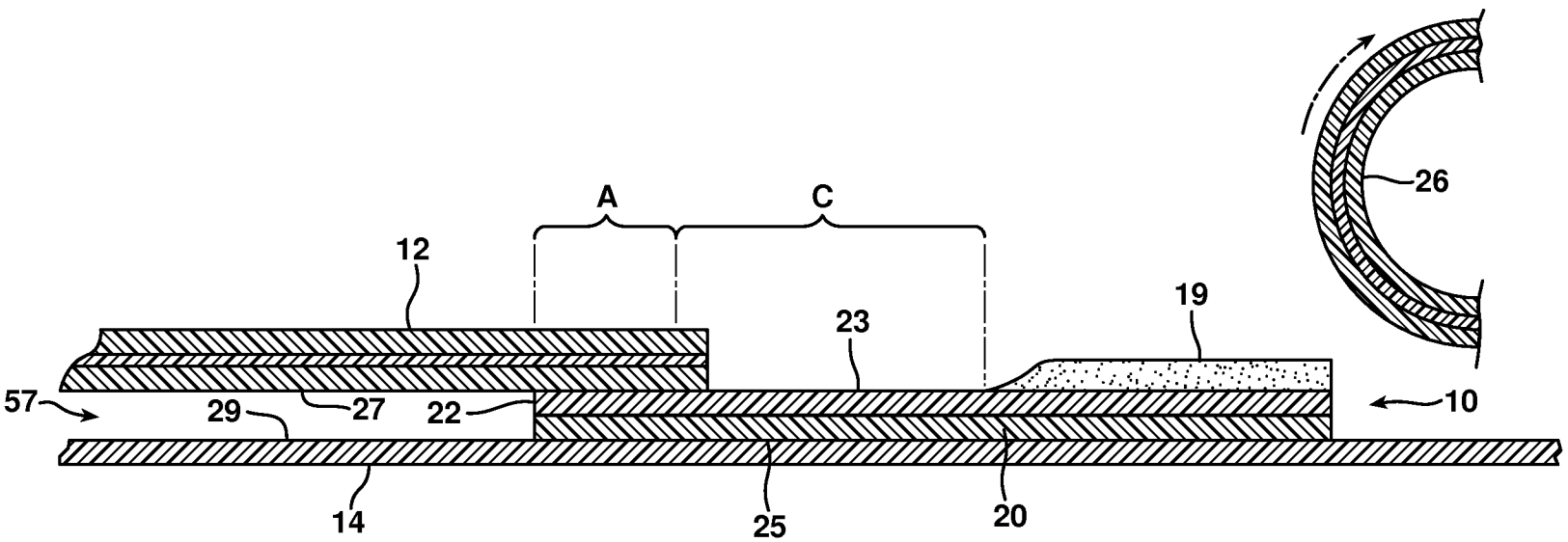
Figure 28D:
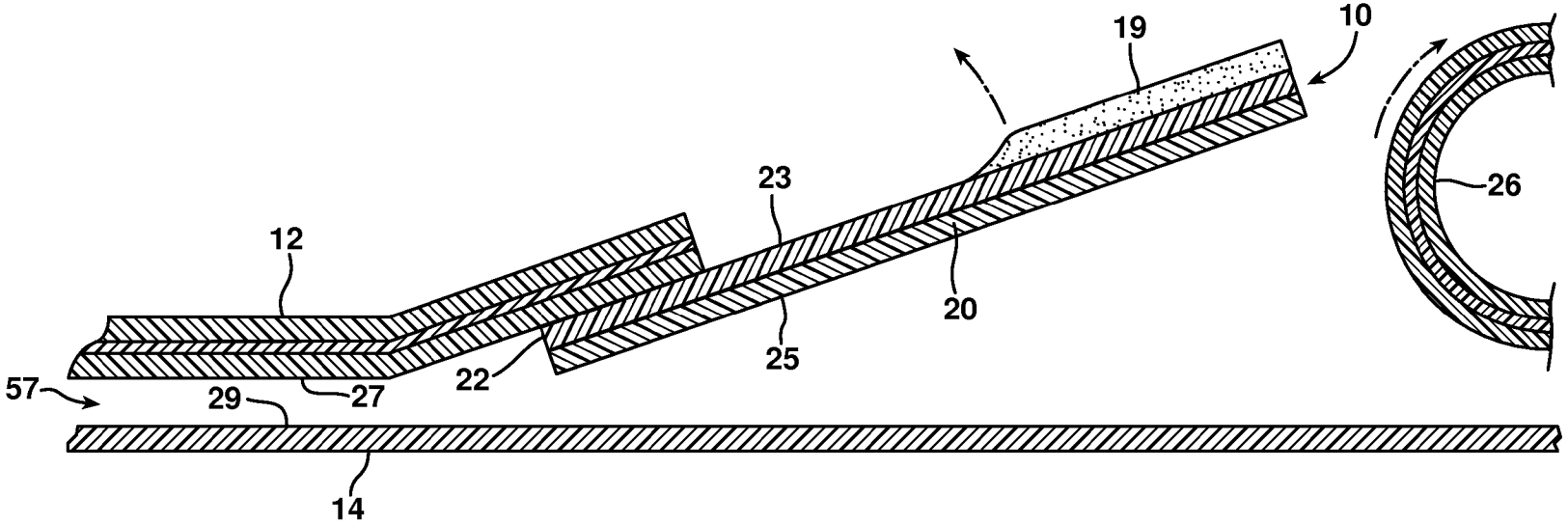
Figure 29B:
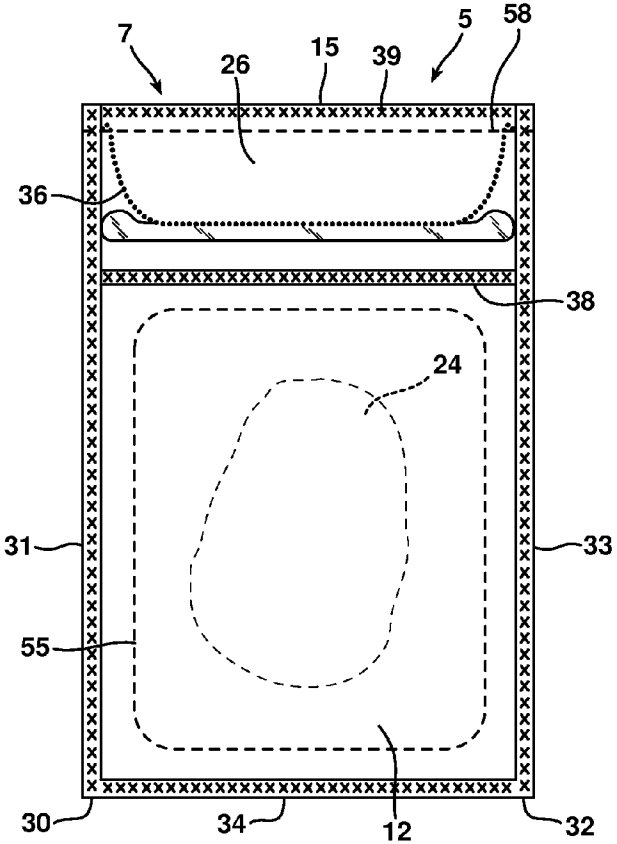
FIGS. 29A, 29B, and 29C are each plan views of the package, showing a sequence for opening the package.
Figure 29A:
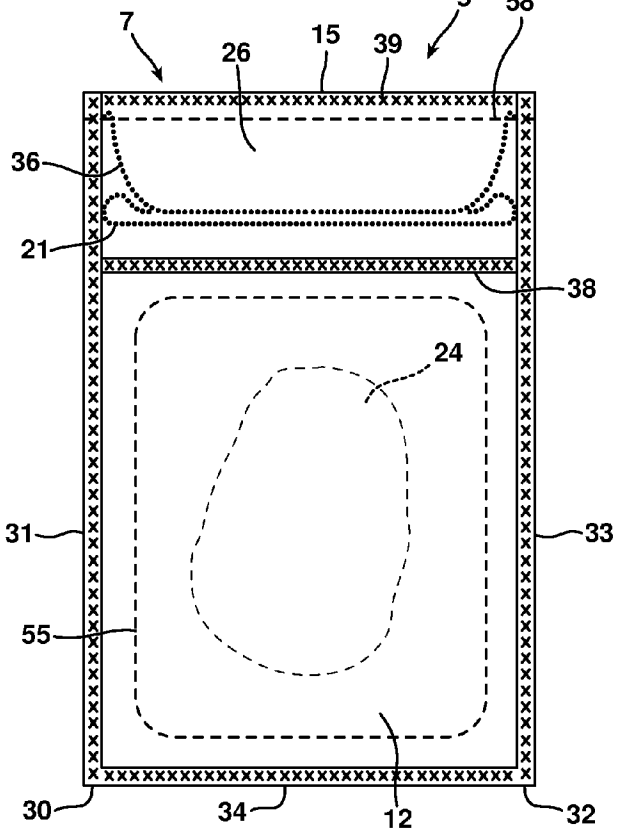
Figure 29D:
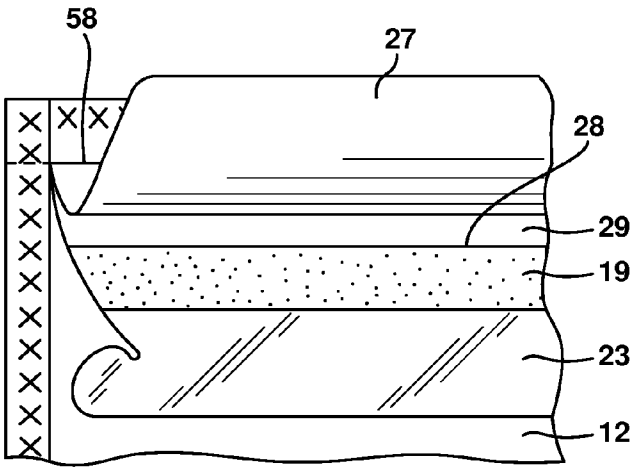
FIG. 29D is an enlarged view of a portion of the package of FIG. 29C.
Figure 29C:
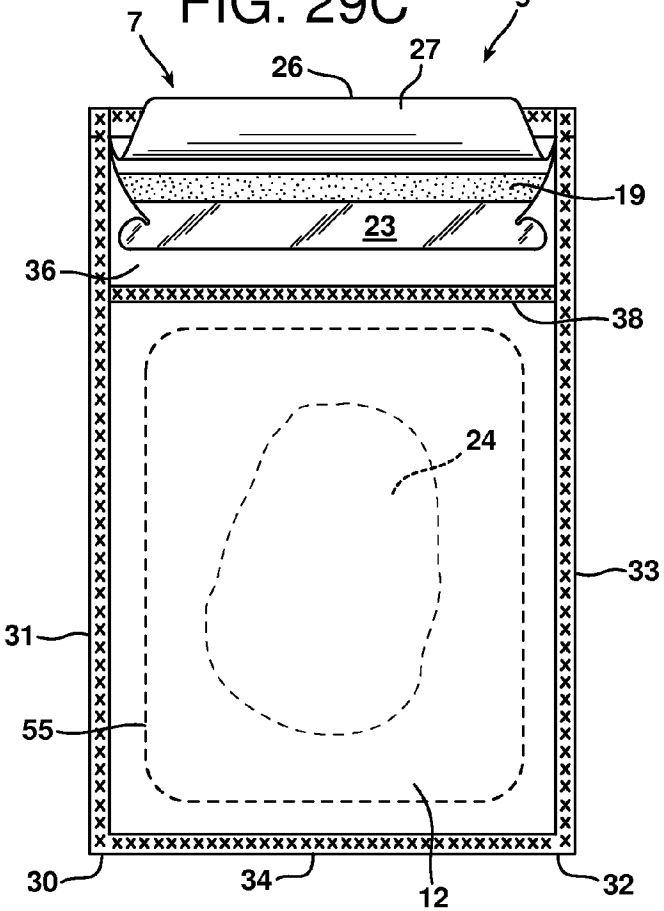

In another embodiment, and referring to FIGS. 26 and 27, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 26 shows such a process and apparatus 700, but one in which a discrete tape 724 is installed into a package. Lay-flat web 702 is drawn from roll 704 and advanced to forming device 710. As this occurs, a series of products 706 is advanced along conveyor 708 to forming device 710, and tape 724 is drawn from roll 726 and advanced to forming device 710. Web 702 is formed by forming device 710 into folded web 712. This folded web will be like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) typically at the bottom of the folded web, but can also be embodied as a fin seal along a longitudinal edge of the finished package. The lap or fin seal is typically a heat seal. An alternative is to have a separate sealing device 714 to produce the lap or fin seal. The products travel downstream from forming device 710 and sealing device 714 to transverse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced.

Alternatively, the sealing function of transverse sealing device 716 and the cutting function of cutting device 718*a* and 718*b* can be combined at a single station, rather than being performed at separate locations on the production path.

Web 702 and tape 724 can be of any suitable dimension and composition, such as those disclosed herein. As tape 724 is fed to forming device 710, it can be brought into contact with, and optionally anchored to a surface of web 702. This embodiment is shown in FIGS. 26 and 27, where tape 724 is shown as anchored parallel to, spaced apart from, and near a longitudinal edge 703 of web 702 as it progresses toward forming device 710. Alternatively, tape 724 can be fed into forming device 710, and then incorporated into folded web 712 by anchoring the tape to the interior surface of the web adjacent to the area of the formed web in which the lap or fin seal is made, and in a manner and format analogous to the embodiment of the VFFS pouch and package of FIGS. 10 and 21A and 21B, but in a horizontal rather than vertical position. In another embodiment, tape 724 can be pre-applied to web 702 by the supplier of the web, analogous to the embodiment of the VFFS pouch and package of FIG. 13, and the HFFS pouch and process of FIGS. 9A and 9B. In another embodiment, the tape can be positioned at right angles to the direction of travel of web 702, and can be preapplied to the web, as in FIG. 14. The resulting packages will in this particular embodiment be like those illustrated in FIGS. 15 and 16.

At any time during the method of making the package in a continuous horizontal packaging process, a second portion of the first surface of the base strip is anchored to the lay-flat web or the formed web. This can be done on the lay-flat web prior to supplying the web to the processor, or prior to or as the lay-flat web is advanced to a forming device, or before or after advancing a product to a forming device.

E. "Window Pane" Label

In another alternative, a laminate of the base strip, the PSA, and a release liner is made in web form. The strip/PSA/release liner is then dereeled, the liner separated from the strip/PSA while still in web form, the adhesive is deadened by conventional means, such as applying a coating over the PSA in selected areas, and curing it, then re-laminating the strip/PSA to the liner. Individual labels can then be die-cut into the desired shape in accordance with the invention, and any excess material removed. The resulting labels are provided on release liner, with adhesive in the desired areas, and can be applied by labeling equipment to a first surface of a web. A series of labels, with the PSA on each label, can thus be applied to a lay-flat web as discrete tapes, to produce a package of the invention using the various processes disclosed herein. In these embodiments, it is not required, although in some cases can be useful, to have a sealant on either surface of each discrete tape.

Figure 33A:
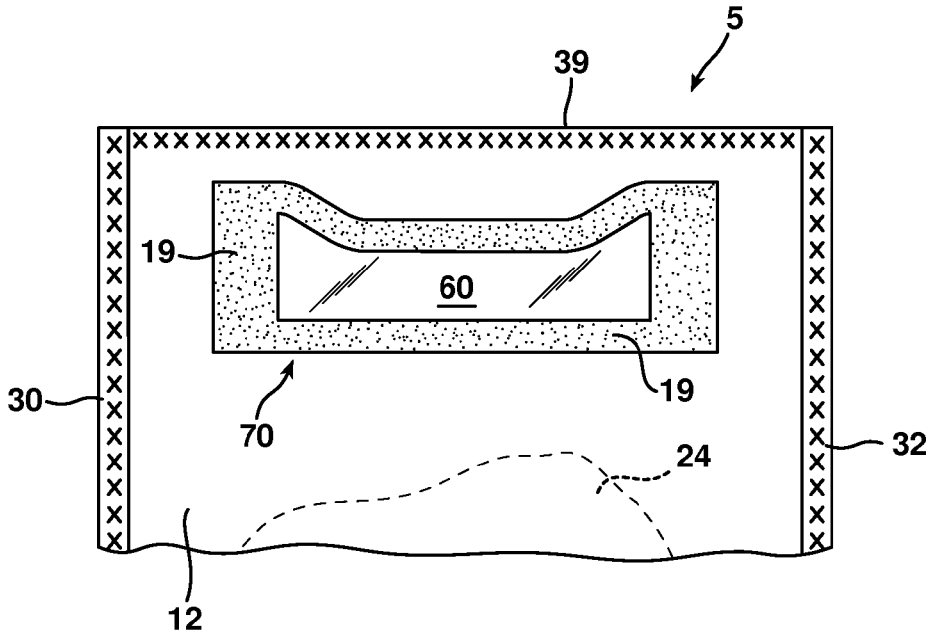
FIG. 33A is a plan view of an alternative embodiment of the invention.
Figure 33B:
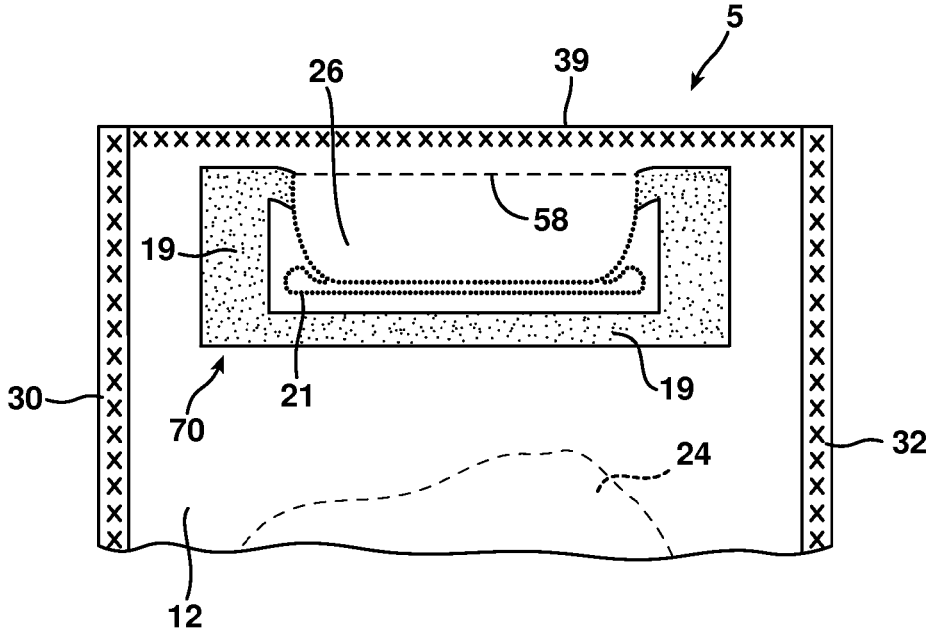
FIG. 33B is a plan view of FIG. 33A showing a framed die cut.

Thus, in any of the processes described herein, in one embodiment the die cut or die cuts on the web can be partially or completely framed by a lane of PSA on each perimeter of a discrete tape to form a label 70, with a central clear area 60 within which all or part of one or more closed-loop or open loop die cuts are present (see FIGS. 33A and 33B). In one embodiment, label 70 is spaced apart from any perimeter seals of the finished package. The central area 60 can be initially coated with PSA, along with the rest of the label, and thereafter the central area can be deadened using masking techniques, with e.g. overprint varnish as the masking material. Masking of the central area of each label 70 in a series of labels, and the overall production of the labels, can be done using flexographic label making processes.

The label 70 can be made by otherwise conventional label manufacturing techniques known by those skilled in the art. Label stock in accordance with the invention is made by coating and curing or drying a PSA on a release liner (either paper or film). The PSA-coated release liner is then laminated to the base strip such that the PSA is trapped between the base strip and the release liner. Areas of the label that are predetermined to be free of adhesive are "deadened" by placing a roll of the label stock on a press (such as manufactured by Mark Andy or Propheteer), dereeling and separating the liner from the base strip (leaving the PSA adhered to the base strip), then deadening the adhesive, typically by selectively coating the desired clear areas with a coating, such as a UV curable overprint varnish (OPV), curing the OPV, and mating the base strip again with the release liner. The base strip can then be printed with registration marks if required. Alternatively, the base strip can be printed with registration marks earlier in the process. The labels are cut to shape by die cutting—typically several lanes at once, depending on the size of the labels and the width of the press, and the unused portions of the label stock, called the "matrix" or "weed", is pulled away, rolled up and discarded. The final steps include slitting to width and winding the labels into rolls. A roll of labels so made is installed in a label applicator 72 (see FIG. 14A).

Alternatively, labels can be made by coating the PSA directly on the base strip and deadening the PSA in areas where desired as described above. There is no liner as the labels (i.e. the base strip with the PSA coat as described) are wound upon themselves like tape. The labels can be perforated in the area between them in the web direction. There is no need to remove the "matrix", or "weed", as these are either cut at application, or pulled apart at the perforations. The final steps include slitting to width and winding the labels into rolls. A roll of labels so made is installed in a label applicator 72 (see FIG. 14A).

Labels can be of any desired shape to suit the shape of the die cut in the web. For example, considered in plan view, the center section of the top edge of the label can be lower than the outer edges of the top edge of the label to allow the hinge of the flap to extend above it, allowing access to the interior after opening. Hence, the outer ends will be slightly higher to cover the "stress relief hooks" of some embodiments of die cuts that form the ends of the opening flap, assuring hermeticity of the package before opening, if desired.

For clarity, label 70 is not shown in FIGS. 33A and 33B in phantom, but it will be understood that label 70 is anchored to the inner surface of first side panel 12. Likewise, to demonstrate the location of label 70, FIG. 33A shows label 70 without the die cut 21 on the web. The die cut is in fact pre-installed on the lay-flat web prior to the application of labels 70 (see FIG. 14A).

The label thus supplies the reclosable (PSA) functionality for the package, and frames the die cut in the web that provides the easy-open functionality for the package. In the case of an open-loop die cut, a flap may be present.

In embodiments where the die cut is completely framed by the lanes of PSA, hermeticity is provided to the package without the need for seals (other than perimeter seals) such as intermediate seal 38, although seal 38 could nevertheless be beneficially installed to improve the ergonomics of opening the package. If hermeticity is not needed, part of the die cut can be outside the frame of the label.

Figure 14A:
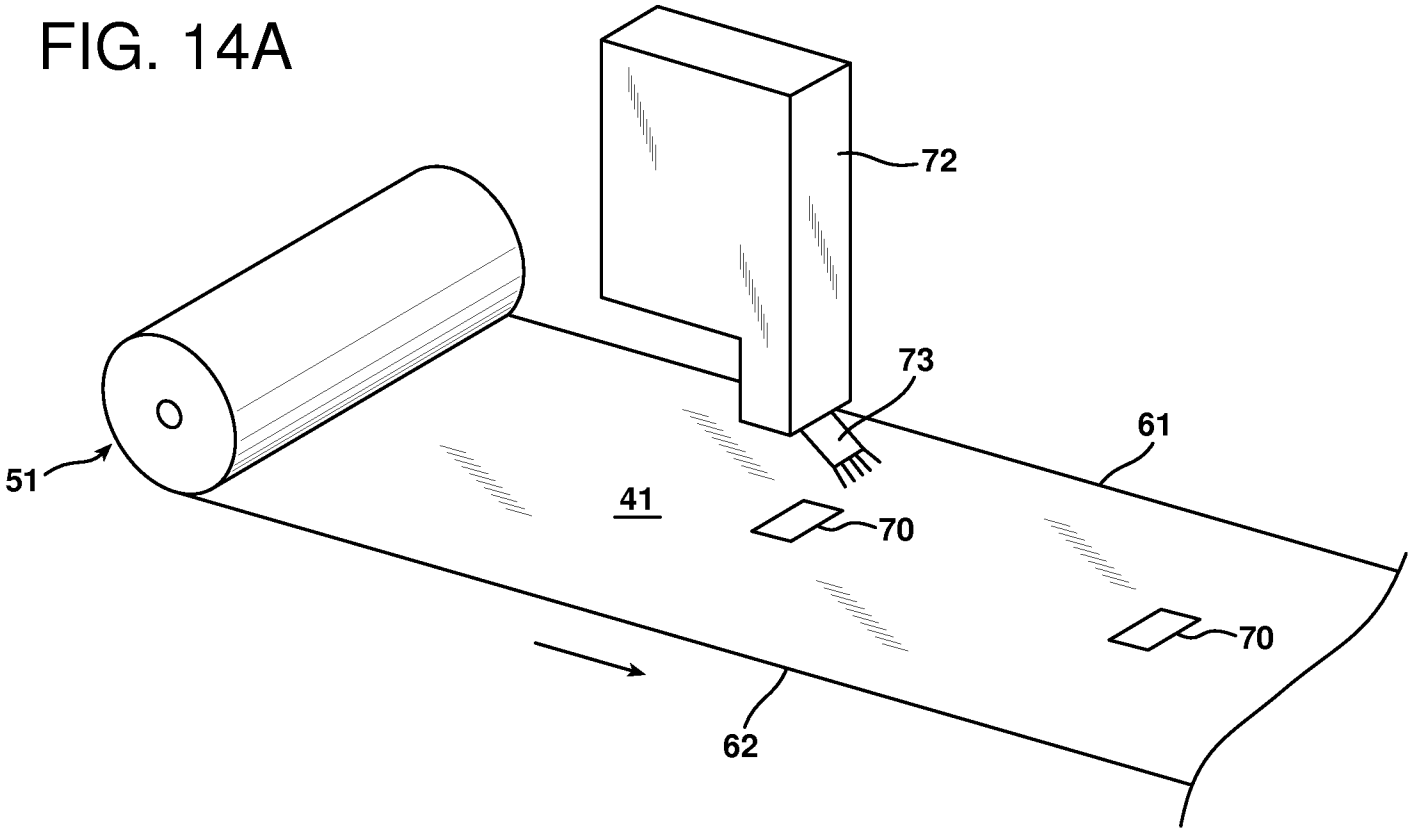
FIG. 14A is a perspective of a roll of lay-flat film and a discrete tape in the form of a label according to yet another embodiment.

Labels can be applied as a periodic pattern on lay-flat web as shown in FIG. 14A. Label applicator 72 applies labels 70 to a first surface of lay-flat web. Any suitable in-line label applicator can be used, such as those available from Label-Aire of Fullerton, Calif., or Arca Etichette SPA Milan, Italy.

To initiate the application of labels 70 to layflat web 41, a sensor or other suitable detection device detects a registration mark, or other suitable feature that has been pre-marked at pre-determined intervals on the web, on the moving web that is a known distance from the die cut on the web. This sensor signals the label applicator 72 to initiate the process of placing a label. The label applicator 72 indexes the release liner containing a series of labels that have been cut to shape as described above in a manner that closely matches the web speed and pulls the liner around a sharp corner. The leading edge of a label releases from the release liner, and its leading edge touches the web at a desired point in relation to the die cut. Pressure is then applied to adhere the label to the web by any suitable means, such as a brush or roller 73. Alternative methods of application, such as tamp, or tamp and blow, as known by those skilled in the art can also be used. Linerless labels are applied in similar manner by labelers provided by Arca Etichette, e.g., without the need to wind up the liner. The label is either cut to length, or pulled apart from the roll of labels at the perforation between labels.

F. Side Seal Bags

Figure 34:
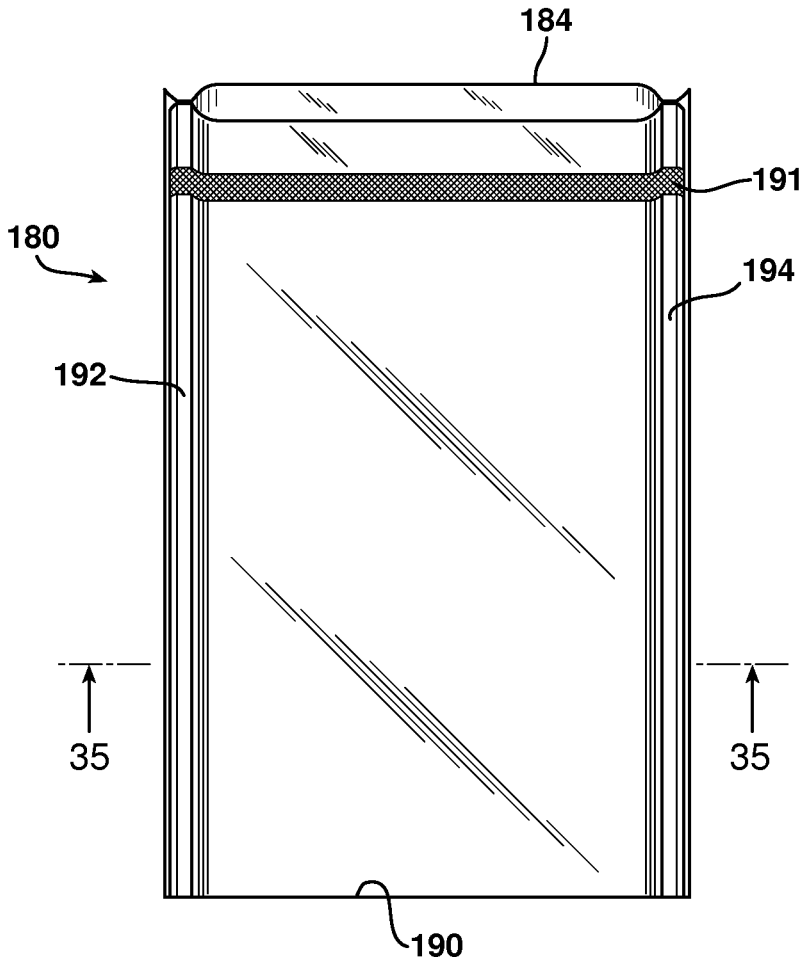
FIG. 34 is a plan view of an alternative embodiment of the invention.
Figure 35:
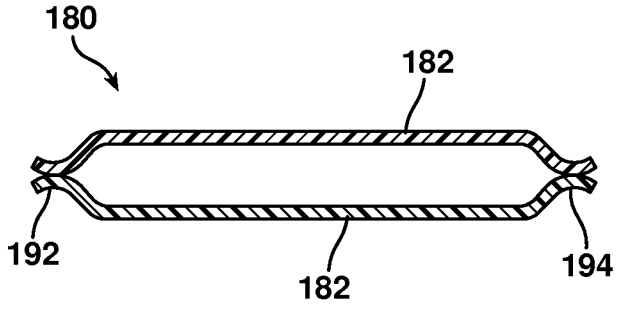
FIG. 35 is a cross sectional view of FIG. 34.

In one embodiment, and referring to FIGS. 34 and 35, the package of the invention can be made using otherwise conventional bag making equipment and processes. Bags are often made as side seal bags. The side seal bag has a factory-made heat seal at opposite bag edges. The bag bottom is formed by one of two folds of film created during the extrusion of bag tubing during manufacture. The opposite fold of film is slit to form a bag mouth. The bag is typically made from a long length of bag tubing. A method of making side seal bags is disclosed in US 2008/0138478 A1 (Ebner et al.), this patent incorporated herein by reference in its entirety.

FIGS. 34 and 35 illustrate bag 180. FIG. 34 illustrates a side seal bag 180, in a lay-flat view; FIG. 35 illustrates a cross-sectional view taken through section 15-15 of FIG. 34. With reference to FIGS. 34 and 35 together, side seal bag 180 comprises a web 182, first edge 184 defining an open mouth, edge fold 190, first side seal 192, and second side seal 194. Discrete tape is installed on the individual bag, or on a slit bag tube that is then cut and sealed at predetermined intervals to make a series of side seal bags 180, by any suitable process such as any of those disclosed herein.

A bag with a die cut and discrete tape disposed thereon can be made by extruding a thermoplastic tube to make a bag tubing; die cutting the bag tubing at predetermined intervals; slitting the tubing at one longitudinal edge thereof; and periodically transversely cutting and sealing the bag tubing to make a plurality of individual bags each with a discrete tape disposed thereon. The discrete tape and die cut can function as described herein for other embodiments and processes, in providing an easy-open and reclosable package. Some of the steps set out in US 2008/0138478 A1, for making a bag, are optional with respect to the present invention; such steps including irradiation and orientation of the tubing.

Method of Operation

Figure 30A:
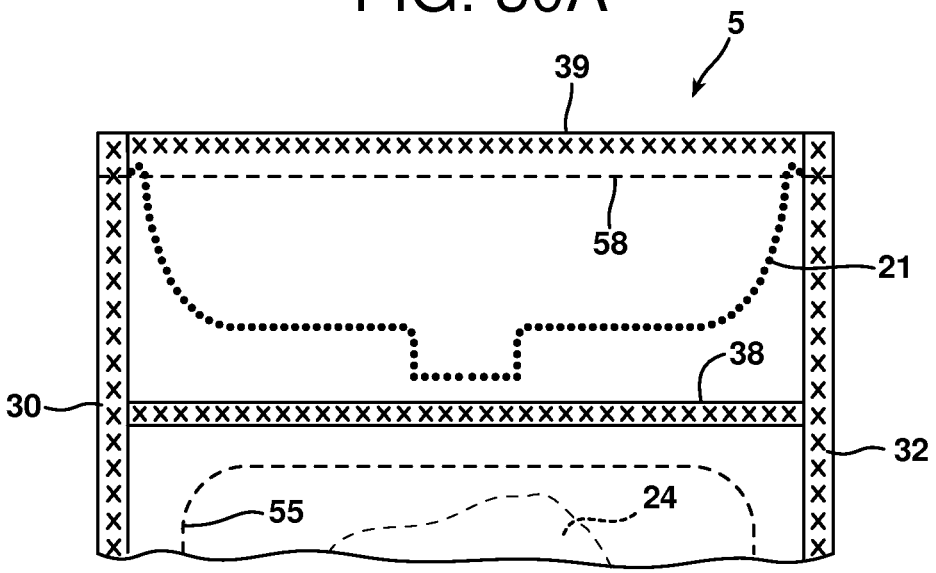
FIGS. 30A, 30B, 30C, 30D, 30E, and 30F are each a plan view of alternative embodiments.
Figure 30B:
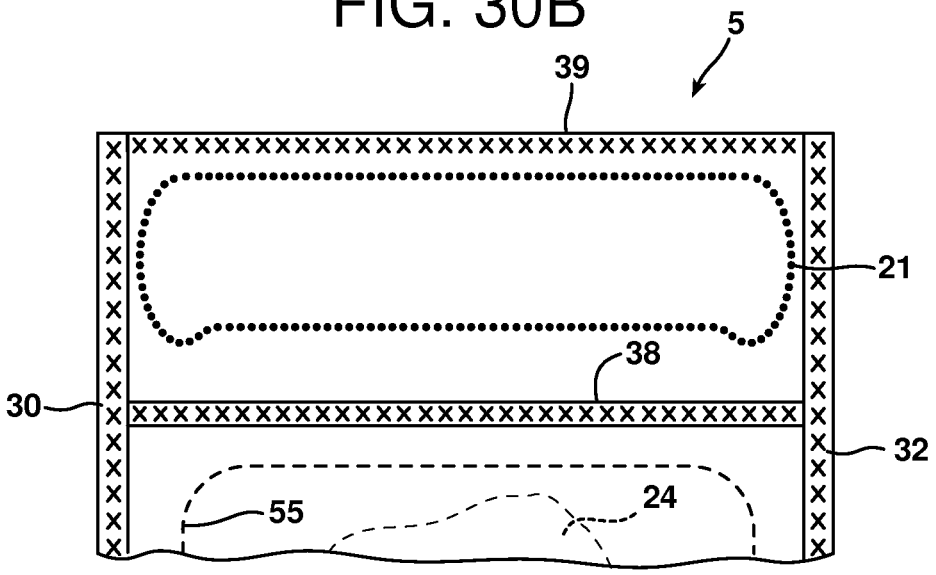
Figure 30C:
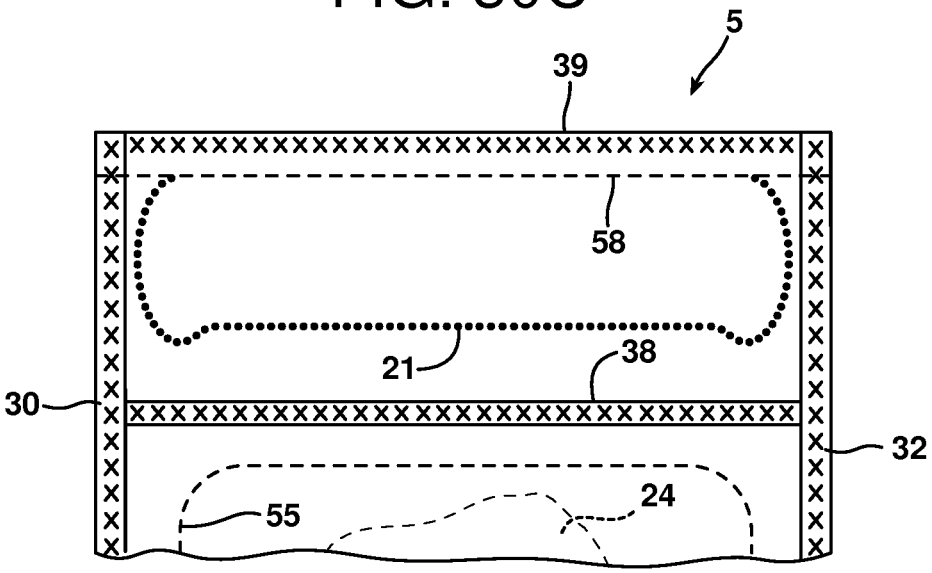
Figure 30D:
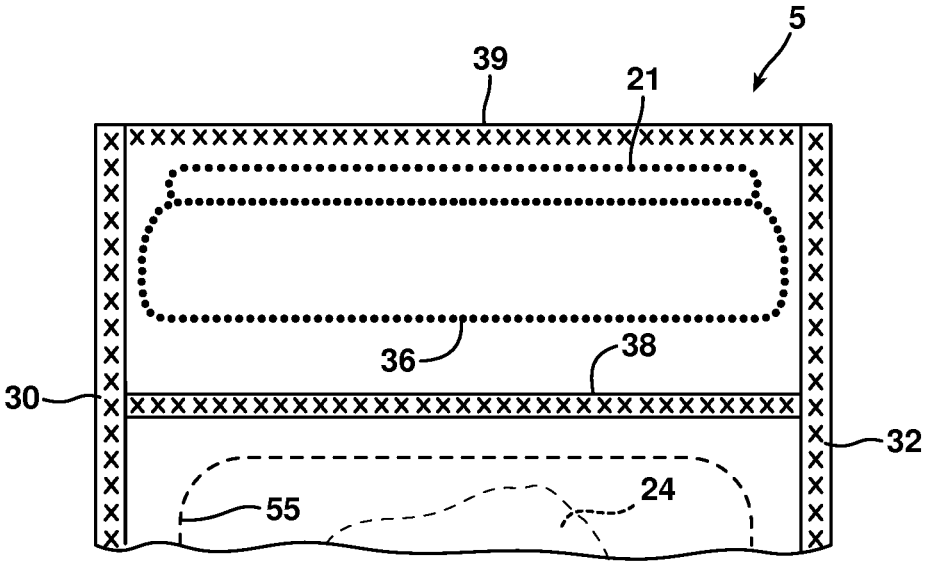
Figure 30E:
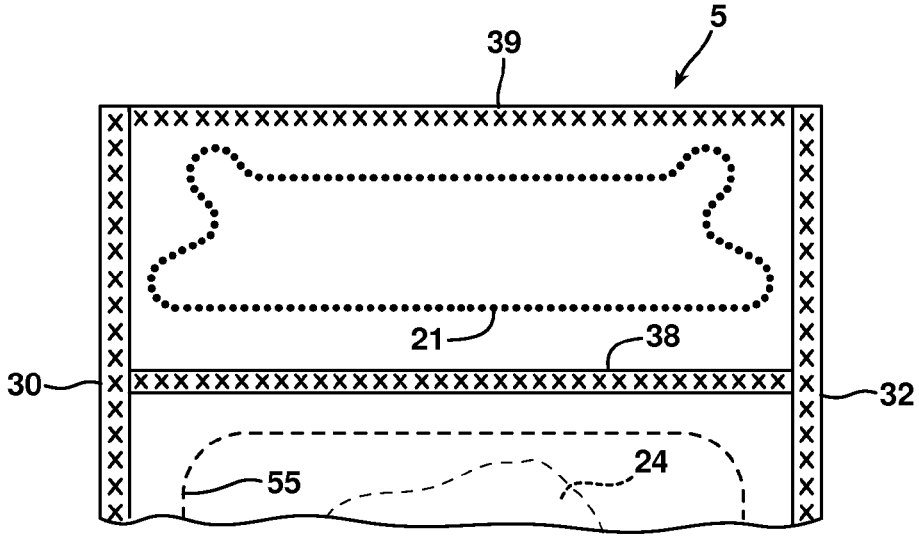
Figure 30F:
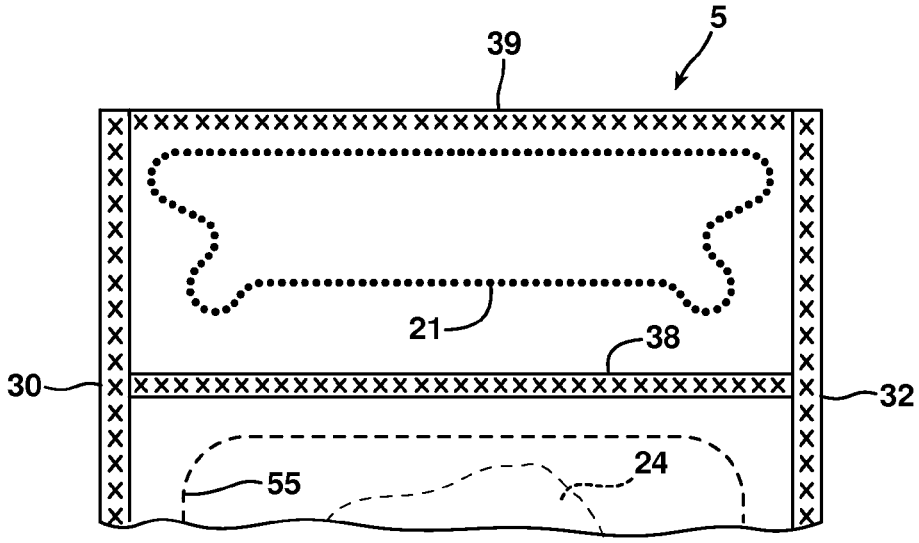

In opening the package of FIGS. 28A to 28D, die-cut segment 56 defined by a first closed-loop die cut 21 (see also FIGS. 29A to 29D) is manually grasped and pulled from the first side panel. Flap 26 is then grasped, along a second die cut 36 and pulled up and back toward the first end of the package along flap hinge 58. The end of strip 10 closest to flap 26 is then grasped and pulled away from the second side panel 14, breaking through the easy-open seal to access product in the interior 57 of the package. During this opening sequence, the anchor in region "A" between surfaces 23 and 27 of first side panel 12 will typically remain intact, such that a portion of the strip 10 stays on and in contact with surface 27. Here, and in FIG. 30D, more than one die cut is present. The first die cut is in some embodiments close-looped, i.e. the die cut defines a die-cut segment that can be displaced or completely removed from the first side panel of the package. The second die cut can also be closed-loop (see e.g. FIG. 30D), or can be open-loop and hinged (FIGS. 29A through 29D) such that the flap formed by a second die cut and a hinge line can be opened without removing the flap from the first side panel of the package. Alternatively, a single die cut can be used, that is either close-looped (FIGS. 30B, 30E, 30F) or includes a hinge line (FIG. 30C). Each die cut can be of any suitable geometry and depth. In the area of first die cut region "C" on the first side panel of FIGS. 2A and 28A, there is neither a seal nor PSA holding the strip to the inner surface 27. This leaves an area of the package where a portion of the first side panel can be relatively easily removed. PSA layer 19 is exposed when the package is opened in each of these embodiments. To reclose the package, a portion of the second side panel can be folded over to contact the PSA; or the flap of the first side panel can be placed down on the PSA. The package can be opened and reclosed several times. When the package is opened, the PSA is positioned facing the outside of the package. This is useful especially with food products where it is undesirable to have the PSA facing the interior of the package, and thus potentially in contact with the product.

Method of Applying a PSA Layer to a Base Strip

Figure 32:
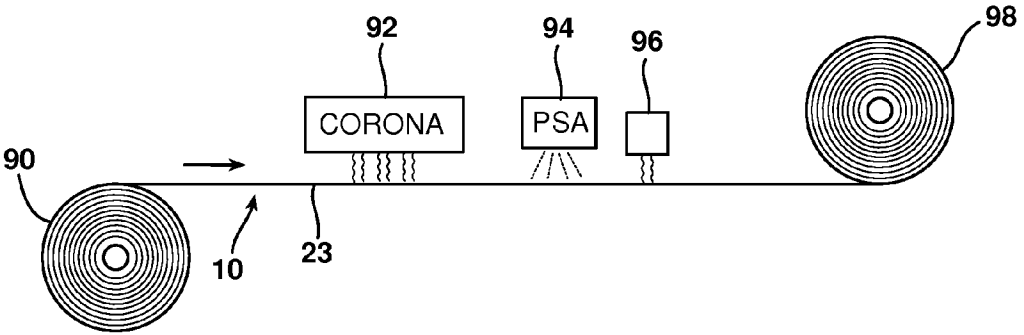
FIG. 32 is an apparatus and process for making a discrete tape.

FIG. 32 shows a method of applying a PSA layer to a base strip to make a discrete tape, comprising the following steps:

1) advancing base strip 10 by suitable motive means (not shown, and well known in the art, such as a motor) from roll 90.

2) Optionally, corona treating surface 23 using a conventional corona treater 92 in preparation for the application of a PSA to the treated surface. The PSA may adhere to strip 10 without corona treatment. However, in this embodiment, depending on the materials chosen, the PSA may, upon opening of a package, exhibit cohesive failure, or alternating adhesive failure, i.e. some of the PSA may adhere to strip 10, and some to surface 27.

3) applying a coating of PSA 59 to substantially the entire surface 23 of strip 10. A conventional PSA applicator 94 is shown applying PSA to now corona treated surface 23. The PSA can be of any suitable composition and thickness. The thickness of the coating of PSA may vary from one portion of the coated surface to another. This is acceptable as long as the finished package functions in its intended way with respect to its reclosability. As an alternative, a silicon-coated transfer paper can be coated with PSA, and the PSA-coated paper is then laminated to corona treated strip 10. When the liner is removed, the PSA remains with the strip 10.

4) providing, in a selected portion of surface 23, a clear area.

5) curing the coating of PSA. Curing can be accomplished by any suitable process, taking into account the type of PSA being used, including hot air drying by a conventional hot air dryer 96.

6) advancing resulting tape 8 to take-up roll 98.

Method of Making a Die Cut in a Web

A conventional die cutter can be used to create a first die cut 21, and optionally one or more additional die cuts 36 in a web that is used to make first side panel 12. Die cuts can be made by any suitable conventional process and equipment. Any suitable pattern of die cut can be used, open or closed-loop, as long as it serves the function of providing an easy open package in which the packaged product can be accessed by means of a flap created at least in part by the die cut. Alternative patterns include elliptical, oval, triangular, three side rectangle, hour glass, "dog bone", and other regular and irregular shapes.

The die cut extends completely through the first side panel, or may extend through most of, but not entirely through, the thickness of the panel. The die cut may extend through e.g. at least 50% of the thickness of the first side panel, e.g. at least 60%, at least 70%, at least 80%, at least 90%, at least 95%, or 100% of the thickness of first side panel 12.

A laser system can be configured to produce a laser cut that cuts partly or completely through the panel, or alternatively, a die cut can be made using a mechanical cutting system using rotary engraved dies, or steel rule dies supported in platens as used in reciprocating presses. The choice of die cutting technique depends on several factors, including the thickness and physical nature of the film or web to be cut.

The die cut may act as a tamper evident feature.

The application of PSA to the strip, the die cutting of a web to produce a first side panel, and the assembling of a package incorporated a die cut web and a PSA coated strip, can be done at a single location, but more practically will typically be done at separate locations, with the assembling of the package by a packager using pre-provided PSA coated strip and a die cut web prepared elsewhere and provided in advance of the packaging process.

PACKAGE EXAMPLES

Example 1

A package is made in accordance with the embodiment illustrated in FIG. 2D and described herein, in a horizontal form/fill/seal system. First and second side panels 12 and 14 respectively each comprise H7530B, a laminate having the construction:

| | | |
|---|---|---|
| chemically treated PET | polyurethane adhesive | coextruded barrier film |

where the PET is a biaxially oriented polyester film, and the coextruded barrier film has the construction:

| Layer 1 | Layer 2 | Layer 3 | Layer 4 | Layer 5 | Layer 6 | Layer 7 |
|---|---|---|---|---|---|---|
| PE2 | EV1 | AD3 | OB1 | AD3 | EV1 | 76% PE3 + 20% PE4 + 4% AB1 |
| 0.63 | 0.33 | 0.19 | 0.23 | 0.19 | 0.33 | 0.63 |

The overall thickness of the coextruded barrier film is about 2.50 mils. Layer gauges in mils for each layer are indicated below each layer. Layer 7 is the layer of the barrier film adhered, by the adhesive, to the PET film. Layer 1 is the heat sealant layer of the film, and the EAO (PE2) of layer 1 forms the inner or sealant surface of the package, facing the contained product, and the PET forms the outer or skin surface of the package. The thickness of the PET film is about 0.48 mils. The overall thickness of the laminate is about 3.0 mils.

Alternatives to the composition of layer 7 include various combinations of materials, including:

96% PE3+4% AB1.

100% PE3.

76% PE3+20% PE8+4% AB1.

The base strip of the package is an extrusion laminated film that has the construction:

| Layer 1 | Layer 2 | Layer 3 | Layer 4 | Layer 5 |
|---|---|---|---|---|
| 85% PE6 + 15% PE7 | EM1 | PET2 | EM1 | PE7 |
| 0.75 | 0.25 | 1.50 | 0.25 | 0.75 |

The overall thickness of the base strip is about 3.5 mils. Layer gauges in mils for each layer are indicated below each layer. Layer 5 is the layer of the base strip to which the PSA is pattern coated. Layer 1 is the layer of the base strip facing the interior of the package.

Before the package is made, a PSA (acResin® A 204 UV) carrying 15% tackifier (FORAL® 85 synthetic resin) by weight of the total PSA/tackifier composition is pattern coated on a first portion of layer 5 of the base strip, the PSA/tackifier composition is UVcured, and the resulting tape adhered by the PSA to the H7530B web (specifically, to layer 1 of the coextruded barrier film of the H7530B laminate) while the latter is in a lay-flat condition. A closed loop die cut is made in the web by a $CO_2$ laser prior to applying the tape to the web; the die cut defining a die cut segment that is positioned so as to result in the package as shown in FIG. 2D.

Example 2

A package like that of package example 1 is made, but in which 25% tackifier is used in the PSA/tackifier composition.

Example 3

A package like that of Example 1 is made, but in which the coextruded barrier film of the first and second side panel is a nine-layer film with a composition very similar to the seven layer film construction of Example 1, but having an additional intermediate layer of EV1, and an additional intermediate layer of a LDPE or a blend including LLDPE.

Example 4

A package like that of Example 2 is made, but in which the coextruded barrier film of the first and second side panel is a nine-layer film with a composition very similar to the seven layer film construction of Example 1, but having an additional intermediate layer of EV1, and an additional intermediate layer of a LDPE or a blend including LLDPE.

The above descriptions are those of embodiments of the invention. All parts and percentages are by weight, unless otherwise indicated or well understood in the art. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by reference.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

Both the web or webs used in the manufacture of the package according to the invention, and the base strip of the invention, can be made by any suitable process, including coextrusion, extrusion coating, extrusion lamination, and conventional lamination using polyurethane or other adhesives. These manufacturing processes are well known in the art. Extrusion can be done in annular or flat dies. The extrudate can be hot blown or cast, and optionally solid-state oriented as desired. Chemical or electronic crosslinking of one or more layers of the webs or the strip can be done. Both web and strip can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics.

Printed indicia can be in the form of a message e.g. "easy open" or "open here". This can be printed in scattered process (i.e. registration is not required) on or near the first end of the package. The message is surface printed or reverse printed.

In some embodiments, such as those shown in FIGS. 8 to 14, it may be beneficial to adhere the discrete tape to the lay-flat web prior to processing on equipment, or at the time, before processing, when the tape is disposed on the web. Any suitable means, such as permanent adhesive or heat sealing, can be used to seal the tape to the web to ensure that the tape maintains its position on the web during processing. In these embodiments, the tape is anchored to the web at the interface between the web and the surface of the tape comprising a sealant layer that provides a relatively strong seal. The tape can be e.g. sealed to the web by a suitable device (not shown) such as a heat sealer, disposed below the web (see FIGS. 8 and 12) while the web is in its lay-flat condition, that seals the tape to the web. In such embodiments, the surface of the discrete tape that comprises the easy-open surface faces away from the web, so that the opposite surface of the discrete tape is sealed to the web. This approach leaves the easy-open surface unaffected until such time as the package is made and closed, or until e.g. the lap or fin seal is made on the pouch.

In the embodiments disclosed herein, the first end of the package can be sealed, typically where two webs are used to make the package. Alternatively, the first end of the package can be a fold, e.g. where a single web of material is used to make the package.

The present invention, including the package and methods as disclosed herein, is provided in several embodiments in the absence of: plastic zipper closures; press-to-close or slide zippers; interlocking closures; reclosable fasteners with interlockable fastener elements; interlocking rib and groove elements having male and female profiles; interlocking alternating hook-shaped closure members, and the like. The package of the invention is provided herein in the absence of a release liner for a PSA layer or coating. None of these aforementioned closures, zippers, elements, etc. is present in the package of the invention.

Although the invention is described in some embodiments herein as a package comprising a pouch comprising a first and second side panel each having a top edge, a first side edge, and a second side edge, those skilled in the art will understand, after a review of this disclosure, that in some embodiments, wherein a single web is used, the terms "side panel", "top edge", "first side edge", "second side edge", and the like are used for convenience to describe the relative locations or regions on a single web made into a pouch, so that the overall geometry of the package, and relative positions of the various features of the invention can be described. Thus, for instance, the first and second panels in a single web embodiment of the invention can be simply defined regions of the pouch, and the package made therefrom, and side edges are simply the side end lines of those regions. In such embodiments, the line of joinder of the side edges are the two side folds in the web that define the sides of the package. In contrast, in embodiments with two webs, each web when produced will have an identifiable first and second side edge, that will each be joined to a respective side edge of a second web.

Although the first and second side panels are shown in various embodiments as having the same length, the second side panel can in some embodiments be longer than the first side panel, i.e. the first end of the second side panel can extend beyond the first end of the first side panel, or vice versa. The extended portion can e.g. accommodate a hang tab with a hole therein, or function as a fold-over flap for reclosing the package after opening.

In some embodiments, a seal can be applied obliquely across each of the two corners of the first side panel of a package of the invention, closest to the first end of the package, such that they cross over and seal two corners of the discrete tape to the first side panel. These angled seals can be useful in facilitating the reclosure of the package after opening, and/or in assuring the integrity of the package before initial opening. The seals can overlap a portion of a die cut 21 in the first side panel at upper edges of the die cut. Optionally, the die cut can be discontinuous in the regions of the die cut where the angled seals are present.

In some embodiments, a die cut can be installed on the second side panel near its first end, or the region of a lay-flat web or folded web that will form the second side panel, that can act as a fold line for facilitating reclosure of the package. This die cut, which can be a score, can be of any suitable geometry, e.g. a straight line, positioned to ease or direct the folding of the second side panel to reclose the package after opening.

Those skilled in the art will appreciate that in describing a panel, strip or the like being "sealed" to another panel, strip, or the like, sealing is done by conventional means as described, and typically occurs in seal widths consistent with industry practice for packaging.

Packages of the various embodiments of the invention disclosed herein can optionally be vacuumized or gas flushed by otherwise conventional means. A package in accordance with the invention can contain a modified atmosphere.

What is claimed is:

1. An easy-open and reclosable package comprising:

a) a pouch comprising i) a first and second side panel each comprising an outer and inner surface, a first and second side edge, and a first and second end, the first and second side panels joined together along their respective first and second side edges;

ii) a first end defined by the first end of at least one of the first and second side panels;

iii) a second end defined by the second ends of the first and second side panels respectively;

iv) the first and second side panels joined together along their respective second ends;

v) a discrete tape, disposed between the first and second side panels, comprising a base strip comprising a first and second surface, a first and second end, and a first and second side edge, wherein (a) the base strip is spaced apart from the first end of the pouch, and spaced apart from the second end of the pouch, (b) at least a first portion of the first surface is coated with a pressure sensitive adhesive, and (c) the at least first portion of the first surface is adhered by the pressure sensitive adhesive to the inner surface of the first side panel at a first location on the first side panel, and a second portion of the first surface is anchored to the inner surface of the first side panel at a second location on the first side panel; and vi) a die cut disposed in the first side panel, the die cut defining a die cut segment, wherein a first portion of the die cut segment is underlain by pressure sensitive adhesive, and a second portion of the die cut segment is underlain by a clear area of the first surface of the base strip, the die cut segment so arranged with respect to the discrete tape that when the die cut segment is removed, at least a portion of the pressure sensitive adhesive is exposed, at least a portion of the first end of the base strip is exposed, and when the package is opened, the second portion of the first surface of the base strip remains anchored to the inner surface of the first side panel at the second location on the first side panel, and the package can thereafter be reclosed by adhering one of the first and second panels to the pressure sensitive adhesive; and vii) the first end of the first side panel joined to the second side panel; and b) a product disposed in the pouch.

2. The package of claim 1 wherein the base strip is spaced apart from the first and second side edges of the first and second side panels.

3. The package of claim 1 wherein the die cut segment includes a first portion wherein the die cut extends partially through the first side panel, and a second portion wherein the die cut extends entirely through the first side panel.

4. The package of claim 1 wherein a supplemental seal seals the first side panel to the first end of the base strip.

5. The package of claim 1 wherein at least one of the first and second surfaces of the base strip is sealed to the inner surface of the first or second side panel respectively with an easy-open seal.

* * * * *